US008792793B2

(12) United States Patent
Kawai et al.

(10) Patent No.: US 8,792,793 B2
(45) Date of Patent: Jul. 29, 2014

(54) REPLACEMENT CONSUMABLE UNIT MANAGEMENT APPARATUS AND IMAGE FORMING APPARATUS

(75) Inventors: Atsushi Kawai, Totokawa (JP); Kazuo Okunishi, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 220 days.

(21) Appl. No.: 13/164,879

(22) Filed: Jun. 21, 2011

(65) Prior Publication Data

US 2011/0311243 A1 Dec. 22, 2011

(30) Foreign Application Priority Data

Jun. 22, 2010 (JP) ..... 2010-141265
Jul. 30, 2010 (JP) ..... 2010-173128

(51) Int. Cl.
*G03G 15/01* (2006.01)

(52) U.S. Cl.
USPC ..... 399/8; 399/28

(58) Field of Classification Search
USPC ..... 399/8
See application file for complete search history.

(56) References Cited

U.S. PATENT DOCUMENTS 6,588,870 B2 7/2003 Aruga et al.
6,798,995 B2 9/2004 Nagata
7,426,482 B2 * 9/2008 Inami et al. ..... 705/26.82

(Continued)

FOREIGN PATENT DOCUMENTS

JP 2001-325351 A 11/2001
JP 2002-297969 A 10/2002

(Continued)

OTHER PUBLICATIONS

Office Action (Notification of Reasons for Refusal) dated Jun. 26, 2012, issued in corresponding Japanese Patent Application No. 2010-173128, and an English Translation thereof. (7 pages).

(Continued)

*Primary Examiner* — Walter L Lindsay, Jr.
*Assistant Examiner* — Philip Marcus T Fadul
(74) *Attorney, Agent, or Firm* — Buchanan Ingersoll & Rooney

(57) ABSTRACT

A replacement consumable unit management apparatus is provided with: a receiver which receives consumable unit replacement information indicating that one consumable unit of one color or more than one consumable unit of different colors has been replaced with a new one, from one or more than one image forming apparatus which the replacement consumable unit management apparatus can access via a communication circuit; a consumable unit manager which manages the remaining amount information or the life information of the one or more than one consumable unit, and stock information indicating the states of the stocks of replacement consumable units for the one or more than one consumable unit; a determiner which, if the receiver receives the consumable unit replacement information while a consumable unit which cannot be replaced with a new one because of no stock and a consumable unit whose remaining amount information or life information is smaller than a first predetermined value are both used at the same place as the new consumable unit most recently loaded, makes a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together; and a transmitter which outputs a delivery instruction as determined by the determiner.

26 Claims, 24 Drawing Sheets

(56) References Cited

U.S. PATENT DOCUMENTS

| | | | | |
|---|---|---|---|---|
| 7,676,164 | B2 | 3/2010 | Shiori et al. | |
| 2002/0099630 | A1 | 7/2002 | Aruga et al. | |
| 2004/0103048 | A1* | 5/2004 | Vitulli et al. | 705/28 |
| 2008/0201374 | A1* | 8/2008 | Oya | 707/104.1 |

FOREIGN PATENT DOCUMENTS

| | | | |
|---|---|---|---|
| JP | 2002-318850 | A | 10/2002 |
| JP | 2006-033000 | A | 2/2006 |
| JP | 2007-155752 | A | 6/2007 |
| JP | 2008-271231 | A | 11/2008 |

OTHER PUBLICATIONS

Office Action (Notification of Reasons for Refusal) dated Apr. 24, 2012, issued in corresponding Japanese Patent Application No. 2010-141265, and an English Translation thereof. (9 pages).

* cited by examiner

| Remaining Toner Information | Permit/ Prohibit Printing | Panel Display | Toner State |
|---|---|---|---|
| Normal | Permit printing | (No message displayed) | The sub-hopper and the toner cartridge hold enough toner. |
| Toner Near Empty | Permit printing | One-line message: "There will be a need for toner cartridge replacement in a short time." | The sub-hopper holds some toner but the toner cartridge nearly runs out of toner. |
| Toner Empty (permit printing) | Permit printing | One-line message: "The toner cartridge is running out of toner. Please replace." | The sub-hopper holds some toner but the toner cartridge absolutely runs out of toner. |
| Toner Empty (prohibit printing) | Prohibit printing | Strong Alert message: "The toner cartridge has run out of toner. Please immediately replace and close the toner garage door." | The sub-hopper and the toner cartridge absolutely run out of toner, and printing is not available any more due to low toner concentration. |

FIG.10

| | Full | Normal | Near Empty | Empty (Permit Pinting) | Empty (Prohibit Printing) |
|---|---|---|---|---|---|
| Y(Yellow) | | | | ○→◎ | |
| M(Magenta) | | | ○ | | |
| C(Cyan) | | ○ | | | |
| K(Black) | △→○ | | | | |

| | Full | Normal | Near Empty | Empty (Permit Pinting) | Empty (Prohibit Printing) |
|---|---|---|---|---|---|
| Y(Yellow) | ◎→○ | | | | |
| M(Magenta) | | | ○ | | |
| C(Cyan) | | ○ | | | |
| K(Black) | | ○ | | | |

FIG.13

| | Full | Normal | Near Empty | Empty (Permit Pinting) | Empty (Prohibit Printing) |
|---|---|---|---|---|---|
| Y(Yellow) | | | ○ | | |
| M(Magenta) | | | ○ | | |
| C(Cyan) | | ○ | | | |
| K(Black) | △ | | | | |

FIG.14

| | Full | Normal | Near Empty | Empty (Permit Pinting) | Empty (Prohibit Printing) |
|---|---|---|---|---|---|
| Y(Yellow) | | | | ○→◎ | |
| M(Magenta) | | | ○ | | |
| C(Cyan) | | ○ | | | |
| K(Black) | | △→○ | | | |

FIG.15

| | | Stock Information | | |
|---|---|---|---|---|
| | | △ (there is no replacement toner in stock) | ○ (there is replacement toner in stock; delivery has not been arranged) | ◎ (there is replacement toner in stock; delivery has been arranged) |
| Remaining Toner Information | Normal | To be delivered with the other one | Not to bedelivered with the other one | Not to bedelivered with the other one |
| | Near Empty | To be delivered with the other one | Not to bedelivered with the other one | Not to bedelivered with the other one |
| | Empty (Permit Printing) | To be delivered with the other one | To be delivered with the other one | Not to bedelivered with the other one |
| | Empty (Prohibit Printing) | To be delivered with the other one | To be delivered with the other one | Not to bedelivered with the other one |

FIG. 17

REPLACEMENT CONSUMABLE UNIT MANAGEMENT APPARATUS AND IMAGE FORMING APPARATUS

This application claims priority under 35 U.S.C. §119 to Japanese Patent Application No. 2010-141265 filed on Jun. 22, 2010 and Japanese Patent Application No. 2010-173128 filed on Jul. 30, 2010, the entire disclosure of which is incorporated herein by reference in its entirety.

BACKGROUND OF THE INVENTION

1. Field of the Invention

The present invention relates to: a replacement consumable unit management apparatus which determines a right replacement consumable unit and a right delivery address when a consumable unit loaded on an image forming apparatus is replaced with a new one; and an image forming apparatus which determines a right replacement consumable unit or a right delivery address when a consumable unit loaded on the image forming apparatus itself or another image forming apparatus is replaced with a new one.

2. Description of the Related Art

The following description sets forth the inventor's knowledge of related art and problems therein and should not be construed as an admission of knowledge in the prior art.

Conventionally, if the remaining consumable resource in a consumable unit loaded on an image forming apparatus such as a digital photo copier, a digital photo printer, or a multifunctional machine called MFP (Multi Function Peripheral), for example, the remaining toner in a toner cartridge is lower than a predetermined level, the image forming apparatus determines that the toner cartridge nearly runs out of toner (the toner cartridge is in toner near empty state) and displays for the user a message stating that the toner cartridge nearly runs out of toner, on a display panel provided thereon. Noticing this message, the user prepares a replacement toner cartridge, or places an order for a replacement toner cartridge if not having any ones in stock.

Meanwhile, in recent years, an image forming apparatus connected with a management apparatus to exchange information with has been more commonly used in a remote management system (for example, Japanese Unexamined Patent Publication No. 2002-297969). In many cases, a retailer of image forming apparatuses or a provider of office supplies have their own management apparatus in their own place, in order to collect, store, and manage for their business, various types of information including toner near empty information from a plurality of image forming apparatuses in their users' places. Being connected with the image forming apparatuses, the management apparatus is capable of recognizing that the toner cartridges nearly run out toner and that these are replaced with new ones.

In some cases, the management apparatus is further connected with an order receiving apparatus receiving orders for a replacement toner cartridge (for example, Japanese Unexamined Patent Publication No. 2008-271231). In such a case, the management apparatus further transmits an order to the order receiving apparatus, so that a replacement toner cartridge will be delivered to the user. In other words, this is exactly a system to automatically deliver a replacement toner cartridge to users while they need not bother to place an order for it.

Such an automatic order and delivery system is very useful if the manufacturer and the user are in an agreement about billing and payment for the use of an image forming apparatus. In accordance with such an agreement, the user pay a service fee for making one copy, which includes a charge for the toner used for the copy. That is, it is convenient for the user to pay a service fee simply depending on the number of copies regardless of how many replacement toner cartridges they ordered and have a replacement toner cartridge automatically delivered without the need for placing an order for it. At the same time, the manufacturer can expect a benefit from saving the costs of handling order transactions.

However, while acquiring a benefit from saving the costs of the labor to handle order transactions, the manufacturer still pay the costs of delivering a replacement toner cartridge, using an automatic order and delivery system in which a management apparatus automatically places an order for it based on a condition about remaining toner level (for example, toner near empty information or toner cartridge replacement information).

For example, it is not preferred in terms of cost-effectiveness that the management apparatus receives such information repeatedly from four toner cartridges loaded on a color image forming apparatus, and automatically outputs a delivery instruction again and again. Actually, the four toner cartridges are supposed to randomly run out of toner and some of them may run out of toner nearly at the same tome. If necessary replacement toner cartridges are delivered together in one package, the manufacturer will save the costs of delivery. On the other hand, if necessary replacement toner cartridges are delivered together in one package, the user will need to keep a larger space for storing them.

In order to resolve this conflict, there is a demand for a delivery control technology which can save the costs of delivery without requiring the user to keep a larger space to store delivered replacement toner cartridges.

Such a delivery control technology should be applied to not only the consumable units of a particular type which consume their consumable resources for making copies just like the toner cartridges which consume their toner for making copies, but also the consumable units of another particular type which partially get near to their ends of life due to making copies just like the imaging units including photoreceptor drums, photoreceptors of which get near to their ends of life due to making copies.

Actually, in addition to toner cartridges, the image forming apparatuses also load consumable units of other types: a transfer belt unit, photoreceptor units, developer units, fuser units, and the like which need to be replaced with new ones in their respective predetermined manners. The manufacturer's technical staff called service engineers usually visit their users to replace the consumable units of that type having gotten old. If it is determined around at the same time that a service engineer should be sent to a user's place to replace a consumable unit such as a transfer belt having ended its life and an instruction to deliver a replacement toner cartridge should be outputted according to the need, there possibly will be inconveniences as to be described in the following cases.

[Case-1]

A service engineer may visit the user's place and replace both the transfer belt unit and the toner cartridge with new ones at the same time before the user receive a replacement toner cartridge which was automatically shipped out by the manufacturer according to the delivery instruction.

Receiving the replacement toner cartridge, without noticing that the toner cartridge has been replaced with a new one, the user may further replace the new toner cartridge with the received replacement toner cartridge, wasting the toner almost fully contained in the new toner cartridge.

Even if noticing that the toner cartridge has been replaced with a new one, the user would need to have in stock the received replacement toner cartridge. And the next time there is a need to replace a toner cartridge, the user receives another replacement toner cartridge which is automatically shipped out by the manufacturer and always needs to keep one replacement toner cartridge in stock.

In order to resolve this inconvenience, the service engineers will need to operate the delivery system to enter and correct the stock quantities of their users. However, it would be troublesome for them to check whether or not a delivery instruction has been outputted and operate the delivery system to correct a stock quantity if it has been outputted, everytime after replacing both a transfer belt unit and a toner cartridge, or they probably would even forget going through that process.

[Case-2]

A service engineer may visit the user's place and replace only the transfer belt unit with a new one before the user receives a replacement toner cartridge which was automatically shipped out by the manufacturer according to the delivery instruction. Receiving the replacement toner cartridge and noticing that the toner cartridge has not been replaced with a new one, the user may be unhappy with that the service engineer did not care about the toner cartridges.

As described above, the inconveniences: the costs of stock check, the costs of stock keeping, and bad user experience possibly will be caused.

The manufacturer's service engineers may, visit their users not only to replace old consumable units but also to clean and check the image forming apparatuses, at regular time intervals. The same holds true in this case, too; the same inconveniences possibly will be caused since such a service engineer also may replace both a transfer belt unit and a toner cartridge with new ones or replace only a transfer belt unit with a new one, before the user receives a replacement toner cartridge.

In order to resolve the inconveniences, it is only necessary that the service engineers visit their users for consumable unit replacement and/or a routine service, carrying a replacement toner cartridge which is supposed to be delivered via courier according to a delivery instruction.

Despite people have been waiting for a technology to resolve the inconveniences: the costs of delivery, the costs of stock check, the costs of stock keeping, and bad user experience, such a technology is not disclosed in the Japanese Unexamined Patent Applications No. 2002-297969 and No. 2008-271231 and other conventional inventions which have a management apparatus manage toner cartridges loaded on image forming apparatuses and output an instruction to deliver a replacement toner cartridge according to the need.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The Preferred embodiments of the present invention can significantly improve upon existing methods and/or apparatuses.

It is an object of the present invention to provide replacement consumable unit management apparatuses which contribute to saving the costs of delivery without causing the costs of stock check, the costs of stock keeping, and bad user experience, by determining a right replacement consumable unit and a right delivery address, and outputting a delivery instruction accordingly.

It is another object of the present invention to provide an image forming apparatus which contributes to saving the costs of delivery without causing the costs of stock check, the costs of stock keeping, and bad user experience, by determining a right replacement consumable unit and a right delivery address, and outputting a delivery instruction accordingly.

According to a first aspect of the present invention, a replacement consumable unit management apparatus is provided with:

a receiver which receives consumable unit replacement information indicating that one consumable unit of one color or more than one consumable unit of different colors has been replaced with a new one, from one or more than one image forming apparatus which the replacement consumable unit management apparatus can access via a communication circuit;

a consumable unit manager which manages the remaining amount information or the life information and the stock information indicating the states of the stocks of replacement consumable units, by the consumable units of the different colors;

a determiner which, if the receiver receives the consumable unit replacement information while a consumable unit which cannot be replaced with a new one because of no stock and a consumable unit whose remaining amount information or life information is smaller than a first predetermined value are both used at the same place as the new consumable unit most recently loaded, makes a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together; and a transmitter which outputs a delivery instruction as determined by the determiner.

According to a second aspect of the present invention, an image forming apparatus is provided with:

a detector which detects that any consumable unit loaded on the image forming apparatus or loaded on a different image forming apparatus which the image forming apparatus can access via a communication circuit has been replaced with a new one;

a consumable unit manager which manages the remaining amount information or the life information and the stock information indicating the states of the stocks of replacement consumable units, by the consumable units of the different colors;

a determiner which, when the detector detects that any consumable unit has been replaced with a new one, determines a right replacement consumable unit to be delivered to the same place as the new consumable unit most recently loaded, based on the remaining amount information or the life information and the stock information which are all managed by the consumable unit manager; and a transmitter which outputs a delivery instruction as determined by the determiner.

According to a third aspect of the present invention, a replacement consumable unit management apparatus is provided with:

a receiver which receives the life information of a first consumable unit from one or more than one image forming apparatus which the replacement consumable unit management apparatus can access via a communication circuit, and the life information of a second consumable unit loaded on the image forming apparatus causing the life information of the first consumable unit and/or a different image forming apparatus provided at the same place as the image forming apparatus causing the life information of the first consumable unit;

a transmitter which outputs an instruction to deliver a replacement consumable unit for the first consumable unit, depending on the life information of the first consumable unit; and a determiner which determines a first delivery address or a second delivery address for a replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

According to a fourth aspect of the present invention, a replacement consumable unit management apparatus is provided with:

a receiver which receives the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus causing the life information of the first consumable unit and/or a different image forming apparatus provided at the same place as the image forming apparatus causing the life information of the first consumable unit;

a transmitter which transmits an instruction to deliver a replacement consumable unit for the first consumable unit, depending on the life information of the first consumable unit which is received by the receiver; and a determiner which determines a first delivery address or a second delivery address for a replacement consumable unit for the first consumable unit, based on the service log information if the receiver receives the service log information before the transmitter outputs the delivery instruction, and wherein the transmitter that outputs an instruction to deliver a replacement consumable unit for the first consumable unit to the determined delivery address.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 10 is a table illustrating the statuses depending on remaining toner level;

FIG. 13 is illustrates a table indicating the remaining toner levels of the toner cartridges of the respective colors and the states of the stocks of replacement toner cartridges of the same when the toner cartridge of Yellow (Y) is further replaced with a new one, i.e. when the management apparatus further receives such toner cartridge replacement information;

FIG. 14 illustrates a table indicating the remaining toner levels of the toner cartridges of the respective colors and the states of the stocks of replacement toner cartridges of the same when the toner cartridge of Black (K) is replaced with a new one, in another specific example;

FIG. 15 illustrates a table changed from that of FIG. 14, in which the remaining toner levels and the states of the stocks have been updated;

FIG. 17 illustrates a table to search for any replacement toner cartridge that can be delivered together with a replacement toner cartridge of the same color as the new toner cartridge most recently loaded (in one package);

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, a first mode of implementing the present invention will be described with reference to the accompanying drawings.

Figure 1:
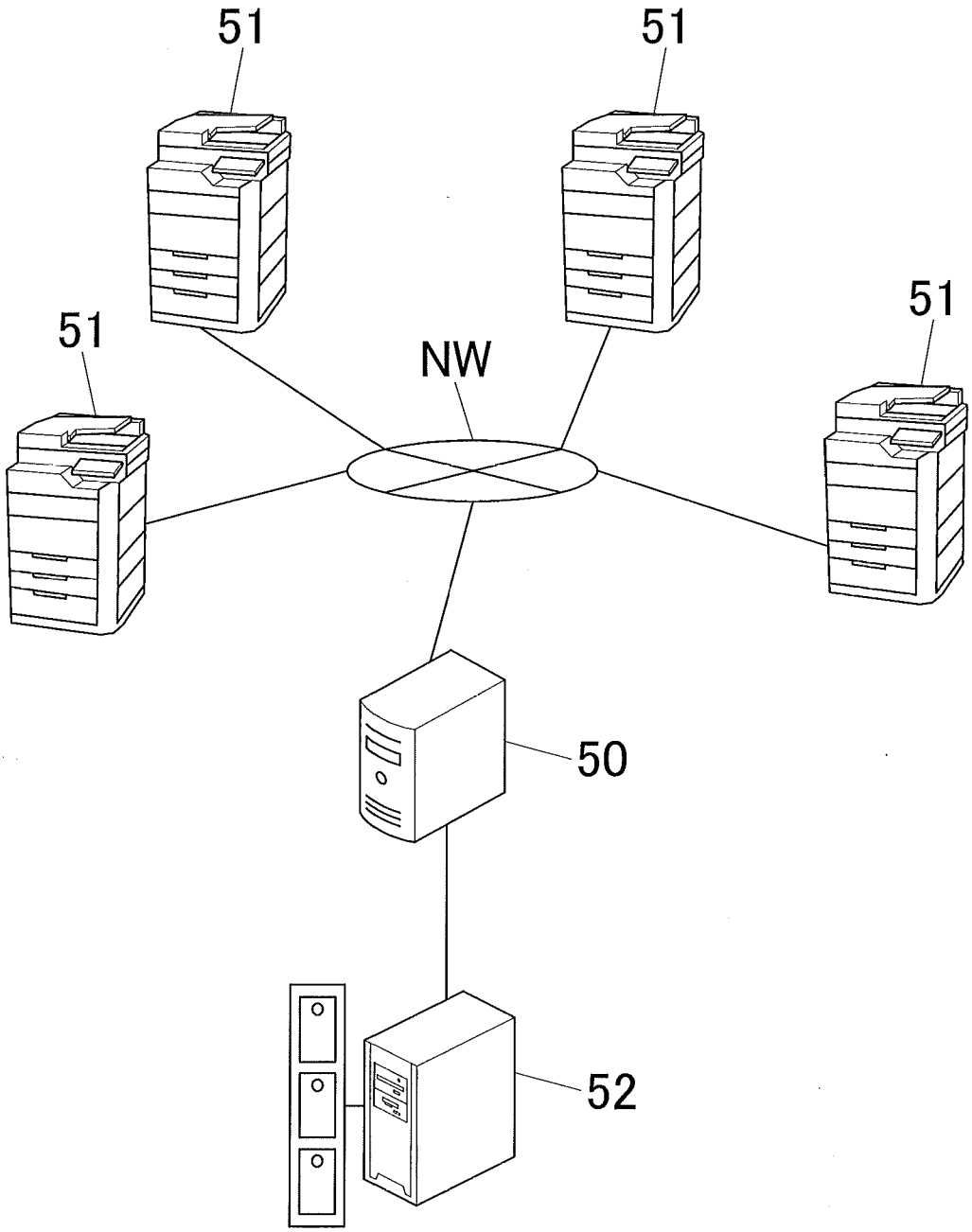
FIG. 1 is a view illustrating a configuration of a consumable unit management system according to one mode of implementing the present invention.

FIG. 1 is a view schematically illustrating a configuration of a consumable unit management system according to the first mode of implementing the present invention.

Toner cartridges will be described as a practical example of consumable units in this mode of embodied implementation.

As illustrated in FIG. 1, the management system basically includes one or more than one image forming apparatus 51 and a management server 50, which are connected with each other via a communication circuit such as the Internet network. The management server 50 is further connected to an order receiving server 52 via the Internet or the like.

The management server 50, which is usually provided in a service center or the like which offers various services on the image forming apparatuses 51, manages information of the image forming apparatuses 51 by users. More specifically, by communicating with the image forming apparatuses 51, the management server 50 monitors the remaining toner level(s) of a single toner cartridge or plural toner cartridges containing one color or different colors of toner that is a consumable resource, loaded on each of the image forming apparatuses 51, and whether or not there is a replacement toner cartridge(s) in stock. That will be further described in detail later. The image management server 50 further manages billing transactions and maintenance issues by collecting billing information such as number of prints and trouble information from the image forming apparatuses 51.

Users may use different types of image forming apparatuses; the image forming apparatuses 51 may be of different types. For example, the image forming apparatuses 51 may be printers, full-color copiers, monochrome copiers, and the like. Therefore, the image forming apparatuses 51 may load four toner cartridges containing four colors of toner: Yellow (Y), Magenta (M), Cyan (C), and Black (K), or only one toner cartridge containing one color of toner, Black (K).

Furthermore, by monitoring unique uses and use patterns of the users, the management server 50 remotely controls the image forming apparatuses 51 for perfect performance based on settings and the like of the image forming apparatuses 51 stored on its own recording medium. The setting information of the image forming apparatuses 51 is integrally managed by the management server 50; it therefore can be changed by the management server 50 quite easily even if any of the image forming apparatuses 51 are located in remote areas.

The image forming apparatuses 51 and the management server 50 exchange information with each other, for example by e-mails via the Internet network.

Being further connected to the order receiving server 52, the management server 50 transmits an order for a replacement toner cartridge to the order receiving server 52 according to toner cartridge replacement information received from the image forming apparatuses 51, so that the order receiving server 52 can arrange for an automatic delivery.

Figure 2:
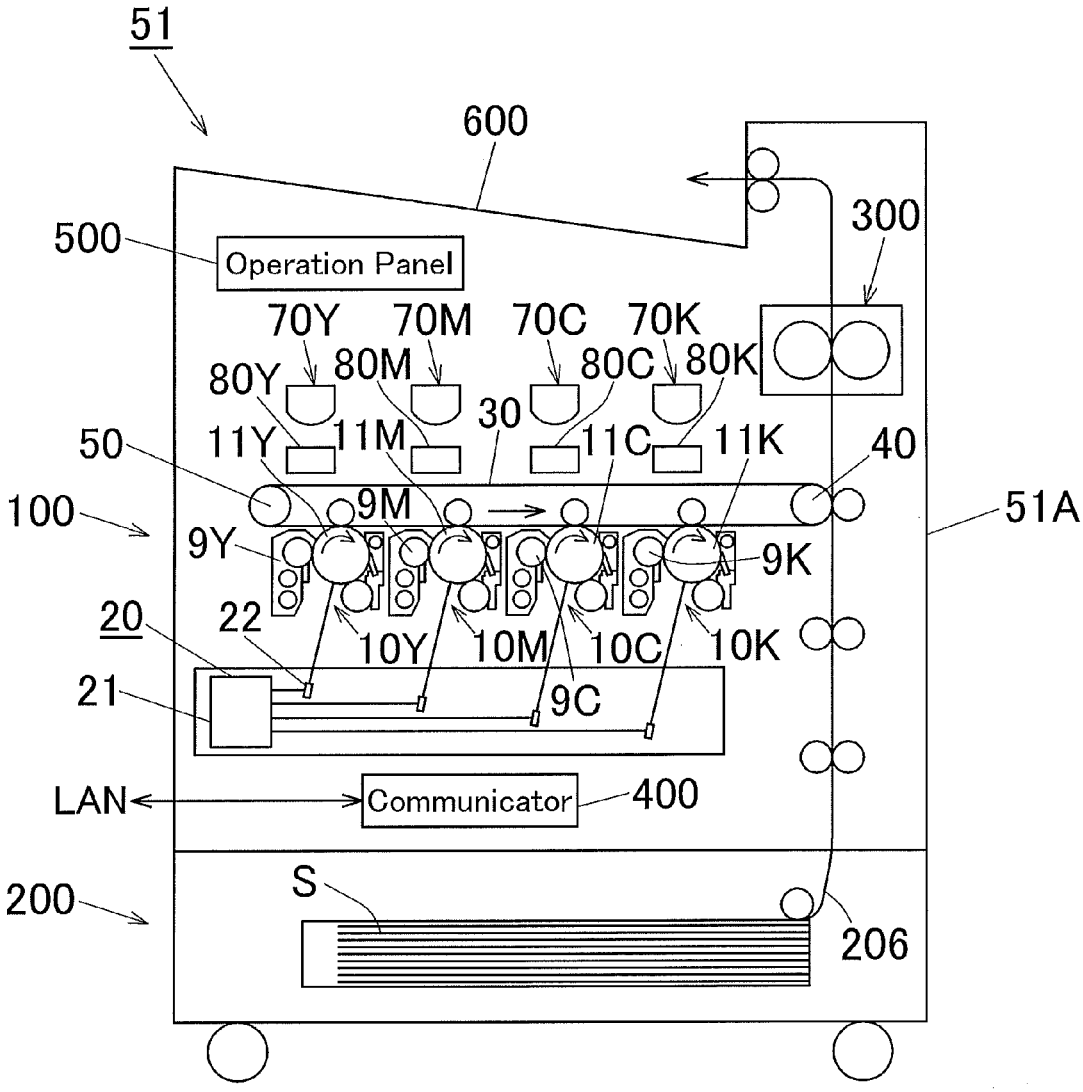
FIG. 2 is a view schematically illustrating a configuration of an image forming apparatus employed in the toner cartridge management system of FIG. 1.

FIG. 2 is a view schematically illustrating a configuration of the image forming apparatus 51. In this example, a tandem color printer is employed as the image forming apparatus 51.

As illustrated in FIG. 2, the image forming apparatus 51 has a paper feeder 200 in the lower area of the body 51A, a color image former 100 in the middle area of the body 51A, and a paper discharger 600 in the upper area of the body 51A, respectively. A paper conveyance path 206 conveying toward the upper area, paper (a sheet of paper) S provided by the paper feeder 200 is extended all the way from the paper feeder 200 to the paper discharger 600.

The color image former 100 includes: a driving roller 40 and a driven roller 50 provided in the middle area of the vertical direction of the body 51A; a midway transfer belt 30 horizontally going around a group of the driving roller 40 and the driven roller 50 to run toward the direction indicated by arrow; and image forming units 10Y, 10M, 10C, and 10K containing Yellow (Y), Magenta (M), Cyan (C), and Black (K) of toner, respectively, provided along the belt's running direction.

Toner images formed by the image forming units 10Y, 10M, 10C, and 10K are layered together and transferred onto the transfer belt 30. In the second transfer process, the merged toner images are further transferred on the paper S passing trough the corner of the transfer belt 30 (on the extreme right of the body) via the paper conveyance path 206; the sheet S is conveyed to a fuser 300 to have the merged toner images fixed thereon.

The image forming units 10Y, 10M, 10C, and 10K forming images by the electrostatic copy method is provided with: a charger; a print head 21 including four laser diodes, a polygon mirror, a scanner lens, and the like; an exposure unit 20 including four reflection mirrors 22 and the like; development devices 9Y, 9M, 9C, and 9K; photoreceptor drums 11Y, 11M, 11C, and 11K; a transfer portion; and the like, which are all located in the vicinity of the image forming units themselves.

Above the image forming units 10Y, 10M, 10C, and 10K, toner cartridges 70Y, 70M, 70C, and 70K and sub-hoppers 80Y, 80M, 80C, and 80K are provided as supplier machineries that feed toner in the development devices 9Y, 9M, 9C, and 9K of the image forming units 10Y, 10M, 10C, and 10K, respectively.

The toner cartridges 70Y, 70M, 70C, and 70K are removably loaded on the body 51A so as to be replaced with new ones when need. The toner cartridges 70Y, 70M, 70C, and 70K have a fuse attached thereto but not illustrated in this drawing; the body 51A detects an unused state of the toner cartridges when their fuses are conductive, and releases the unused state when the fuses are cut out. In other words, cutting the fuses, replacement of the toner cartridges is recognized.

In FIG. 1, a portion with the number 400 is a communicator communicating with external machines, and a portion with the number 500 is an operation panel provided with a set of keys and a display.

Figure 3:
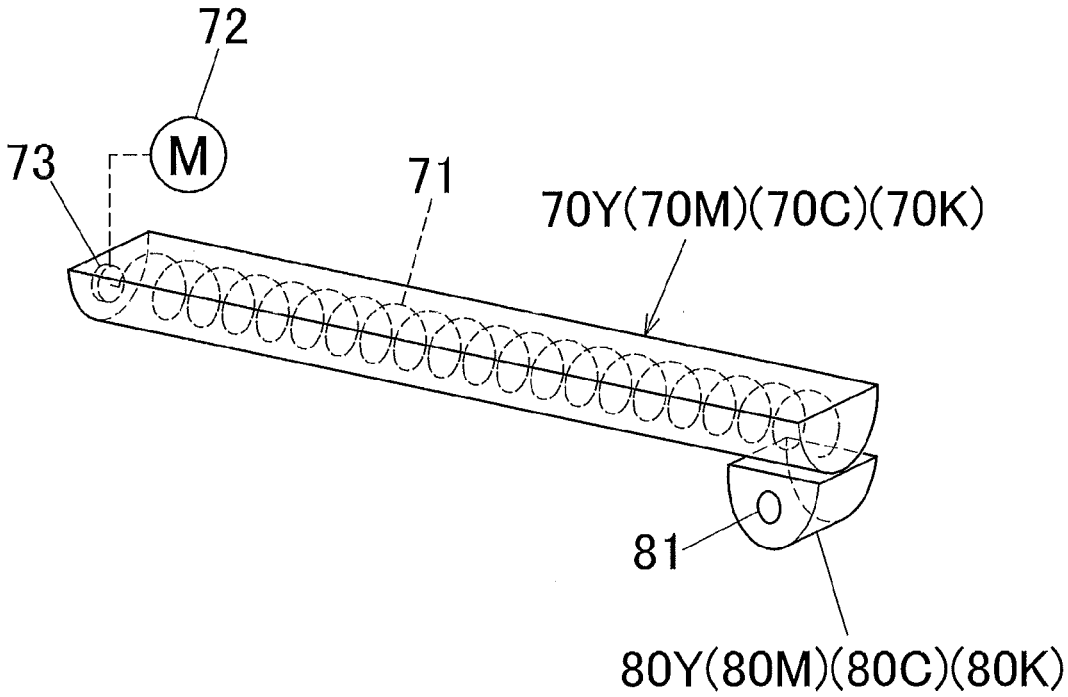
FIG. 3 is a view to explain a feature of the image forming apparatus to feed toner in a sub-hopper from a toner cartridge.

FIG. 3 is a view to explain a feature to feed toner in the sub-hoppers 80Y, 80M, 80C, and 80K from the toner cartridges 70Y, 70M, 70C, and 70K, respectively.

As illustrated in FIG. 3, when the toner cartridges 70Y, 70M, 70C, and 70K are loaded on the body 51A, the sub-hoppers 80Y, 80M, 80C, and 80K open shutters on their top to receive toner from the toner cartridges 70Y, 70M, 70C, and 70K.

The toner cartridge 70Y, 70M, 70C, and 70K have a spiral spring 71 inside, and feed toner in the sub-hoppers 80Y, 80M, 80C, and 80K, respectively, by having their spiral springs 71 rotated by stepper motors (also referred to as cartridge motors) 72.

There provided two stepper motors 72 for the four spiral springs 71; one of the two works for the toner cartridges 70Y and 70M, and the other one works for the toner cartridges 70C and 70K. An even number of gears 73 are arranged between an inlet valve of the toner cartridges 70Y and 70C and an inlet valve for the toner cartridges 70K and 70M; when the stepper motors 72 perform normal rotation, the spiral springs 71 of the toner cartridges 70Y and 70C are properly rotated while the spiral springs 71 of the toner cartridges 70K and 70M are rotated idle, and when the stepper motors 72 perform reverse rotation, the spiral springs 71 of the toner cartridges 70Y and 70C are rotated idle while the spiral springs 71 of the toner cartridges 70K and 70M are properly rotated. Switching the stepper motors 72 between normal rotation and reverse rotation determines whether or not to allow the toner cartridges 70Y, 70M, 70C, and 70K to feed toner.

Figure 4:
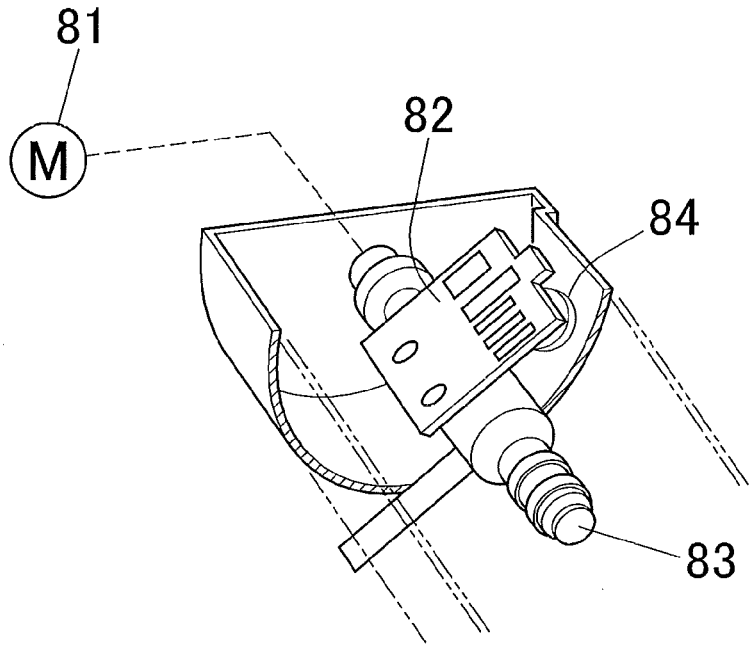
FIG. 4 is a view to explain a feature of the image forming apparatus to feed toner in a development device from the sub-hopper.

FIG. 4 is a view to explain a feature to feed toner in the development devices 9Y, 9M, 9C, and 9K from the sub-hoppers 80Y, 80M, 80C, and 80K.

As illustrated in FIG. 4, there provided one stepper motor (also referred to as sub-hopper motor) 81 for each of the sub-hoppers, the sub-hoppers 80Y, 80M, 80C, and 81K.

The sub-hoppers 80Y, 80M, 80C, and 80K feed toner in the development devices 9Y, 9M, 9C, and 9K, respectively, by having paddles 82 and spiral rollers 83 inside of themselves rotated by the sub-hopper motors 81. The remaining toner levels of the sub-hoppers 80Y, 80M, 80C, and 80K are detected by a toner empty sensor (piezoelectric sensor) 84.

Figure 5:
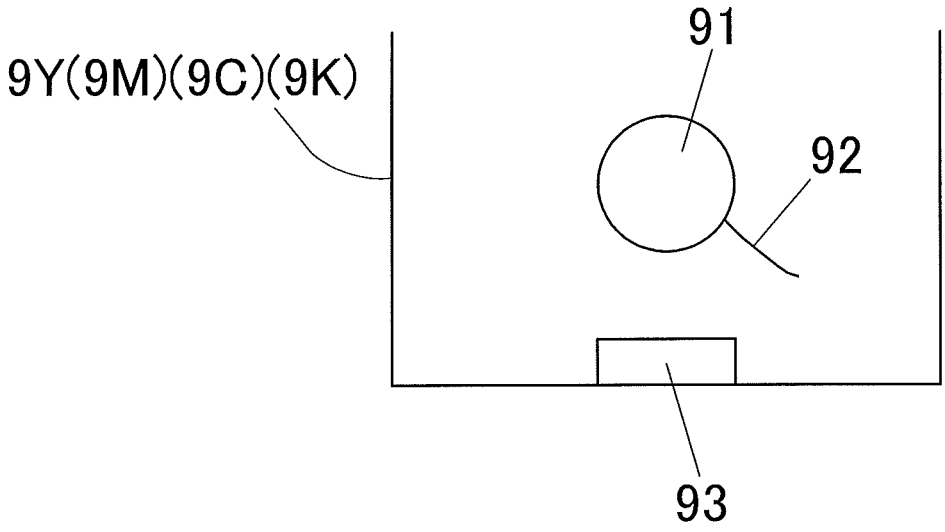
FIG. 5 is a view schematically illustrating a configuration of a feature to measure toner concentration.

FIG. 5 is a view schematically illustrating a configuration of a feature to measure toner concentration.

As illustrated in FIG. 5, the development devices 9Y, 9M, 9C, and 9K is filled with developing agent (toner and carrier); the developing agent in the development devices 9Y, 9M, 9C, and 9K is stirred by a Mylar plastic fin 92 attached to a motor-driven screw agitator 91. While the developing agent in the periphery of a toner concentration sensor 93 provided on the bottom of the development devices 9Y, 9M, 9C, and 9K is stirred by the Mylar plastic fin 92, new developing agent is let in the periphery of the toner concentration sensor 93. In other words, the developing agent in the periphery of the toner concentration sensor 93 is replaced with new one every other turn (ripple) of the screw agitator 91.

The toner concentration sensor 93 is a TCR sensor (magnetic sensor), for example. The toner concentration sensor 93 measures the toner concentration of the developing agent by reading out the magnetic permeability of iron included in the carrier of a unit volume of the developing agent in the periphery of the toner concentration sensor 93. That is, the higher a converted value (10-bit resolution) of an analog signal read out by the toner concentration sensor 93 is, the lower the toner concentration is.

Figure 6:
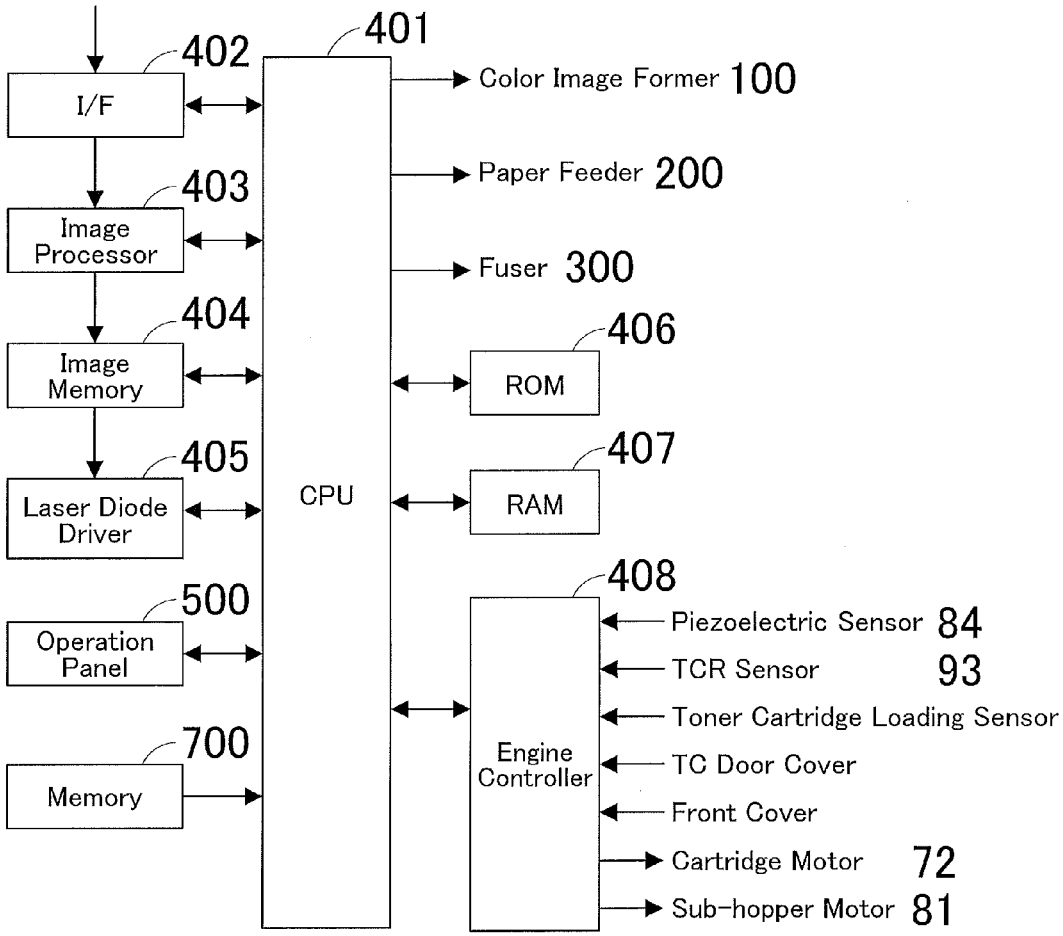
FIG. 6 is a block diagram illustrating a configuration of a controller of the image forming apparatus of FIG. 2.

FIG. 6 is a block diagram illustrating a configuration of a controller of the image forming apparatus 51.

As illustrated in FIG. 6, the controller includes a CPU 401, a communication interface (I/F) 402, an image processor 403, an image memory 404, a laser diode driver 405, an operation panel 500, a recording medium 700, a ROM 406, a RAM 407, and an engine controller 408, as primary members.

The CPU 401 integrally controls all operations of the image forming apparatus 51. Also, the CPU 401 reads out a necessary program from the ROM 406; converts image data by the image processor 403; and writes and reads image data in and out from the image memory 404. Furthermore, the CPU 401 contributes to smooth printing operation by nicely arranging the times of a series of sequential operations of the color image former 100, the paper feeder 200, and the like. Furthermore, the CPU 401 detects (determines) a toner near empty state and an empty state of the toner cartridge 70Y, 70M, 70C, and 70K based on various information inputted from the engine controller 408; arranges the time of detecting (determining) a toner near empty state based on an indicated amount of fed toner and print log data; and displays a predetermined message about the time for replacing the toner cartridges 70Y, 70M, 70C, and 70K, on the operation panel 500. Furthermore, the CPU 401 manages life information of various consumable units such as toner cartridges, a transfer belt unit, a fuser unit, and imaging units such as development units including photoreceptor drums; and transmits the life information to the management server 50 in response to an inquiry from the management server 50.

A new consumable unit has life information indicating a predetermined value, which becomes smaller with use of the consumable unit. In other words, the smaller the value indicated by the life information is, the closer the consumable unit is to the end of life; the larger the value indicated by the life information is, the more away the consumable unit is from the end of life. With use of the consumable unit, the value indicated by the life information becomes small and eventually reaches a predetermined one; if the life information indicates a predetermined value, it is determined that the consumable unit is nearly empty or reaches nearly the end of life.

The communication I/F 402 serves to connect the image forming apparatus 51 to a LAN such as a LAN card or a LAN board, and externally receives data to be printed out according to a print job and transfers it to the image processor 403.

Also, the communication I/F 402 transmits toner empty information, alert information, trouble information, and information of various printing events to the management server 50 managing the image forming apparatus 51 (see FIG. 13) via the Internet, and receives data and an instruction from the administration server 50.

Receiving data to be printed out according to a print job from the communication I/F 402, the image processor 403 converts the data into Y, M, C, and K image data objects for color reproduction and outputs the image data objects to the image memory 404 to have them stored thereon.

Reading out Y, M, C, and K image data objects from the image memory 404, the laser diode driver 405 drives the laser diodes of the exposure unit 20.

The operation panel 500 allows users to perform entry operations and displays various messages for them.

The recording medium 700 stores print log data and toner cartridge replacement log data, as well as various other data and applications.

The ROM 406 stores programs to control image forming operation and other data such as a table serving for toner supply control, toner empty detection control, and other controls.

The RAM 407 serves as a work area for the CPU 402.

Receiving signals and state information from the toner empty sensor 84, the TCR sensor 93, a toner cartridge loading sensor (not illustrated in the drawing), a TC door sensor (not illustrated), a front cover (not illustrated), the cartridge motors 72, the sub-hopper motors (not illustrated), and the like, the engine controller 408 controls printing operation.

Figure 7:
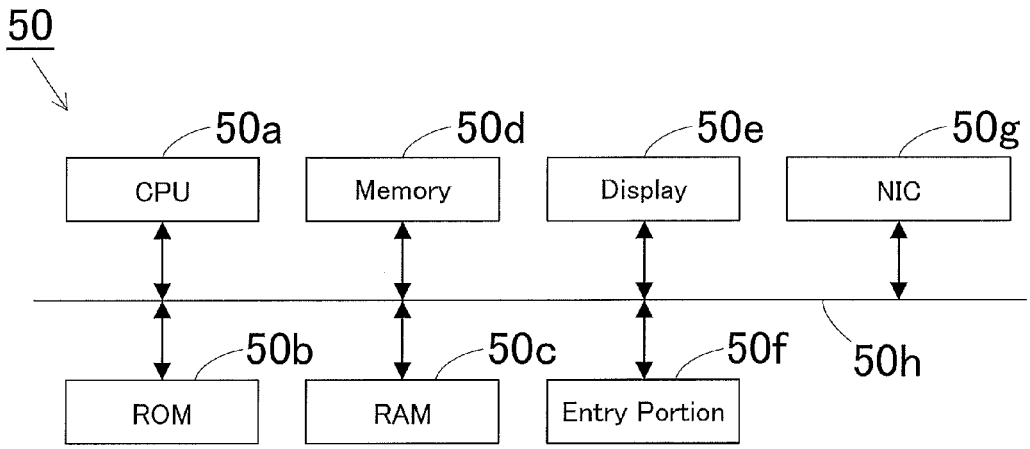
FIG. 7 is a block diagram illustrating a configuration of a toner cartridge management apparatus.

FIG. 7 is a block diagram illustrating a configuration of the management server 50 employed in the consumable unit management system of FIG. 1.

The management server 50 is provided with a CPU 50*a*, a ROM 50*b*, a RAM 50*c*, a display 50*e*, an entry portion 50*f*, a network interface card (NIC) 50*g*, and the like, which are connected to each other via a system bus 50*h*.

The CPU 50*a* integrally controls the entire management server 50 by executing programs stored on the ROM 50*b*. Specifically, in this mode of embodied implementation, the CPU 50*a* receives and manages information of remaining toner that is a consumable resource remaining in the toner cartridges 70Y, 70M, 70C, and 70K loaded on the image forming apparatuses 51; and information indicating that the toner cartridges 70Y, 70M, 70C, and 70K have been replaced. The CPU 50*a* further manages stock information indicating the states of the stocks of replacement toner cartridges. Also, the CPU 50*a* updates the information when the need arises. Furthermore, receiving toner cartridge replacement information (remaining toner information) indicating that the toner cartridge 70Y, 70M, 70C, or 70K loaded on an image forming apparatus 51 has been replaced with a new one or will need to be replaced with a new one because it is nearly empty, the CPU 50*a* determines a right type of replacement toner cartridge which can be delivered together with a replacement toner cartridge for the toner cartridge 70Y, 70M 70C, or 70K to the same delivery address; and outputs a delivery instruction accordingly.

The ROM 50*b* is a recording medium that stores programs and data for the CPU 50*a* to execute processing.

The ROM 50*c* is a recording medium that provides a work area for the CPU 50*a* to execute processing according to an operation program.

The recording medium 50*d* is, for example, a hard disk drive, and stores various data, applications, and the like. Specifically, in this mode of embodied implementation, the recording medium 50*d* stores remaining toner information of the toner cartridges 70Y, 70M, 70C, and 70K loaded on the image forming apparatus 51, which is rewritable thereon. Furthermore, the recording medium 50*d* stores information such as the locations of the image forming apparatuses 51 which correspond to the delivery addresses to which replacement toner cartridges will be delivered.

The display 50*e* is, for example, a CRT display or a liquid-crystal display, and displays various messages, entry accepting screens, selection screens, and other screens for administrator-level users and other users.

The entry portion 50*f* serves for administrator-level users and other users to perform entry operation, and includes a keyboard, a mouse, and the like.

The network interface card 50*g* serves as a communicator that exchanges data with the image forming apparatuses 51 and the order receiving server 52 via the Internet network.

Figure 8:
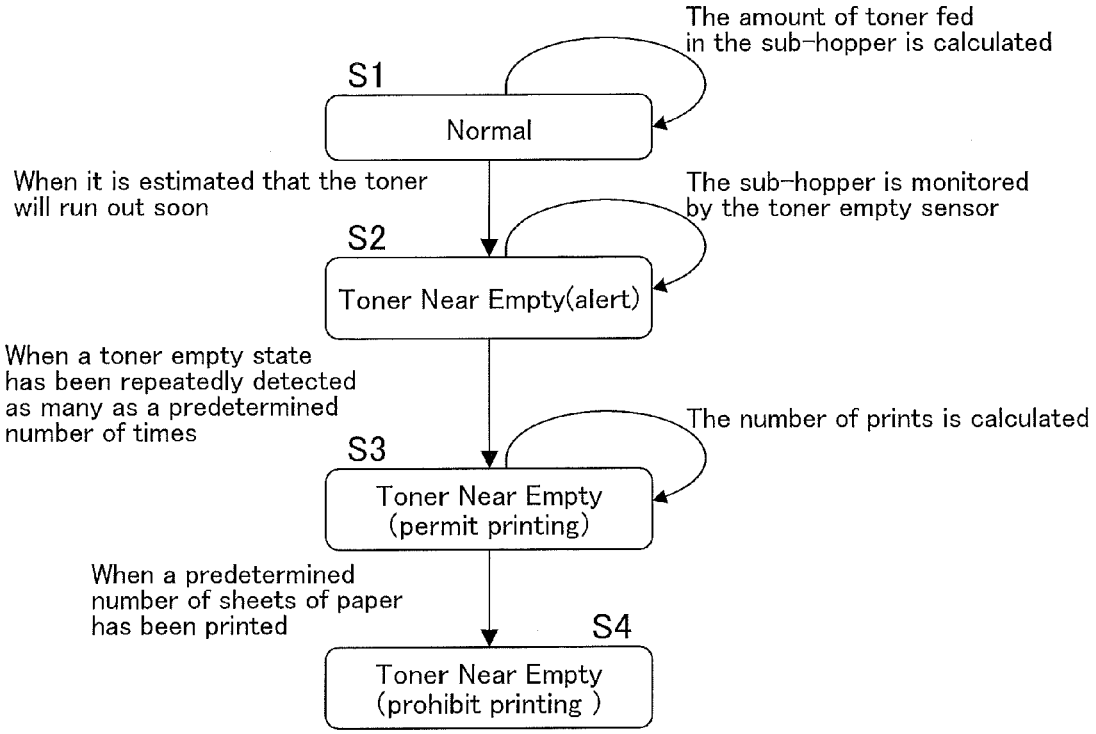
FIG. 8 is a flowchart representing a processing routine to detect a toner empty state.

FIG. 8 is a flowchart representing a processing routine to detect a toner empty state, executed by the image forming apparatuses 51.

In FIG. 8, the remaining toner levels of the toner cartridges 70Y, 70M, 70C, and 70K slowly go down with feeding of toner; the toner cartridges 70Y, 70M, 70C, and 70K eventually run out of toner (become in toner empty state).

There are the four states depending on remaining toner level: "normal" (Step S1), "toner near empty (alert)" (Step S2), "toner empty (permit printing)" (Step S3), and "toner empty (prohibit printing)" (Step S4).

Unlike "toner near empty (alert)" (Step S2), "toner empty (permit printing)" (Step S3), and "toner empty (prohibit printing)" (Step S3), "normal" (Step S1) means that the toner cartridges 70Y, 70M, 70C, and 70K and the sub-hoppers 80Y, 80M, 80C, and 80K are sufficiently filled with toner. In these four states including the state of "normal" (Step S1), the CPU 401 accumulates the rotation quantum numbers of the cartridge motors 72, and estimates the amount of toner fed in the sub-hoppers 80Y, 80M, 80C, and 80K based on the rotation quantum numbers.

Figure 9:
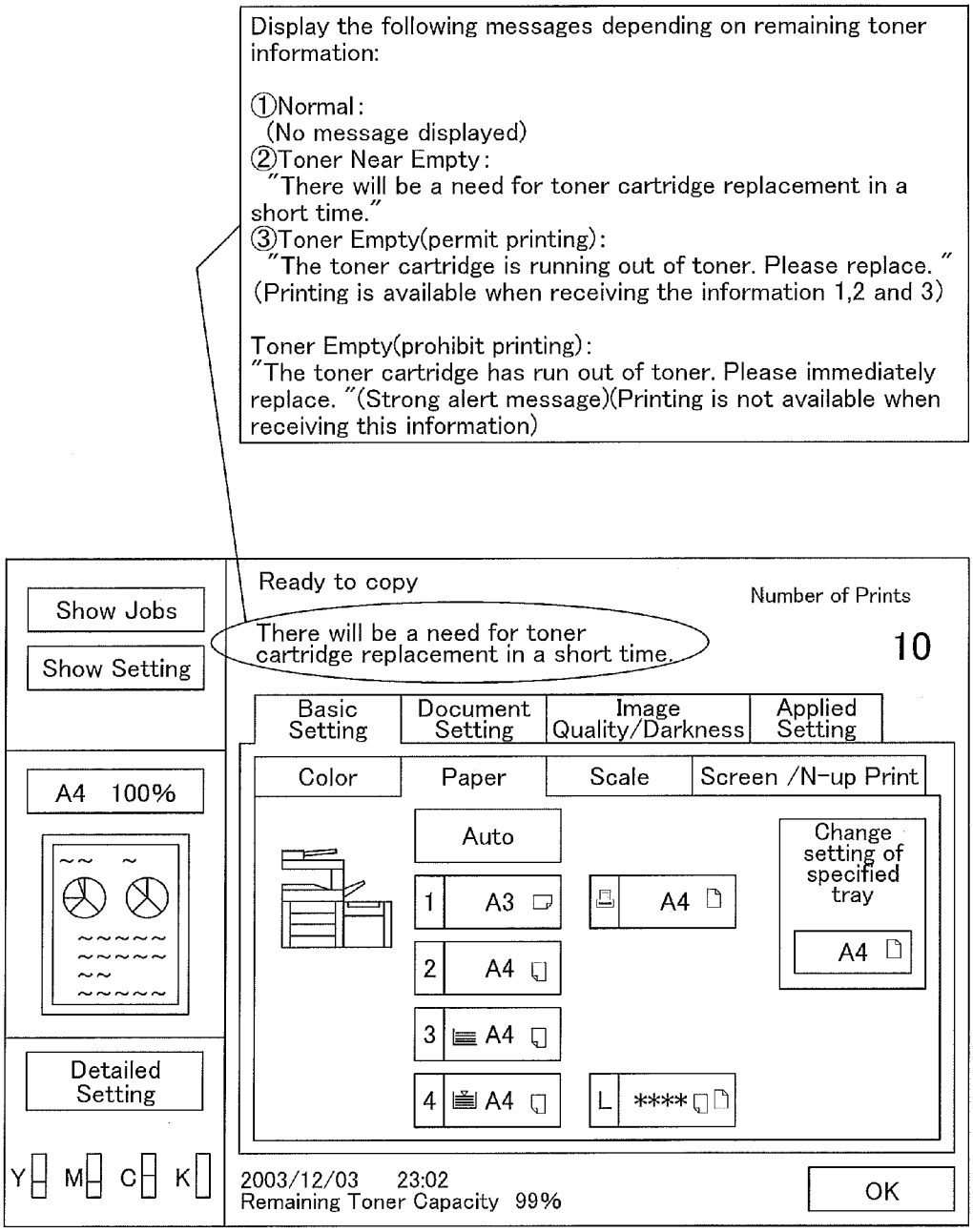
FIG. 9 is a view to explain an example of an alert message displayed on an operation panel of the image forming apparatus.

The CPU 401 determines the state as "toner near empty (alert)" (Step S2) if estimating that the toner cartridges 70Y, 70M, 70C, and 70K nearly run out of toner based on the estimated amount of toner fed in the sub-hoppers 80Y, 80M, 80C, and 80K. In the state of "toner near empty (alert)", as illustrated in FIG. 9, an alert message stating that toner will run out in a short time is displayed on the operation panel 500 so that users will be encouraged to prepare a replacement toner cartridge. After that, thousands of prints still can be made using the toner cartridges 70Y, 70M, 70C and 70K before "toner empty (prohibit printing)" is detected, users therefore have enough time to prepare a replacement toner cartridge even when need to place an order because of no replacement toner cartridges in stock.

The CPU 401 determines the state as "toner empty (permit printing)" (Step S3) when the toner empty sensor 84 has repeatedly detected a toner empty state of the sub-hoppers 80Y, 80M, 80C, and 80K as many as a predetermined number of times. In this state, the toner cartridges 70Y, 70M, 70C, and 70K have no toner left inside while the sub-hoppers 80Y, 80M, 80C, and 80K still contain toner for as many as 100 prints approximately, and printing is therefore permitted.

The CPU 401 determines the state as "toner empty (prohibit printing)" (Step S4) when the sub-hoppers 80Y, 80M, 80C, and 80K run out of toner by further consuming it for a predetermined number of prints after "toner empty (permit printing)" is detected. In this state, printing is prohibited.

In the state of "toner near empty (alert)" (Step S2) and "toner empty (permit printing)" (Step S3), as illustrated in FIG. 9, an alert message is displayed on the operation panel 500 to let the user know that the toner will run out soon. In the state of "toner empty (prohibit printing)" (Step S4), a strong alert message is displayed on the operation panel 500 to let the user know that the toner has run out, and printing is prohibited.

These states depending on remaining toner level: normal, toner near empty, toner empty (permit printing), and toner empty (prohibit printing) (described in Steps S1 to S4, respectively) are incorporated in a table illustrated in FIG. 10.

As is obviously understood from the table of FIG. 10, when the state turns to "toner empty (permit printing)" (Step S3), it is acceptable to replace the toner cartridges 70Y, 70M, 70C, and 70K since these contain little remaining toner (almost run out of toner); when the state turns to "toner near empty" (Step S2), it is not preferred to replace the toner cartridges 70Y, 70M, 70C, and 70K since these still contain some remaining toner.

Figures 11, 12:
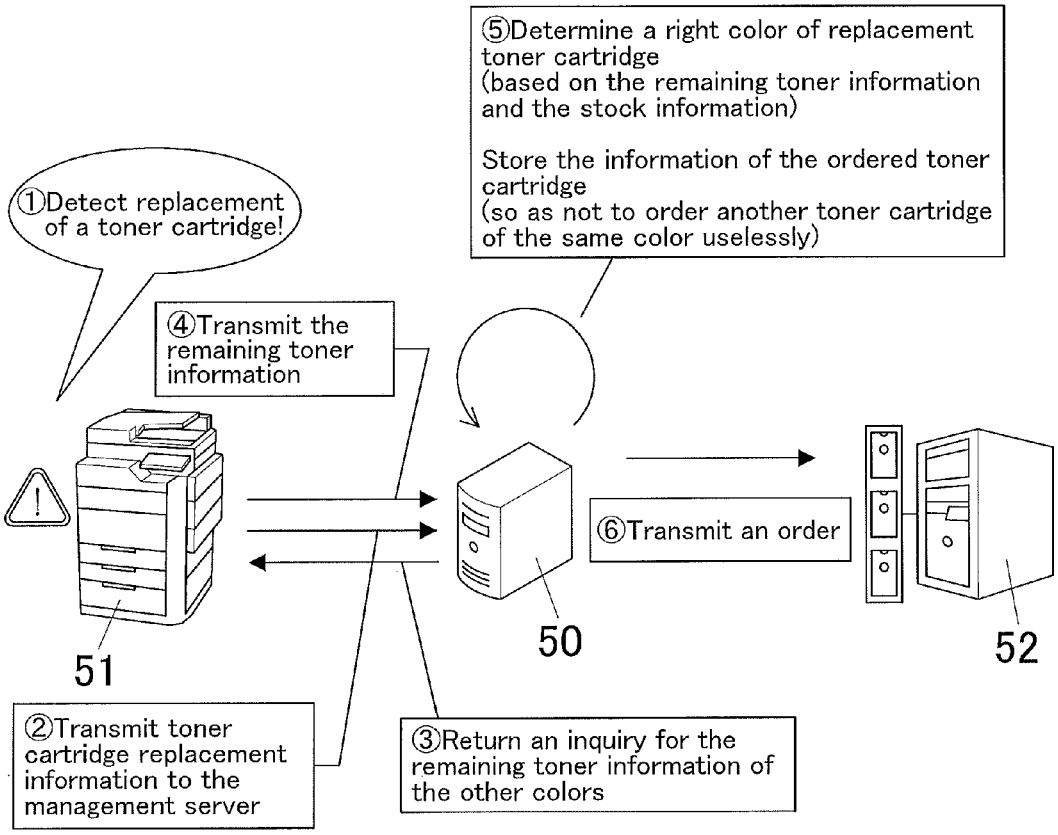
FIG. 11 is a view to explain the overview of a procedure executed by the toner cartridge management system to determine a right type of replacement toner cartridge and output a delivery instruction.
FIG. 12 illustrates a table indicating the remaining toner levels of the toner cartridges of the respective colors and the states of the stocks of replacement toner cartridges of the same when the toner cartridge of Black (K) is replaced with a new one, in a specific example.

FIG. 11 is a view to explain the overview of a procedure to determine a right type of replacement toner cartridge and output a delivery instruction in the toner cartridge management system according to this mode of embodied implementation.

In this example, a right type of replacement toner cartridge to be delivered is determined based on toner cartridge replacement information received from an image forming apparatus 51 when the toner cartridge 70Y, 70M, 70C, or 70K loaded thereon is replaced with a new one, remaining toner information of the toner cartridge, and stock information indicating the stock status of the stocks of replacement toner cartridges.

Initially, a toner cartridge loaded on an image forming apparatus 51 is replaced with a new one (circled number 1 in FIG. 11). Then the image forming apparatus 51 transmits toner cartridge replacement information indicating the occurrence of toner cartridge replacement to the management server 50 connected therewith via a communication circuit (circled number 2).

As is previously mentioned, replacement of the toner cartridges 70Y, 70M, 70C, and 70K is recognized when their attached fuses are cut out. When having its fuse conductive, the image forming apparatus 51 detects the cartridge detection signal as "new toner cartridge"; when having the fuse cut out, it detects the cartridge detection signal as "old toner cartridge".

Back to the procedure, receiving the toner cartridge replacement information from the image forming apparatus 51, the management server 50 returns thereto an inquiry for remaining toner information of the toner cartridges of the other colors (circled number 3), then receives the remaining toner information from the image forming apparatus 51 (circled number 4).

The management server 50 determines and stores a right type of replacement toner cartridge based on the remaining toner information of the toner cartridges of the other colors and the status of the stocks of replacement toner cartridges (circled number 5), then transmits an order to the order receiving server 52 (circled number 6).

Hereinafter, specific examples of the procedures to determine a right type of replacement toner cartridge will be further described.

In this mode of embodied implementation, the management server 50 manages the states of the stocks of replacement toner cartridges kept at the places of the image forming apparatuses 51, and the state of the stocks is roughly staged by stock information as the following. "Replacement toner cartridges" also will be referred to as "replacement toner".

Δ (up-pointing triangle): no replacement toner cartridge in stock.

○ (circle): replacement toner cartridge in stock; delivery has not been arranged.

◎ (double circle): replacement toner cartridge in stock; another delivery has been arranged.

The remaining toner level of the toner cartridges 70Y, 70M, 70C, and 70K loaded on the image forming apparatuses 51 is staged and defined as the following four states: "normal", "near empty", "empty (permit printing)", and "empty (prohibit printing".

Specific Example-A

In this specific example, when the toner cartridge 70Y, 70M, 70C, or 70K is replaced with a new one, a replacement toner cartridge of the same color as the new toner cartridge most recently loaded and another replacement toner cartridge of one of the other colors will be delivered together in one package.

For example, the table of FIG. 12 indicates the states of the remaining toner levels of the toner cartridges 70Y, 70M, 70C, and 70K and the states of the stocks of replacement toner cartridges of the respective colors, when the toner cartridge 70K of Black (K) is replaced with a new one.

More specifically, when the toner cartridge 70K of Black (K) is replaced with a new one, the remaining toner information of the toner cartridge 70K of Black (K) is "full" and the stock information of the same is "Δ: no replacement toner cartridge in stock". In other words, receiving the toner cartridge replacement information, the management server 50 recognizes that no replacement toner cartridge of Black (K) is in stock, then updates the stock information of the toner cartridge 70K of Black (K) with the mark "Δ". As for the toner cartridge 70C of Cyan (C), the remaining toner information is "normal" and the stock information is "○: replacement toner cartridge in stock; delivery has not been arranged"; as for the toner cartridge 70M of Magenta (M), the remaining toner information is "near empty" and the stock information is "○: replacement toner cartridge in stock; delivery has not been arranged"; and as for the toner cartridge 70Y of Yellow (Y), the remaining toner information is "empty (permit printing)" and the stock information is "○: replacement toner cartridge in stock; delivery has not been arranged.

In this case, the toner cartridge 70Y of Yellow (Y) will be replaced with a new one in a short time because the remaining toner information is "empty (permit printing)". Therefore, the management server 50 determines that an instruction to deliver replacement toner cartridges of Black (K) and Yellow (Y) in one package should be outputted, then transmits an order to the order receiving server 52. At the same time, the management server 50 updates the stock information of the toner cartridge of Yellow (Y) by changing "○" to "◎: replacement toner cartridge in stock; delivery has been arranged" and the stock information of the toner cartridge of Black (K) by changing "Δ" to "○".

And then, the toner cartridge 70Y of Yellow (Y) is replaced with a new one. Receiving the toner cartridge replacement information, the management server 50 updates the remaining toner information of the toner cartridge 70Y of Yellow (Y) with "full" and the stock information of the same by changing "◎" to "○", as in the table of FIG. 13. The remaining toner level of the toner cartridge 70K of Black (K) which is a new toner cartridge most recently loaded is now turned to "normal". In this case, a replacement toner cartridge of Yellow (Y) is already kept in stock, and the management server 50 therefore does not transmit an order for a replacement toner cartridge of Yellow (Y). Furthermore, none of the toner cartridges 70M, 70C, and 70K of Magenta (M), Cyan (C), and Black (K)s is currently in the state of "empty (permit printing)", and the management server 50 therefore does not transmit an order for a replacement toner cartridge of any of these three colors.

If any of the toner cartridges 70M, 70C, and 70K is in the state of "empty (permit printing)", the management server 50 will transmit an order for a replacement toner cartridge of that color.

Specific Example-B

In this specific example, when the toner cartridge 70Y, 70M, 70C, or 70K is replaced with a new one, one of the other toner cartridges is in between the state of "empty (permit printing)" and "near empty".

For example, the table of FIG. 14 indicates the states of the remaining toner levels of the toner cartridges 70Y, 70M, 70C, and 70K and the states of the stocks of replacement toner cartridges of the respective colors, when the toner cartridge 70K of Black (K) is replaced with a new one.

More specifically, when the toner cartridge 70K of Black (K) is replaced with a new one, the remaining toner information of the toner cartridge 70K of Black (K) is "full" and the stock information of the same is "Δ". As for the toner cartridge 70C of Cyan (C), the remaining toner information is "normal" and the stock information is "○"; as for the toner cartridge 70M of Magenta (M), the remaining toner information is "near empty" and the stock information is "○"; and as for the toner cartridge 70Y of Yellow (Y), the remaining toner information is "empty" and the stock information is "○".

Although the toner cartridge 70K of Black (K) has been replaced with a new one, the management server 50 keeps an order for a replacement toner cartridge of this color on hold because the toner cartridge 70Y of Yellow (Y) is currently in the state of "near empty". Meanwhile, no replacement toner cartridge of Black (K) is in stock and the stock information remains "Δ".

And then, when the toner cartridge 70Y of Yellow (Y) becomes in the state of "empty (permit printing)", the management server 50 determines that an instruction to deliver replacement toner cartridges of Yellow (Y) and Black (K) in one package should be outputted, then transmits an order to the order receiving server 53. At the same time, the management server 50 updates the stock information of the toner cartridge of Yellow (Y) by changing "○" to "◎" and the stock information of the toner cartridge of Black (K) by changing "Δ" to "○".

However, there is a possibility that the toner of Black (K) is used but the toner of Yellow (Y), Magenta (M), and Cyan (C) is never used while the management server 50 keeps an order for a replacement toner cartridge of Black (K) on hold. In such a case, the management server 50 transmits an order for a replacement toner cartridge of Black (K) when the toner cartridge of Black (K) becomes nearly empty.

That will contribute to eliminating the inconvenience that no replacement toner cartridge of Black (K) is in stock and even the delivery is not arranged because of the pending order, when the toner cartridge 70K of Black (K) needs to be replaced with a new one because of the rapid toner consumption which is unexpected.

And as is previously mentioned, the management server 50 manages the remaining toner levels of the toner cartridges 70Y, 70M, 70C, and 70K and the states of the stocks of replacement toner cartridges of the respective colors, and also manages to deliver preferably more than one replacement toner cartridge in one package based on the remaining toner levels and the states of the stocks. That will contribute to saving the costs of delivery more than the conventional system in which replacement consumable units are delivered one by one. Furthermore, no replacement toner cartridge will be delivered when there is already one in stock. Making a delivery only when necessary will contribute to saving the costs of delivery without causing the costs of stock keeping.

Figure 16:
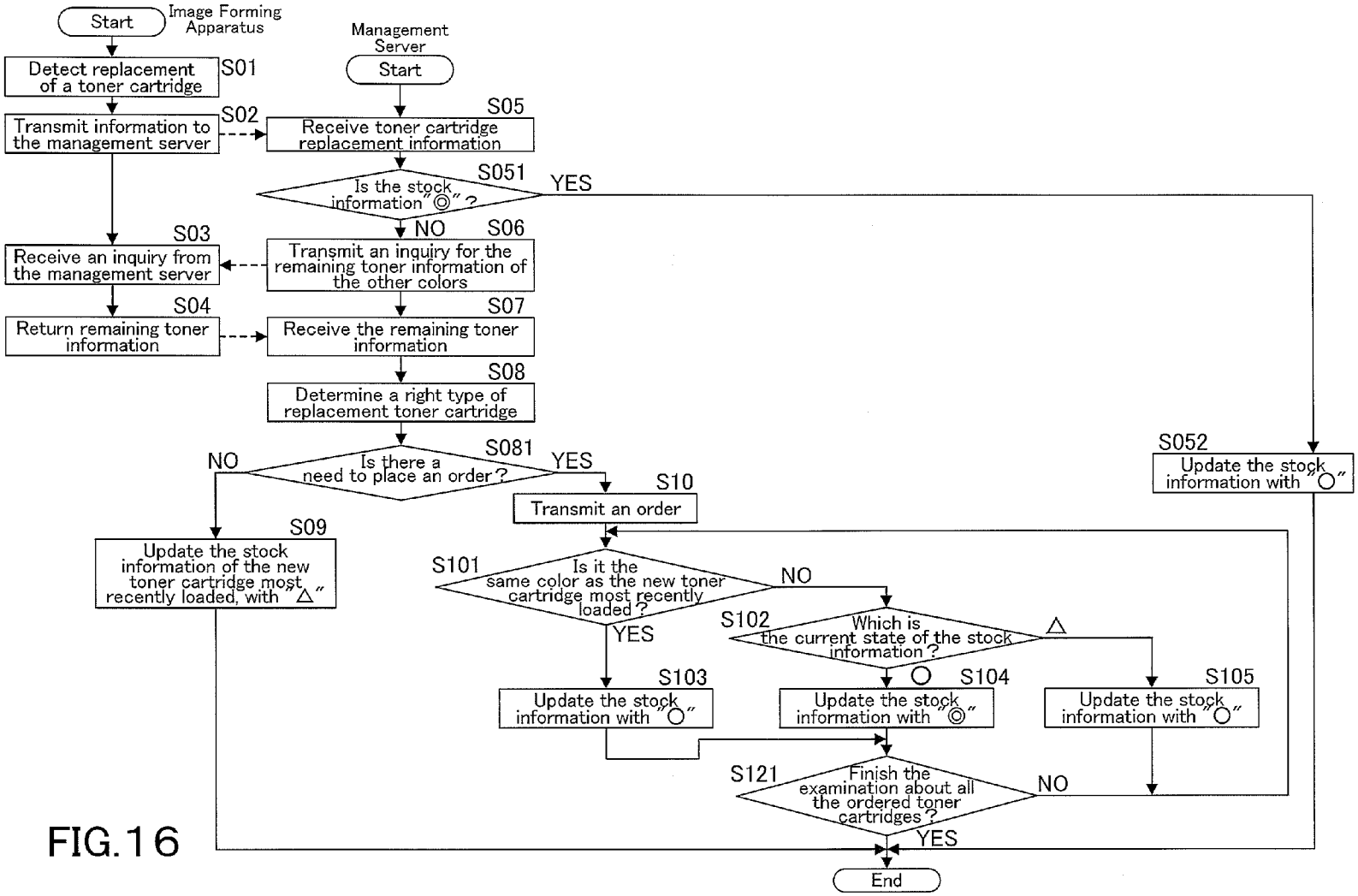
FIG. 16 illustrates a flowchart representing a processing routine executed by the management apparatus to determine a right replacement toner cartridge and output a delivery instruction, which starts when a toner cartridge loaded on the image forming apparatus is replaced with a new one.

FIG. 16 illustrates a flowchart representing a processing routine executed by the management server 50 to determine a right type of replacement toner cartridge and output an order for a replacement toner cartridge of that type, which starts when a toner cartridge loaded on an image forming apparatus 51 is replaced with a new one. The processing routine is executed by the CPU 50*a* of the management server 50 according to an operation program stored on a recording medium such as the ROM 50*b*.

In Step S01, an image forming apparatuses 51 detects replacement of a toner cartridge loaded thereon, and then in Step S02, the image forming apparatus 51 transmits toner cartridge replacement information to the management server 50.

Receiving the toner cartridge replacement information in Step S05, the management server 50 examines whether or not the stock information of the new toner cartridge most recently loaded is "◎: replacement toner cartridge in stock; delivery has been arranged", in Step S051.

If the stock information is "◎" (YES in Step S051), it means that there is in stock a replacement toner cartridge for the new toner cartridge most recently loaded, at the place of the image forming apparatus 51; the management server 50 therefore updates the stock information with "○" without outputting a delivery instruction, in Step S052. Then the routine terminates.

If the stock information is not "◎" (NO in Step S051), the management server 50 transmits to the image forming apparatus 51, an inquiry for the remaining toner levels of the toner cartridges of the other colors in Step S06. Receiving this inquiry in Step S03, the image forming apparatus 51 returns the remaining toner information to the management server 50 in Step S04.

Receiving the remaining toner information in Step S07, the management server 50 determines a right type of replacement toner cartridge based on the remaining toner information and the stock information in Step S08.

And the management server 50 further determines that there is a need to order a replacement toner cartridge of that type in Step S081. If there is no need to order a replacement toner cartridge of that type (NO in Step S081), the stock information of the new toner cartridge most recently loaded is updated with "Δ: no replacement toner cartridge in stock, in Step S09.

In Step S081, if there is a need to order a replacement toner cartridge of the determined type (YES in Step S081), the management server 50 outputs such an order to the order receiving server 52 in Step S10, then judges whether or not the ordered replacement toner cartridge and the new toner cartridge most recently loaded are of the same color in Step S101. If more than one replacement toner cartridge is ordered, the management server 50 will need to examine each of them.

If the ordered replacement toner cartridge and the new toner cartridge most recently loaded are of the same color, i.e. if the new toner cartridge most recently loaded eventually will be replaced with the ordered one (YES in Step S101), the management server 50 updates the stock information of the new toner cartridge most recently loaded with "○: replacement toner cartridge in stock; delivery has not been arranged", in Step S103.

On the other hand, if the ordered replacement toner cartridge will not be replaced with the new toner cartridge most recently loaded (NO in Step S101), the management server 50 examines the current stock information of the new toner cartridge most recently loaded, in Step S102. If the current stock information is "○: replacement toner cartridge in stock; delivery has not been arranged", the management server 50 updates the stock information with "◎: replacement toner cartridge in stock; delivery has been arranged", in Step S104. Then the routine proceeds to Step S121. If the current stock information is "Δ: no replacement toner cartridge in stock", the management server 50 updates the stock information with "○: replacement toner cartridge in stock; delivery has not been arranged", in Step S105. Then the routine proceeds to Step S121.

In Step S121, the management server 50 judges whether or not to finish the examination about all the ordered replacement toner cartridges in Step S101. If the examination is finished about all of them (NO in Step S121), the routine goes back to Step S101 to repeat the same processes described above.

If the examination is finished about all the ordered replacement toner cartridges in Step S101 (YES in Step S121), the routine terminates.

The toner cartridge determination process of Step S08 will be further described below.

FIG. 17 illustrates a table to examine whether or not any other replacement toner cartridge can be delivered together with a replacement toner cartridge of the same color as the new toner cartridge most recently loaded (in one package).

As illustrated in the table of FIG. 17, there are the remaining toner levels of the toner cartridges loaded on the image forming apparatus 51 in the title column, and the states of the stocks of replacement toner cartridges in the title row. When the stock information of a toner cartridge is "Δ", the management server 50 determines that a replacement toner cartridge for the toner cartridge can be delivered together with the other replacement toner cartridge, not depending on the remaining toner level. When the remaining toner information is "empty (permit printing)" or "empty (prohibit printing)" and the stock information of the empty toner cartridge is "○: replacement toner cartridge in stock; delivery has not been arranged", the management server 50 determines that a replacement toner cartridge of the same color as the empty toner cartridge can be delivered together with the other replacement toner cartridge. When the remaining toner information is "normal" or "near empty" and the stock information of the of the empty toner cartridge is "○", the management server 50 determines that a replacement of the same color as the normal or near empty toner cartridge cannot be delivered together with the other replacement toner cartridge. When the stock information of a toner cartridge is "◎: replacement toner cartridge in stock; delivery has been arranged", the management server 50 determines that a replacement toner cartridge of the same color as the toner cartridge cannot be delivered together with the other replacement toner cartridge, not depending on the remaining toner level.

After the determination process, the management server 50 further performs the following process depending on the result obtained by the determination process. (1) When there is at least one replacement toner cartridge (a second toner cartridge) that can be delivered together with a replacement toner cartridge for the new toner cartridge most recently loaded (a first toner cartridge), the management server 50 determines that an instruction to deliver the first and second toner cartridges together in one package should be outputted. Exceptionally, if the first toner cartridge is already in stock at the place of the image forming apparatus 51, only the second toner cartridge will be delivered. (2) When there is no replacement toner cartridge (a second toner cartridge) that can be delivered together with a replacement toner cartridge for the new toner cartridge most recently loaded (a first toner cartridge); the stock information is "○: replacement toner cartridge in stock; delivery has not been arranged"; and there is a near empty toner cartridge (a third toner cartridge), the management server 50 determines that no delivery instruction needs to be outputted and keeps on hold an order for the first toner cartridge (an instruction to deliver the first toner cartridge).

And eventually when the third toner cartridge becomes in the state of "empty (permit printing)", the first toner cartridge and a replacement toner cartridge of the same color as the third toner cartridge will be delivered together in one package.

Exceptionally, the toner cartridge to be replaced with the first toner cartridge may become in the state of "near empty" before the third toner cartridge becomes in the state of "empty (permit printing)". In such a case, only a replacement toner cartridge of the same color as the first toner cartridge will be delivered. (3) In all the cases excluding the cases (1) and (2) mentioned right above, the management server 50 determines that an instruction to deliver only the first toner cartridge should be outputted. Exceptionally, if the first toner cartridge is already in stock at the place of the image forming apparatus 51, the management server 50 determines that no delivery instruction needs to be outputted.

While the present invention has been described herein with reference to one particular mode of embodied implementation, it should be understood that the invention is not limited thereto.

For example, in the mode of embodied implementation, the management server 50 examines whether or not the image forming apparatus 51 most recently having loaded a new toner cartridge because of replacement has any other toner cartridge that has to be replaced with a new one, so that a replacement toner cartridge for the toner cartridge can be delivered together with that for the new toner cartridge most recently loaded. Alternatively, the management server 50 may examine whether or not the image forming apparatus 51 most recently having loaded a new toner cartridge because of replacement and other image forming apparatus 51, which are all provided at the same office have any other toner cartridge that has to be replaced with a new one, so that a replacement toner cartridge for the toner cartridge can be delivered together with that for the new toner cartridge most recently loaded. The management server 50 may examine whether or not more than one monochrome printer provided at the same place has any other toner cartridge of Black (K) that has to be replaced with a new one, so that more than one replacement toner cartridge of Black (K) can be delivered together.

In the mode of embodied implementation, the management server 50 receives toner cartridge replacement information; manages the remaining toner levels of the toner cartridges and the states of the stocks of replacement toner cartridges; determines a right type(s) of replacement toner cartridge; and outputs a delivery instruction (an order). Instead of the management server 50, one image forming apparatuses 51 collectively having all these functions may receive toner cartridge replacement information; manage the remaining toner levels of the toner cartridges and the states of the stocks of replacement toner cartridges; determine a right type(s) of replacement toner cartridge; and output a delivery instruction (an order). In such a case, these operations are performed according to an operation program by the control of the CPU 401 of the image forming apparatus 51.

Hereinafter, a second mode of implementing the present invention will be described. In the second mode of embodied implementation, a right delivery address for a consumable unit such as a toner cartridge to be loaded on an image forming apparatus is determined based on the stage of the life of another consumable unit. The differences with the first mode of embodied implementation will be mainly described below.

Figure 18:
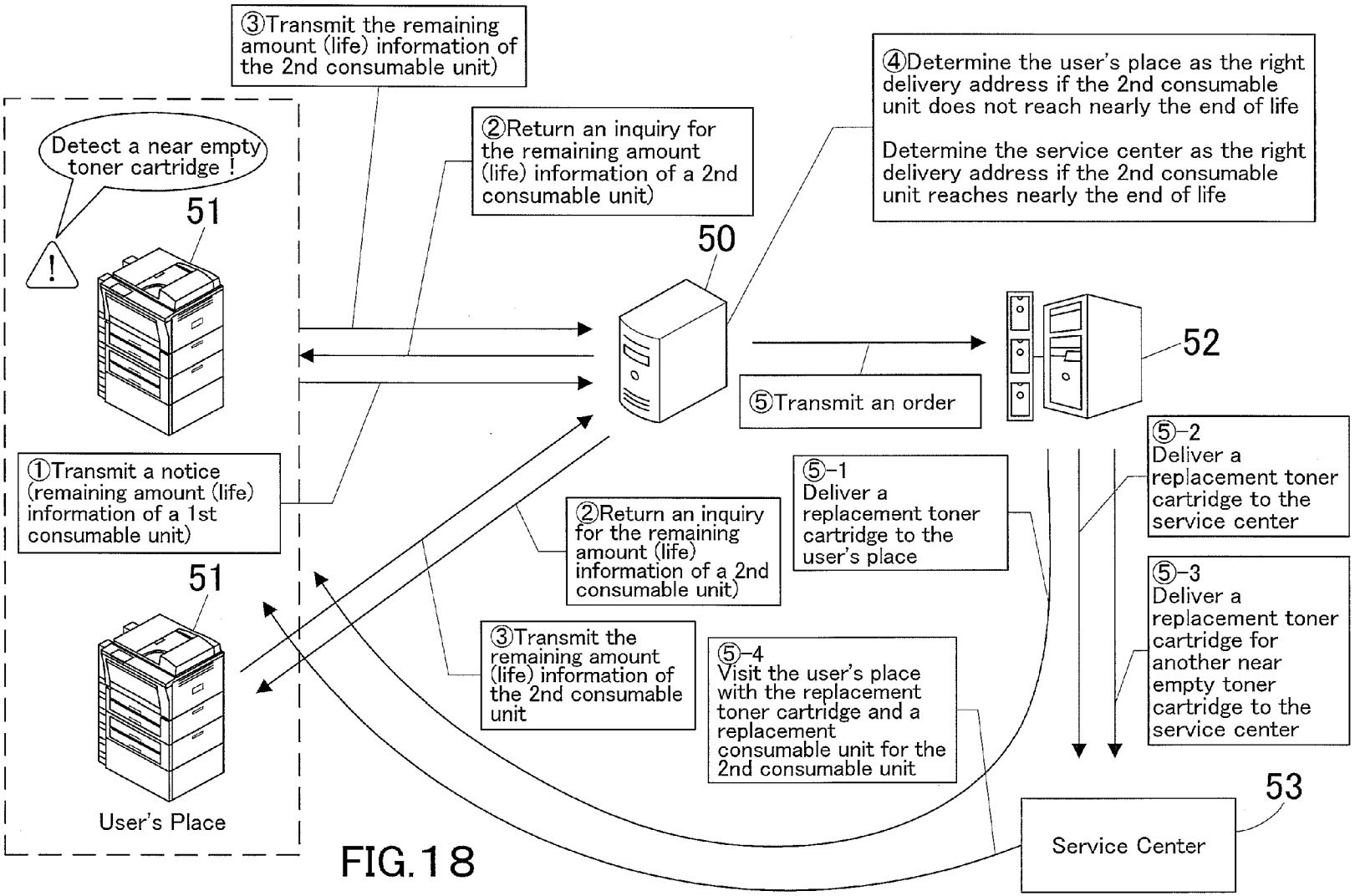
FIG. 18 is a view to explain the overview of a procedure executed by a consumable unit management system according to another mode of implementing the present invention to determine a right delivery address for a replacement consumable unit, output a delivery instruction, and arrange for the delivery accordingly.

FIG. 18 is a view to explain the overview of a procedure executed by a consumable unit management system according to the second mode of embodied implementation to determine a right delivery address for a replacement consumable unit, output a delivery instruction, and arrange for the delivery accordingly. While a first consumable unit to be replaced with a new one by a user is a replacement toner cartridge in the following example, it should be understood that the first consumable unit is not limited thereto.

In this mode of embodied implementation, the procedure starts when a toner cartridge loaded on an image forming apparatus 51 becomes nearly empty.

When a toner cartridge loaded on an image forming apparatus 51 becomes nearly empty, the image forming apparatus 51 transmits a notice of the occurrence of toner near empty (remaining amount (life) information of a first consumable unit) to the management server 50 (circled number 1 in FIG. 18).

Receiving this notice, the management server 50 transmits an inquiry for the remaining amount (life) information of a second consumable unit which is supposed to be replaced with a new one by a service engineer, to the image forming apparatus 51 and more than one other image forming apparatus 51 which are all used by the same user at the same place (circled number 2). The second consumable unit is a transfer belt unit, a photoreceptor unit, a developing unit, a fuser unit, or the like.

The image forming apparatuses 51 individually return to the management server 50, the remaining amount (life) information of the second consumable unit loaded thereon (circled number 3). If the second consumable unit reaches nearly the end of life (or the remaining amount (life) information exceeds a predetermined value), the management server 50 determines a service center 53 as the right delivery address for a replacement toner cartridge (to be referred to simply as "toner" in the following description and figures) for the near empty toner cartridge (circled number 4), then outputs a delivery instruction (an order) to the order receiving server 52 (circled number 5) so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge and a replacement consumable unit for the second consumable unit (for example, a transfer belt unit) (circled number 5-4), and replaces the near empty toner cartridge and the second replacement unit with the new ones.

On the other hand, if the second consumable unit does not reach nearly the end of life, the management server 50 determines the place where the image forming apparatus 51 is located (the user's place) as the right delivery address for a replacement toner cartridge for the near empty toner cartridge (circled number 4), and outputs a delivery instruction to the order receiving server 52 (circled number 5) so that toner will be delivered to the user's place. Meanwhile the order receiving server 52 arranges for shipping out the replacement toner cartridge to the user's place (circled number 5-1). In this case, the near empty toner cartridge will be replaced with the received replacement toner cartridge by the user.

Here, the same place in which the image forming apparatuses are provided may be a building, a site, or a group of separate sites which a service engineer can take a round of at one visit. More specifically, in a group of separate sites, a service engineer needs to finish his work about all the image forming apparatuses within one day.

Furthermore, in this mode of embodied implementation, the remaining amount (life) information of the first consumable unit indicates toner near empty. The first consumable unit can be used for making thousands of copies even after its toner near empty until printing is prohibited because of its toner empty, for a period of two weeks approximately. Different parameters are set depending on the type of image forming apparatus. It should be understood that the remaining amount (life) information of the first consumable unit does not indicate toner near empty in a limited manner.

In this mode of embodied implementation, the second consumable unit is a transfer belt unit, a fuser unit, a photoreceptor unit, a developer unit or the like which users usually have a difficulty of replacing; the remaining amount (life) information of the second consumable unit indicates near end of life. The second consumable unit is not limited to those mentioned above, and is different depending on the type of image forming apparatus. The second consumable unit is supposed to be replaced with a new one by a service engineer, which is a characteristic of the second consumable unit. Near end of life of the second consumable unit corresponds to near empty of a toner cartridge, and the remaining amount (life) information indicating near end of life serves as an alert noticing that printing will be prohibited after a predetermined number of copies are made. In general, when consumable units which contain something in the form of powder or liquid such as toner cartridges containing toner run out of it, it is said that the consumable units are empty; when consumable units which are deteriorated because of friction or another factor run out, it is said that the consumable units reach the end of life.

In this mode of embodied implementation, the management server 50 transmits an inquiry for the remaining amount (life) information of the second consumable unit to the image forming apparatus 51, and the image forming apparatus 51 returns the information to the management server 50. Alternatively, the consumable unit management system may be configured such that the image forming apparatuses 51 transmit the remaining amount (life) information of the second consumable unit loaded thereon to the management server 50 individually and automatically when the state of the second consumable unit is changed, and the management server 50 stores the information.

Furthermore, in this mode of embodied implementation, if any other toner cartridge loaded on the image forming apparatus 51 and the other image forming apparatuses 51 which are all provided in the same place is nearly empty after the service center 53 is determined as the right delivery address, the management server 50 outputs a delivery instruction to the order receiving server 52 (circled number 5, 5-3), so that a replacement toner cartridge for the other near empty toner cartridge also will be delivered to the service center 53.

As is mentioned above, in this mode of embodied implementation, if a first consumable unit which corresponds to a replacement toner cartridge most recently loaded is nearly empty while a second consumable unit reaches nearly the end of life, the management server 50 determines that another replacement toner cartridge for the new toner cartridge most recently loaded should be delivered to the service center 53. Therefore, a service engineer can visit the user's place with replacement consumable units for both the first and the second consumable units and replace them with the new ones. That will contribute to eliminating the inconvenience that a replacement consumable unit for a first consumable unit is delivered to the user's place uselessly after the first consumable unit has been replaced with a new one by a service engineer.

Figure 19:
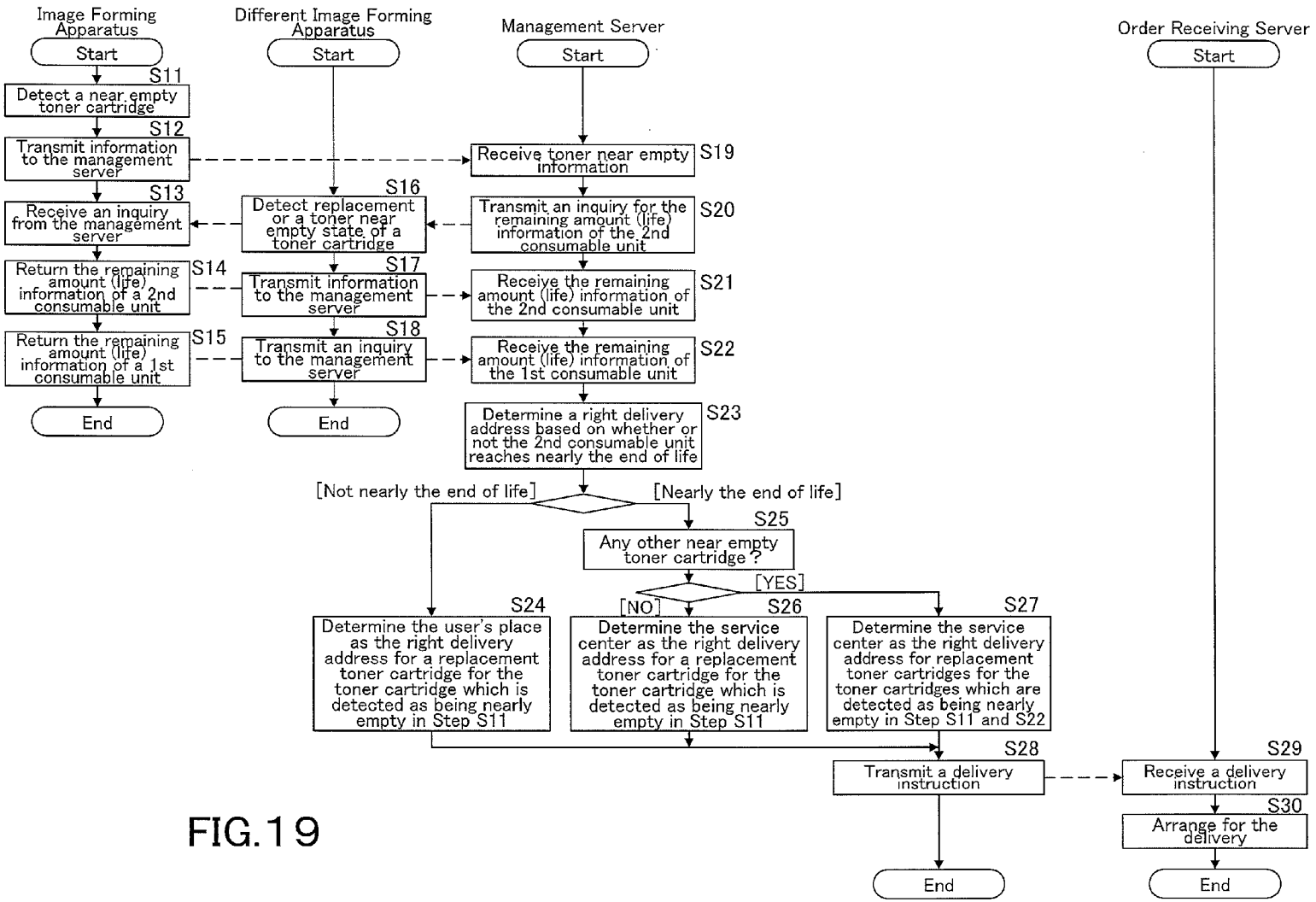
FIG. 19 illustrates a flowchart representing a processing routine executed by the management server and an order receiving server to determine a right delivery address for a replacement toner cartridge, output a delivery instruction, and arrange for the delivery accordingly, which starts when the image forming apparatus detects the toner near empty state of a toner cartridge loaded thereon.

FIG. 19 illustrates a flowchart representing a processing routine executed by the management server 50 and the order receiving server 52 to determine a right delivery address for a replacement toner cartridge, output a delivery instruction, and arrange for the delivery accordingly, which starts when an image forming apparatus 51 detects the toner near empty state of a toner cartridge loaded thereon. The processing routine is executed by the CPU 50*a* of the management server 50 according to an operation program stored on a recording medium such as the ROM 50*b*.

In Step S11, an image forming apparatuses 51 detects the toner near empty state of a toner cartridge loaded thereon. This means that the replacement toner cartridge will be out of stock in a short time, and the image forming apparatus 51 transmits toner near empty information to the management server 50 in Step S12.

Receiving the toner near empty information in Step S19, the management server 50 returns an inquiry for the remaining amount (life) information of a second consumable unit to the image forming apparatus 51 causing the toner near empty information and other image forming apparatuses 51 which are all provided at the same place, in Step S20.

Receiving this inquiry from the management server 50 in Steps S13 and S16, the image forming apparatuses 51 individually return thereto the remaining amount (life) information of the second consumable unit loaded thereon in Steps 514 and S17, and further returns thereto the remaining amount (life) information of a first consumable unit which is a toner cartridge in Steps S15 and S18.

Receiving the remaining amount (life) information of the second consumable unit in Step S21 and the remaining amount (life) information of the first consumable unit in Step S22, the management server 50 determines a right delivery address(s) for replacement toner cartridges for the first and the second consumable units based on whether or not the second consumable unit reaches nearly the end of life.

In other words, if the second consumable unit does not reach nearly the end of life, the routine proceeds to Step S24, in which the user's place is determined as the right delivery address for a replacement toner cartridge for the toner cartridge which is detected as being nearly empty in Step S11. Then the routine proceeds to Step S28.

If the second consumable unit reaches nearly the end of life, the routine proceeds to Step S25, in which it is examined whether or not any other toner cartridge is nearly empty, based on the information received in Step S22.

If no other toner cartridge is nearly empty (NO in Step S25), the routine proceeds to Step S26, in which the service center 53 is determined as the right delivery address for a replacement toner cartridge for the toner cartridge which is detected as being nearly empty in Step S11. Then the routine proceeds to Step S28. If another toner cartridge is nearly empty (YES in Step S25), the routine proceeds to Step S27, in which the service center 53 is determined as the right delivery address for replacement toner cartridges for the toner cartridges which are detected as being nearly empty in Step S11 and Step S22. Then the routine proceeds to Step S28.

In Step S28, a delivery instruction is outputted to the order receiving server 52, so that the replacement toner cartridges will be delivered to the determined delivery address.

Receiving this delivery instruction in Step S29, the order receiving server 52 accordingly arranges for the delivery in Step S30.

Figure 20:
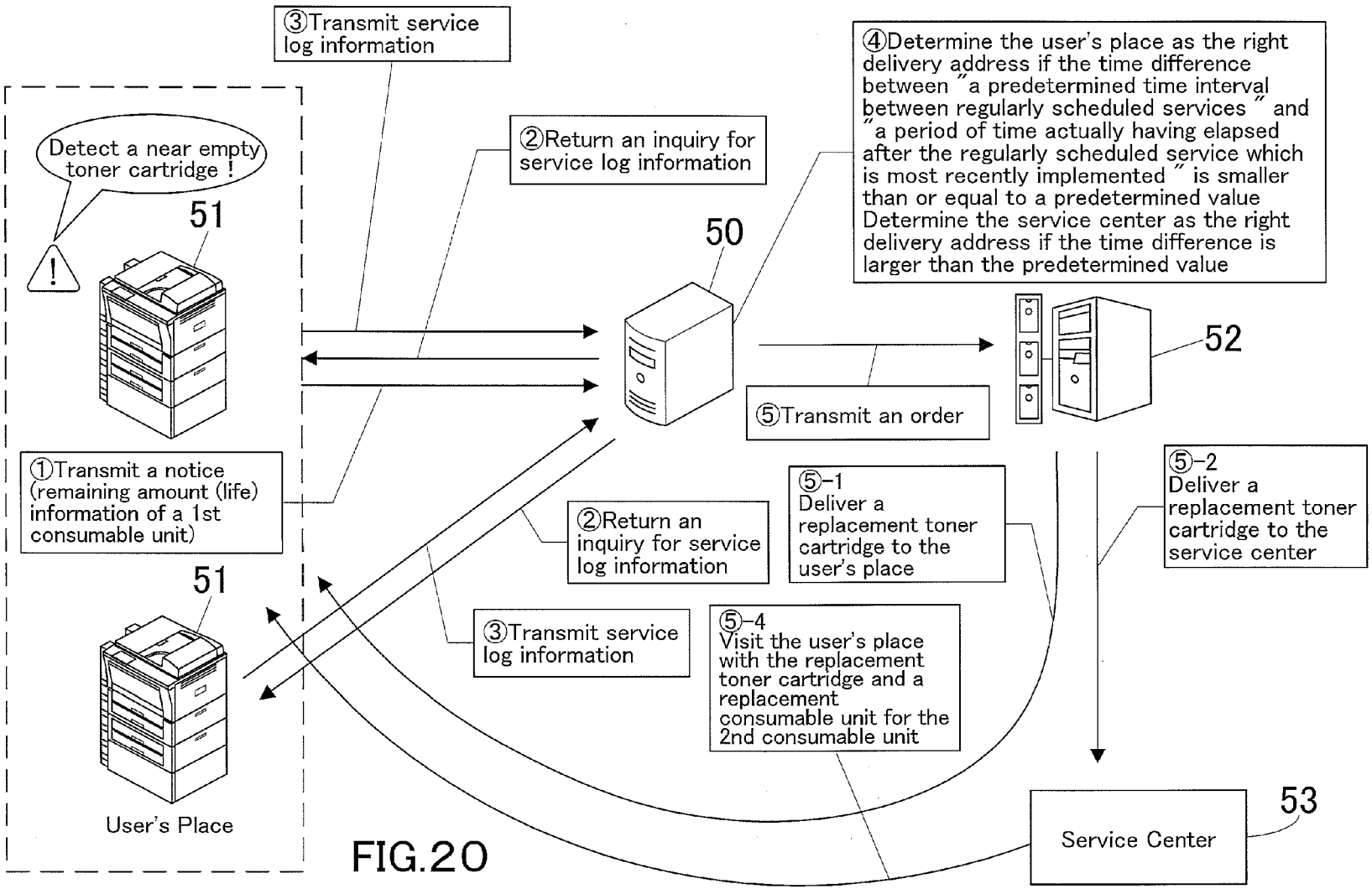
FIG. 20 is a view to explain the overview of a procedure executed by the consumable unit management system to determine a right delivery address for a replacement consumable unit, output a delivery instruction, and arrange for the delivery accordingly, in another mode of implementing the present invention.

FIG. 20 is a view to explain the overview of a procedure executed by the consumable unit management system to determine a right delivery address for a replacement consumable unit, output a delivery instruction, and arrange for the delivery accordingly, in another mode of implementing the present invention.

In this mode of embodied implementation, the procedure starts when an image forming apparatus 51 detects the toner near empty state of a toner cartridge loaded thereon.

Detecting the toner near empty state of a toner cartridge loaded thereon, the image forming apparatus 51 transmits a notice of the occurrence of toner near empty (remaining amount (life) information of a first consumable unit) to the management server 50 which is connected with the image forming apparatus 51 via a communication circuit (circled number 1 in FIG. 20).

Receiving this notice, the management server 50 transmits an inquiry for service log information to the image forming apparatus 51 and more than one other image forming apparatus 51 which are all used by the same user at the same place (circled number 2).

The image forming apparatuses 51 individually return their service log information to the management server 50 (circled number 3). Receiving and examining the service log information of the image forming apparatuses 51, the management server 50 judges whether or not the time difference between "a predetermined time interval between regularly scheduled services" and "a period of time actually having elapsed after the regularly scheduled service which is most recently implemented" is smaller than or equal to a predetermined value, according to the service log information of the image forming apparatuses 51. If the time difference is smaller than or equal to the predetermined value, this means that a service engineer will come to the user's place for a regularly scheduled service in a short time. And the management server 50 determines the service center 53 as the right delivery address for a replacement toner cartridge for the near empty toner cartridge (circled number 4), and outputs a delivery instruction to the order receiving server 52 (circled number 5) so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge (circled number 5-4), and implements a regularly scheduled service and replaces the near empty toner cartridge with the new one.

If the time difference between "a predetermined time interval between regularly scheduled services" and "a period of time actually having elapsed after the regularly scheduled service which is most recently implemented" is larger than the predetermined value, this means that a service engineer will not come to the user's place for a regularly scheduled service any time soon. And the management server 50 determines the user's place as the right delivery address for a replacement toner cartridge for the near empty toner cartridge (circled number 4), and outputs a delivery instruction to the order receiving server 52 (circled number 5) so that the replacement toner cartridge will be delivered to the user's place. The order receiving server 52 arranges for shipping out the replacement toner cartridge to the user's place (circled number 5-1). In this case, the near empty toner cartridge will be replaced with the received replacement toner cartridge by the user.

Service engineers generally visit their users to implement a regular scheduled service including checking, cleaning, and adjusting the settings on the image forming apparatuses, at regular time intervals. Here, the users would be happier if the service engineers can further replace a near empty toner cartridge with a new one according to the need during their visit for such a regular scheduled service. More specifically, if the time difference between a time interval between scheduled services and a period of time having elapsed after the last service, in other words, the number of days left before the next visit is smaller or equal to the predetermined value, this means that a service engineer will visit the user's place before printing is prohibited because of toner empty. Therefore, the service center 53 is determined as the right delivery address for a replacement toner cartridge for the near empty toner cartridge, so that the service engineer can bring it at the next visit. That will contribute to eliminating the inconvenience that a replacement toner cartridge for a near empty toner cartridge is delivered to the user's place uselessly after the near empty toner cartridge has been replaced with a new one by a service engineer.

The predetermined threshold value is set to about a period of time (for example 14 days) which is estimated to elapse from the detection of "toner near empty" until the detection of "toner empty (prohibit printing)".

Figure 21:
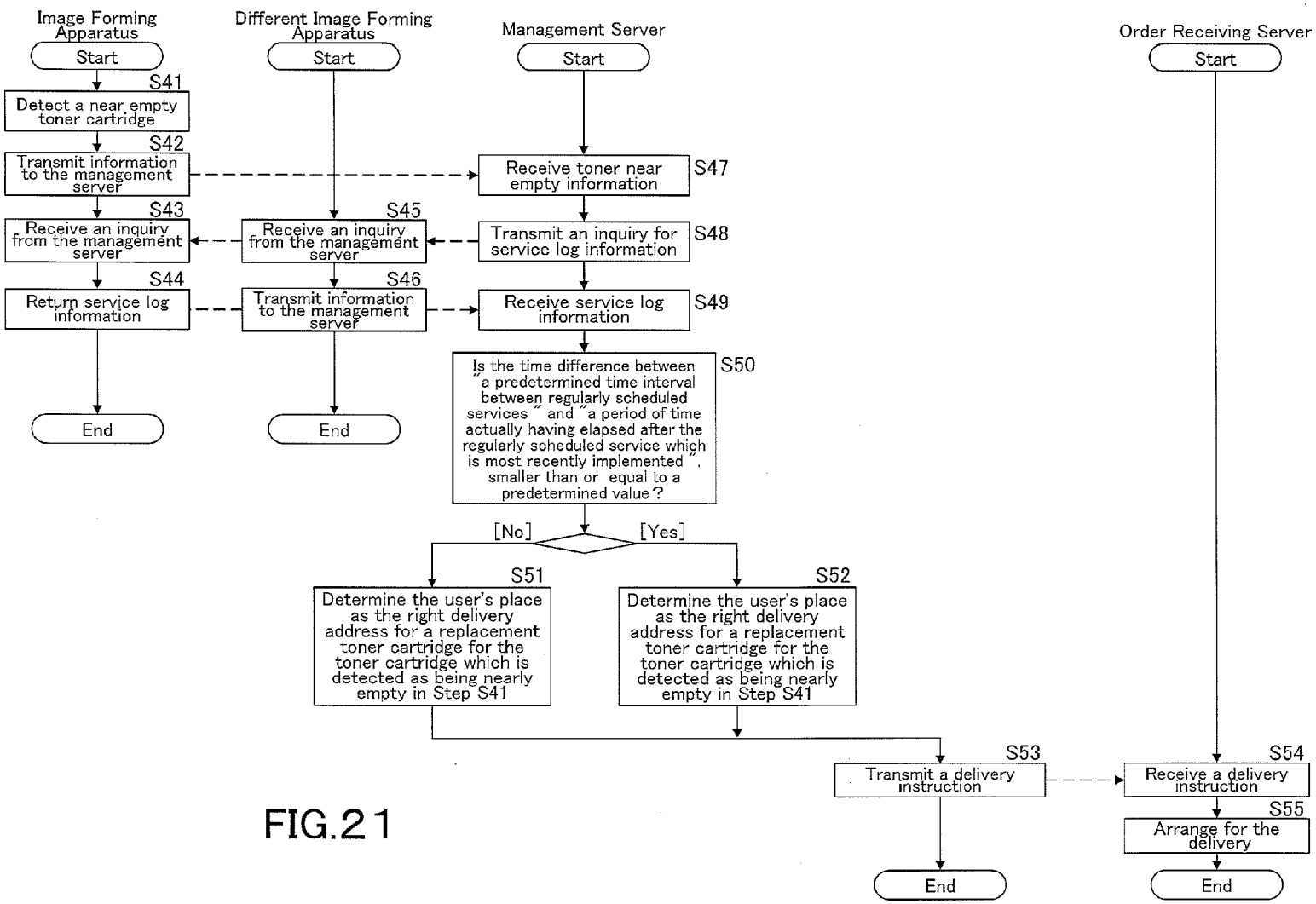
FIG. 21 illustrates a flowchart representing a processing routine executed by the management server and the order receiving server to determine a right delivery address for a replacement toner cartridge, output a delivery instruction, and arrange for the delivery accordingly, which starts when the image forming apparatus detects the toner near empty state of a toner cartridge loaded thereon, in the mode of embodied implementation of FIG. 20.

FIG. 21 illustrates a flowchart representing a processing routine executed by the management server 50 and the order receiving server 52 to determine a right delivery address for a replacement toner cartridge, output a delivery instruction, and arrange for the delivery accordingly, which starts when an image forming apparatus 51 detects the toner near empty state of a toner cartridge loaded thereon, in the mode of embodied implementation of FIG. 20. The processing routine is executed by the CPU 50*a* of the management server 50 according to an operation program stored on a recording medium such as the ROM 50*b*.

In Step S41, an image forming apparatuses 51 detects the toner near empty state of a toner cartridge loaded thereon. This means that the replacement toner cartridge will be out of stock in a short time, and the image forming apparatus 51 transmits toner near empty information to the management server 50 in Step S42.

Receiving the toner near empty information in Step S47, the management server 50 returns an inquiry for service log information to the image forming apparatus 51 causing the toner near empty information and other image forming apparatuses 51 which are all provided at the same place, in Step S48.

Receiving this inquiry from the management server 50 in Steps S43 and S45, the image forming apparatuses 51 individually return thereto the service log information in Steps S44 and S46.

Receiving the service log information in Step S49, the management server 50 judges whether or not the time difference between "a predetermined time interval between regularly scheduled services" and "a period of time having elapsed after the regularly scheduled service which is most recently implemented" is smaller than or equal to a predetermined value, in Step S50.

If the time difference is larger than the predetermined value (NO in Step S50), the routine proceeds to Step S51, in which the user's place is determined as the right delivery address for a replacement toner cartridge for the toner cartridge which is detected as being nearly empty in Step S41. Then the routine proceeds to Step S53. If the time difference is smaller than or equal to the predetermined value (YES in Step S50), the routine proceeds to Step S52, in which the service center 53 is determined as the right delivery address for a replacement toner cartridge for the toner cartridge which is detected as being nearly empty in Step S41. Then the routine proceeds to Step S53.

In Step S53, a delivery instruction is outputted to the order receiving server 52 so that the replacement toner cartridge will be delivered to the determined delivery address.

Receiving this delivery instruction in Step S54, the order receiving server 52 accordingly arranges for the delivery in Step S55.

According to the mode of embodied implementation of FIG. 20, the inconvenience that a replacement toner cartridge for a near empty toner cartridge is delivered to the user's place uselessly after the near empty toner cartridge has been replaced with a new one by a service engineer, will be eliminated.

Figure 22:
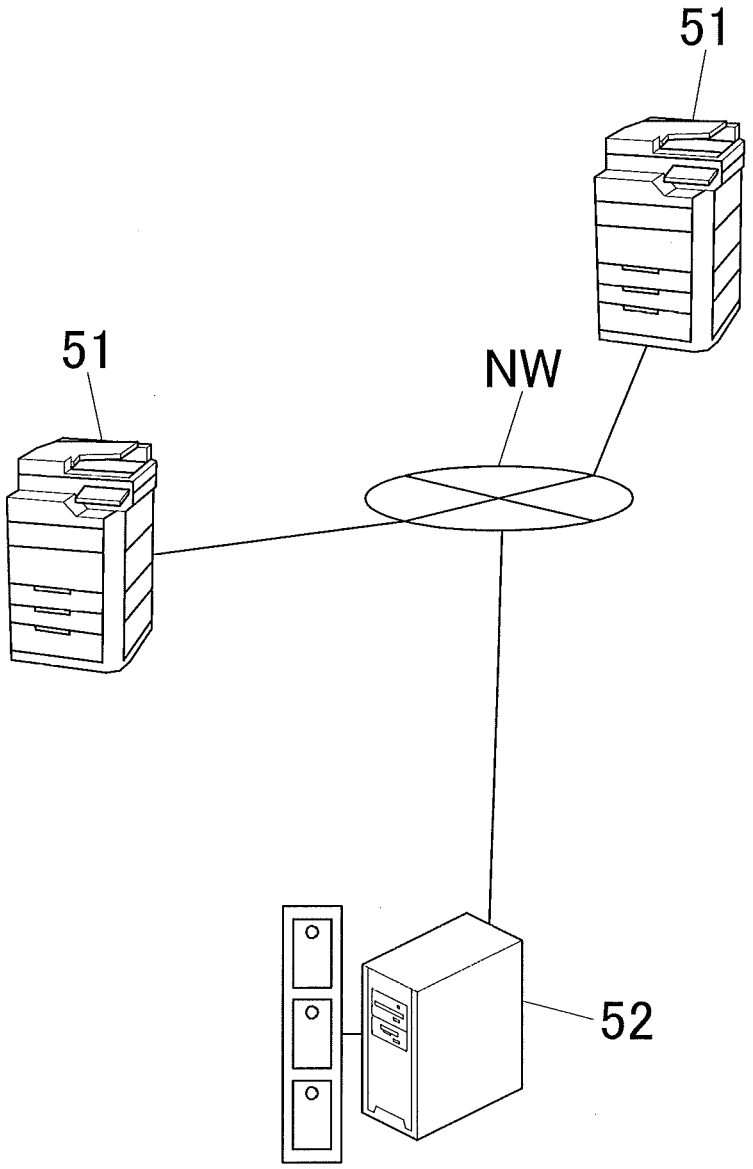
FIG. 22 is a view illustrating a configuration of a consumable unit management system according to yet another mode of implementing the present invention.

FIG. 22 is a view illustrating a configuration of a consumable unit management system according to yet another mode of implementing the present invention. In this mode of embodied implementation, each of the image forming apparatuses 51 collectively has the functions of the management server 50 installed thereon and outputs a delivery instruction to the order receiving server 52 via a network such as the Internet.

Figure 23:
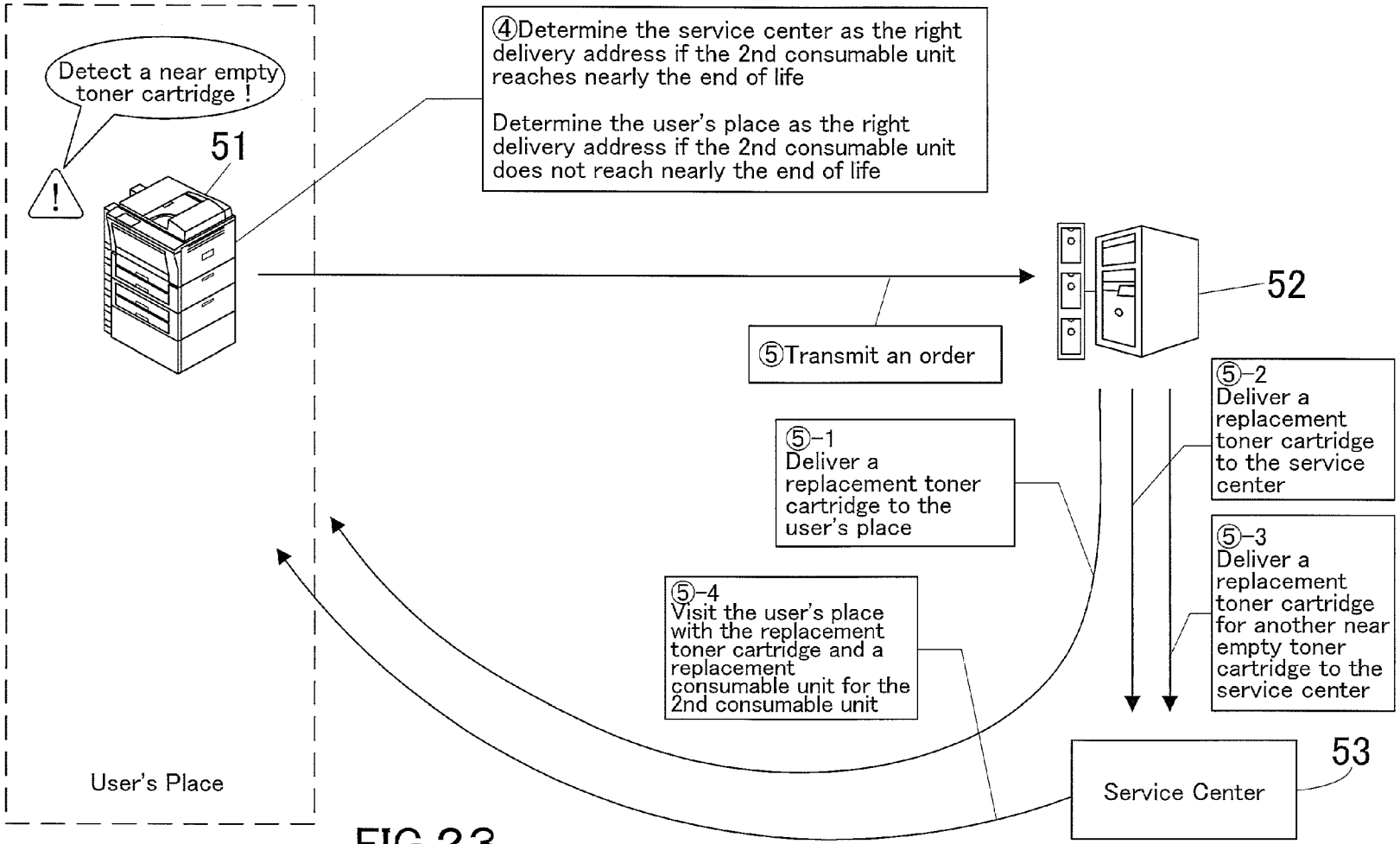
FIG. 23 is a view to explain the overview of a procedure executed by the consumable unit management system according to the mode of embodied implementation of FIG. 22 to determine a right delivery address for a replacement consumable unit, output a delivery instruction, and arrange for the delivery accordingly.

FIG. 23 is a view to explain the overview of a procedure executed by a consumable unit management system according to the mode of embodied implementation of FIG. 22 to determine a right delivery address for a replacement consumable unit, output a delivery instruction, and arrange for the delivery accordingly.

When a toner cartridge loaded on an image forming apparatus 51 becomes nearly empty, the image forming apparatus 51 detects the toner near empty state of the toner cartridge. And the image forming apparatus 51 further obtains the remaining amount (life) information of a second consumable unit loaded thereon, which is supposed to be replaced with a new one by a service engineer.

If the second consumable unit reaches nearly the end of life (or the remaining amount (life) information exceeds a predetermined value), the image forming apparatus 51 determines the service center 53 as the right delivery address for a replacement toner cartridge for the near empty toner cartridge (circled number 4), and outputs a delivery instruction to the order receiving server 52 (circled number 5) so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge and a replacement consumable unit for the second consumable unit (for example, a transfer belt unit) (circled number 5-4), and replaces the near empty toner cartridge and the second replacement unit with the new ones.

On the other hand, if the second consumable unit does not reach nearly the end of life, the management server 50 determines the user's place as the right delivery address for a replacement toner cartridge for the near empty toner cartridge (circled number 4), and outputs a delivery instruction to the order receiving server 52 (circled number 5) so that toner will be delivered to the user's place. Meanwhile the receiving server 52 arranges for shipping out the replacement toner cartridge to the user's place (circled number 5-1). In this case, the near empty toner cartridge will be replaced with the received replacement toner cartridge by the user.

In this mode of embodied implementation, if any other toner cartridge loaded on the same image forming apparatus 51 is nearly empty after the service center 53 is determined as the right delivery address, the image forming apparatus 51 outputs a delivery instruction to the order receiving server 52 (circled number 5, 5-3), so that a replacement toner cartridge for the other near empty toner cartridge also will be delivered to the service center 53.

Figure 24:
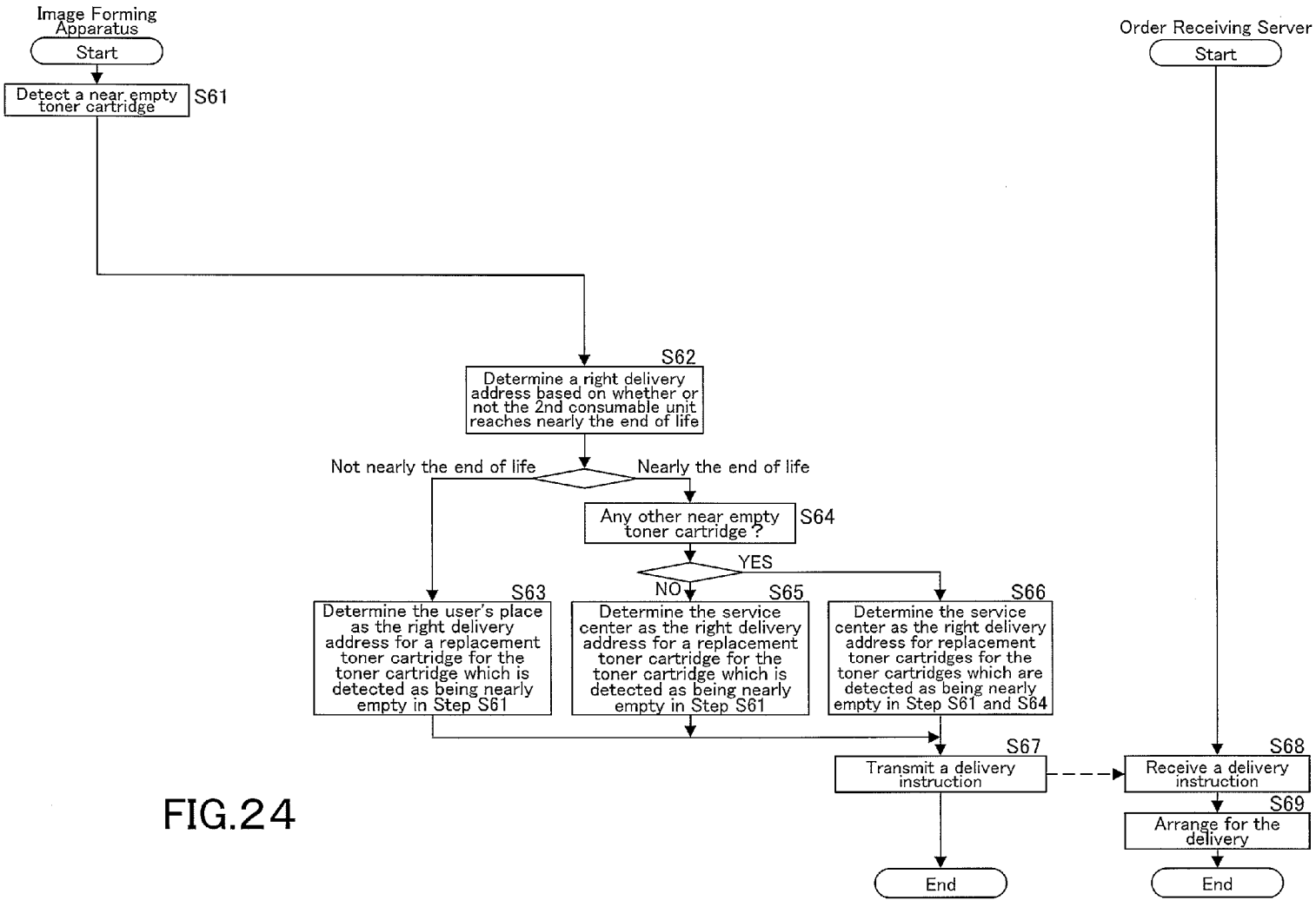
FIG. 24 is a flowchart representing a processing routine executed by the management server and the order receiving server to determine a right delivery address for a replacement toner cartridge, output a delivery instruction, and arrange for the delivery accordingly, which starts when the image forming apparatus detects the toner near empty state of a toner cartridge loaded thereon.

FIG. 24 is a flowchart representing a processing routine executed by the management server 50 and the order receiving server 52 to determine a right delivery address for a replacement toner cartridge, output a delivery instruction, and arrange for the delivery accordingly, which starts when an image forming apparatus 51 detects the toner near empty state of a toner cartridge loaded thereon. The processing routine is executed by the CPU 401 of the image forming apparatus 51 according to an operation program stored on a recording medium such as the ROM 406.

In Step S61, an image forming apparatus 51 detects the toner near empty state of a toner cartridge loaded thereon. Then the image forming apparatus 51 further obtains the remaining amount (life) information of a second consumable unit loaded thereon, and determines a right delivery address for a replacement toner cartridge for the near empty toner cartridge based on whether or not the second consumable unit reaches nearly the end of life.

In other words, if the second consumable unit does not reach nearly the end of life, the routine proceeds to Step S63, in which the user's place is determined as the right delivery address for a replacement toner cartridge for the toner cartridge which is detected as being nearly empty in Step S61. Then the routine proceeds to Step S67.

If the second consumable unit reaches nearly the end of life, the routine proceeds to Step S64, in which it is examined whether or not any other toner cartridge is nearly empty.

If no other toner cartridge becomes nearly empty (NO in Step S64), the routine proceeds to Step S65, in which the service center 53 is determined as the right delivery address for a replacement toner cartridge for the toner cartridge which is detected as being nearly empty in Step S61. Then the routine proceeds to Step S67. If another toner cartridge becomes nearly empty (YES in Step S64), the routine proceeds to Step S66, in which the service center 53 is determined as the right delivery address for replacement toner cartridges for the toner cartridges which are detected as being nearly empty in Step S61 and Step S64. Then the routine proceeds to Step S67.

In Step S67, a delivery instruction is outputted to the order receiving server 52, so that the replacement toner cartridges will be delivered to the determined delivery address.

Receiving this delivery instruction in Step S68, the order receiving server 52 accordingly arranges for the delivery in Step S69.

Figure 25:
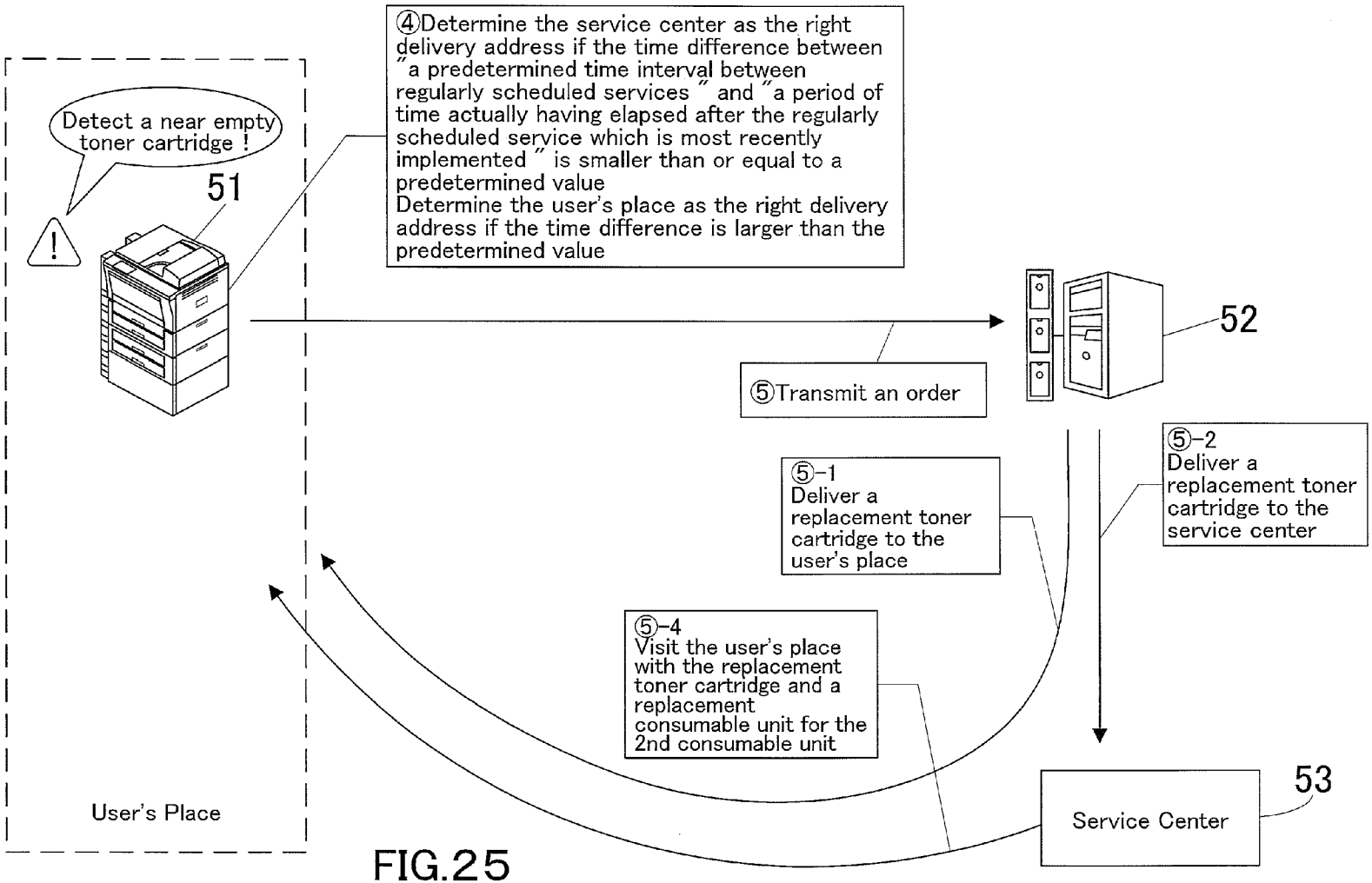
FIG. 25 is a view to explain the overview of a procedure executed by the consumable unit management system of FIG. 22 to determine a right delivery address for a replacement consumable unit, output a delivery instruction, and arrange for the delivery accordingly, in still yet another mode of implementing the present invention.

FIG. 25 is a view to explain the overview of a procedure executed by the consumable unit management system of FIG. 22 to determine a right delivery address for a replacement consumable unit, output a delivery instruction, and arrange for the delivery accordingly, in still yet another mode of implementing the present invention.

When a toner cartridge loaded on an image forming apparatus 51 becomes nearly empty, the image forming apparatus 51 detects the toner near empty state of the toner cartridge, and further obtains its own service log information.

Based on the obtained service log information, the image forming apparatus 51 examines the time difference between "a predetermined time interval between regularly scheduled services" and "a period of time actually having elapsed after the regularly scheduled service which is most recently implemented". If the time difference is smaller than or equal to a predetermined value, this means that a service engineer will come to the user's place for a regularly scheduled service in a short time. And the image forming apparatus 51 determines the service center 53 as the right delivery address for a replacement toner cartridge for the near empty toner cartridge (circled number 4), and outputs a delivery instruction to the order receiving server 52 (circled number 5), so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge (circled number 5-4), and implements a regularly scheduled service and replaces the near empty toner cartridge with the new one.

If the time difference between "a predetermined time interval between regularly scheduled services" and "a period of time actually having elapsed after the regularly scheduled service which is most recently implemented" is larger than the predetermined value, this means that a service engineer will not come to the user's place for a regularly scheduled service any time soon. And the image forming apparatus 51 determines the place where the image forming apparatus 51 itself is located (the user's place) as the right delivery address for a replacement toner cartridge for the near empty toner cartridge (circled number 4), and outputs a delivery instruction to the order receiving server 52 (circled number 5) so that the replacement toner cartridge will be delivered to the user's place. The order receiving server 52 arranges for shipping out the replacement toner cartridge to the user's place (circled number 5-1). In this case, the near empty toner cartridge will be replaced with the received replacement toner cartridge by the user.

Figure 26:
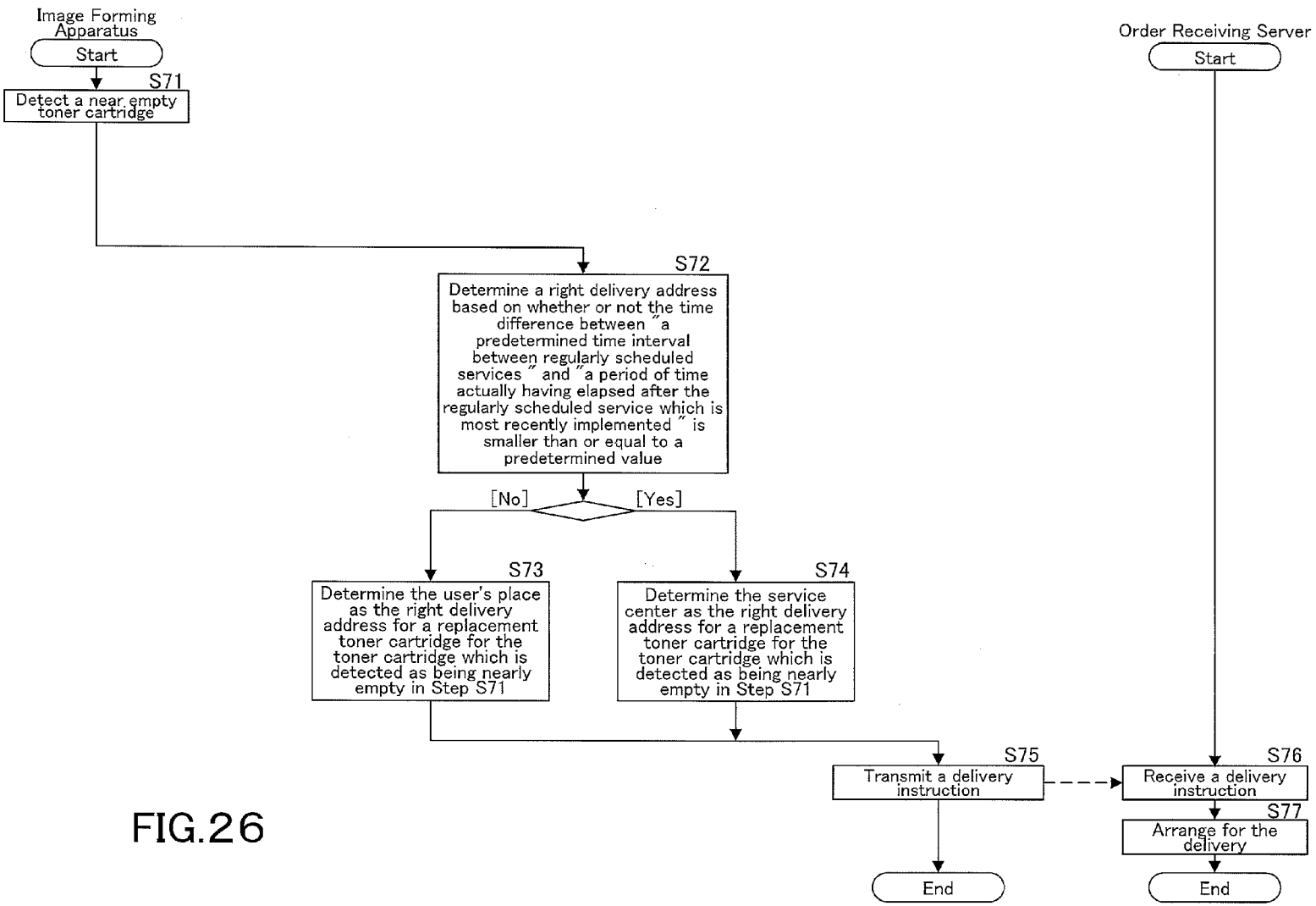
FIG. 26 illustrates a flowchart representing a processing routine executed by the image forming apparatus and the order receiving server to determine a right delivery address for a replacement toner cartridge, output a delivery instruction, and arrange for the delivery accordingly, which the image forming apparatus detects the toner near empty state of a toner cartridge loaded thereon, in the mode of embodied implementation of FIG. 25.

FIG. 26 illustrates a flowchart representing a processing routine executed by the image forming apparatus 51 and the order receiving server 52 to determine a right delivery address for a replacement toner cartridge, output a delivery instruction, and arrange for the delivery accordingly, which starts when the image forming apparatus detects the toner near empty state of a toner cartridge loaded thereon, in the mode of embodied implementation of FIG. 25. The processing routine is executed by the CPU 401 of the image forming apparatus 51 according to an operation program stored on a recording medium such as the ROM 406.

In Step S71, an image forming apparatuses 51 detects the toner near empty state of a toner cartridge loaded thereon. Then in Step S72, the image forming apparatus 51 obtains its own service log information, and examines whether or not the time difference between "a predetermined time interval between regularly scheduled services" and "a period of time actually having elapsed after the regularly scheduled service which is most recently implemented" is smaller than or equal to a predetermined value.

If the time difference is larger than the predetermined value (NO in Step S50), the routine proceeds to Step S73, in which the user's place is determined as the right delivery address for a replacement toner cartridge for the toner cartridge which is detected as being nearly empty in Step S71. Then the routine proceeds to Step S75. If the time difference is smaller than or equal to the predetermined value (YES in Step S50), the routine proceeds to Step S74, in which the service center 53 is determined as the right delivery address for a replacement toner cartridge for the toner cartridge which is detected as being nearly empty in Step S71. Then the routine proceeds to Step S75.

In Step S75, a delivery instruction is outputted to the order receiving server 52, so that the replacement toner cartridge will be delivered to the determined delivery address.

Receiving this delivery instruction in Step S76, the order receiving server 52 accordingly arranges for the delivery in Step S77.

Figure 27:
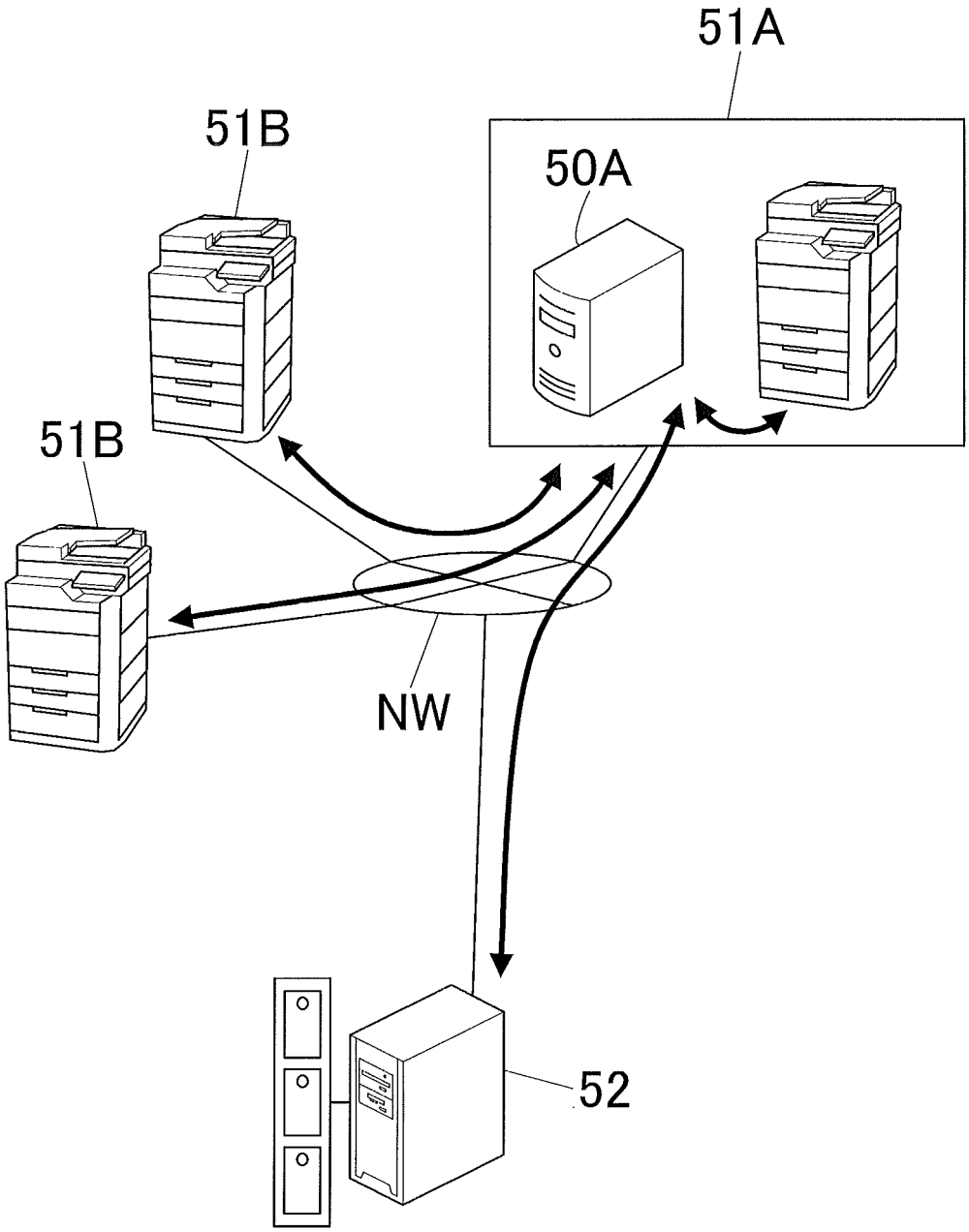
FIG. 27 is a view illustrating a configuration of a consumable unit management system according to still yet another mode of implementing the present invention.

FIG. 27 is a view illustrating a configuration of a consumable unit management system according to still yet another mode of implementing the present invention. In this mode of embodied implementation, some of the image forming apparatuses 51 are image forming apparatuses 51A which have a function 50A of the management server 50 installed thereon, and the other image forming apparatuses 51 are image forming apparatuses 51B which do not have it installed thereon. An image forming apparatus 51A having the server function 50A obtains the remaining amount (life) information of a first consumable unit and a second consumable unit installed thereon; receives the remaining amount (life) information of a first consumable unit and a second consumable unit installed on the image forming apparatus 51B; determines a right delivery address for a replacement consumable unit for the first consumable unit; and outputs a delivery instruction to the order receiving server 52.

Figure 28:
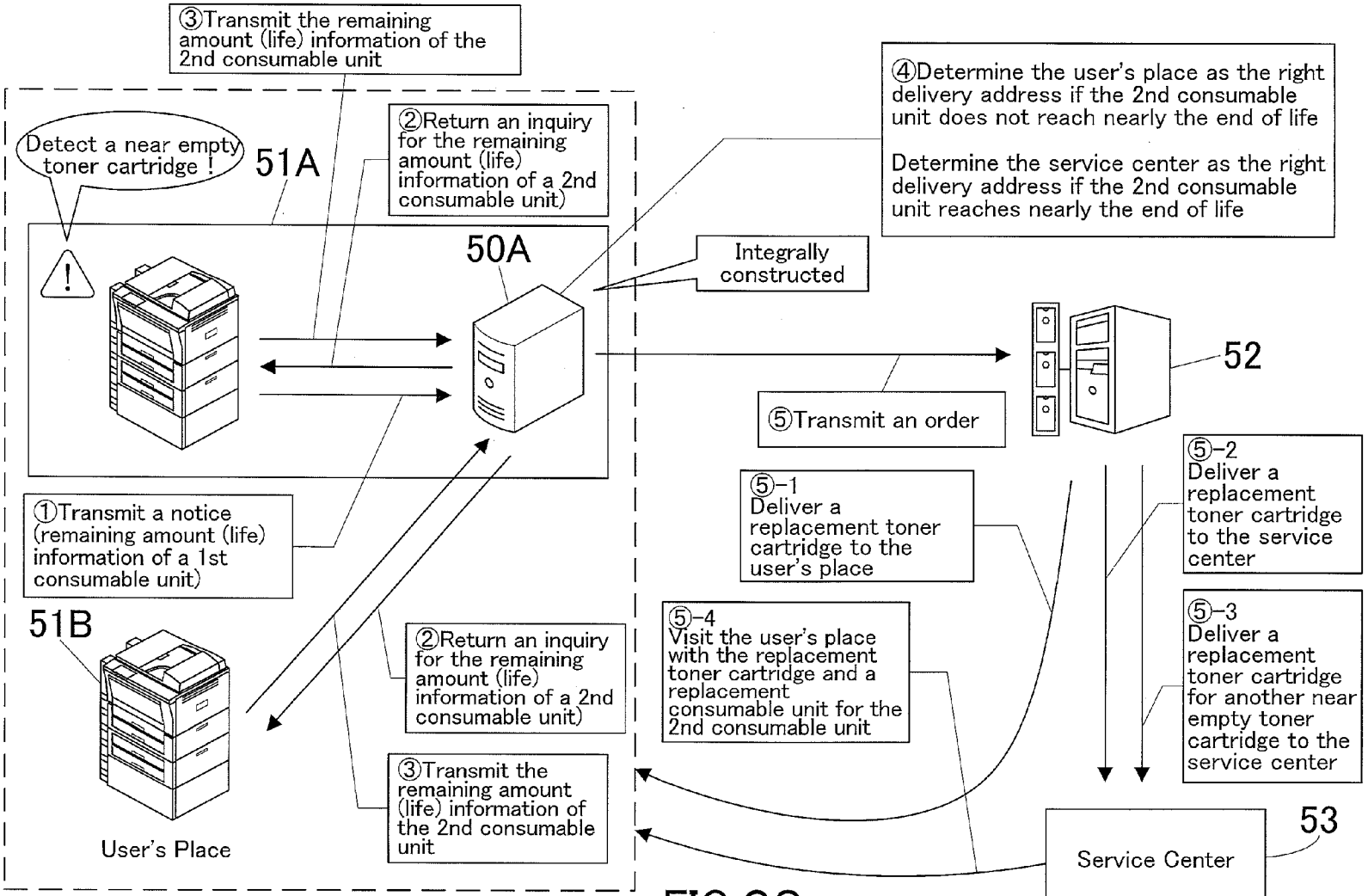
FIG. 28 is a view to explain the overview of a procedure executed by the consumable unit management system according to the mode of embodied implementation of FIG. 27 to determine a right delivery address for a replacement consumable unit, output a deliver instruction, and arrange for the delivery accordingly.

FIG. 28 is a view to explain the overview of a procedure executed by a consumable unit management system according to the mode of embodied implementation of FIG. 27 to determine a right delivery address for a replacement consumable unit, output a delivery instruction, and arrange for the delivery accordingly.

When a toner cartridge loaded on an image forming apparatus 51A having the server function 51A becomes nearly empty, the image forming apparatus 51A transmits a notice of the occurrence of toner near empty (remaining amount (life) information of a first consumable unit) to the server function 50A (circled number 1 in FIG. 28).

Receiving this notice, the server function 50A transmits an inquiry for the remaining amount (life) information of a second consumable unit to the image forming apparatus 51A and more than one other image forming apparatus 51A and 51B which are all used by the same user at the same place (circled number 2).

The image forming apparatuses 51A and 51B individually return to the server function 50A, the remaining amount (life) information of a second consumable unit loaded thereon (circled number 3). If the second consumable unit reaches nearly the end of life (or the remaining amount (life) information exceeds a predetermined value), the server function 50A determines the service center 53 as the right delivery address for a replacement toner cartridge for the near empty toner cartridge (circled number 4), and outputs a delivery instruction to the order receiving server 52 (circled number 5) so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge and a replacement consumable unit for the second consumable unit (circled number 5-4), and replaces the near empty toner cartridge and the second replacement unit with the new ones.

On the other hand, if the second consumable unit does not reach nearly the end of life, the server function 50A determines the place where the image forming apparatus 51A is located (the user's place) as the right delivery address for a replacement toner cartridge for the near empty toner cartridge (circled number 4), and outputs a delivery instruction to the order receiving server 52 (circled number 5) so that toner will be delivered to the user's place. Meanwhile the order receiving server 52 arranges for shipping out the replacement toner cartridge to the user's place (circled number 5-1). In this case, the near empty toner cartridge will be replaced with the received replacement toner cartridge by the user.

If any other toner cartridge loaded on the image forming apparatuses 51A and 51B is nearly empty after the service center 53 is determined as the right delivery address, the server function 50A outputs a delivery instruction to the order receiving server 52 (circled number 5, 5-3), so that a replacement toner cartridge for the other near empty toner cartridge also will be delivered to the service center 53.

The procedure executed by an image forming apparatus 51A and the order receiving server 52 which are employed in the management system of FIG. 28 can be explained in detail with reference to the flowchart illustrated in FIG. 24.

Figure 29:
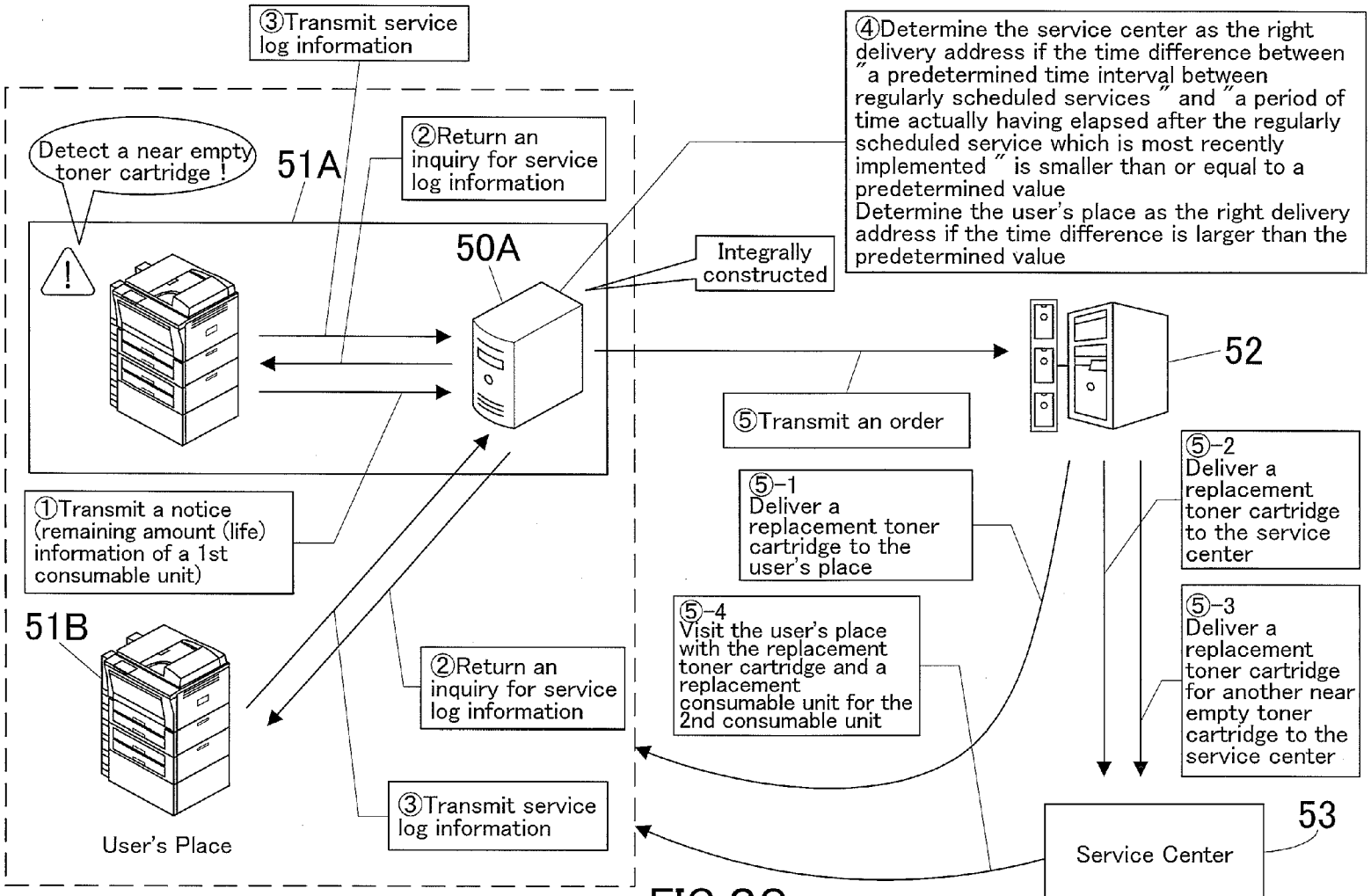
FIG. 29 is a view to explain the overview of a procedure executed by the consumable unit management system according to the mode of embodied implementation of FIG. 27 to determine a right delivery address for a replacement consumable unit, output a delivery instruction, and arrange for the delivery accordingly, in yet another mode of implementing the present invention.

FIG. 29 is a view to explain the overview of a procedure executed by the consumable unit management system of FIG. 27 to determine a right delivery address for a replacement consumable unit, output a delivery instruction, and arrange for the delivery accordingly, in still yet another mode of implementing the present invention.

When a toner cartridge loaded on an image forming apparatus 51A having the server function 51A becomes nearly empty, the image forming apparatus 51A transmits a notice of the occurrence of toner near empty (remaining amount (life) information of a first consumable unit) to the server function 50A which is connected with the image forming apparatus 51A via a communication circuit (circled number 1 in FIG. 28).

Receiving this notice, the server function 50A transmits an inquiry for service log information to the image forming apparatus 51 and more than one other image forming apparatus 51A and 51B which are all used by the same user at the same place (circled number 2).

The image forming apparatuses 51A and 51B individually return their service log information to the server function 50A (circled number 3). If the time difference between "a predetermined time interval between regularly scheduled services" and "a period of time actually having elapsed after the regularly scheduled service which is most recently implemented" is smaller than or equal to a predetermined value, according to the service log information of the image forming apparatuses 51A and 51B, this means that a service engineer will come to the user's place for a regularly schedule service in a short time. And the server function 50A determines the service center 53 as the right delivery address for a replacement toner cartridge for the near empty toner cartridge (circled number 4), and outputs a delivery instruction to the order receiving server 52 (circled number 5) so that the replacement toner cartridge will be delivered to the service center 53. The order receiving server 52 arranges for shipping out the replacement toner cartridge to the service center 53 (circled number 5-2).

A service engineer visits the user's place with the replacement toner cartridge (circled number 5-4), and implements a regularly scheduled service and replaces the near empty toner cartridge with the new one.

If the time difference between "a predetermined time interval between regularly scheduled services" and "a period of time actually having elapsed after the regularly scheduled service which is most recently implemented" is larger than the predetermined value, this means that a service engineer will not come to the user's place for a regularly scheduled service any time soon. And the server function 50A determines the user's place as the right delivery address for a replacement toner cartridge for the near empty toner cartridge (circled number 4), and outputs a delivery instruction to the order receiving server 52 (circled number 5) so that the replacement toner cartridge will be delivered to the user's place. The order receiving server 52 arranges for shipping out the replacement toner cartridge to the user's place (circled number 5-1). In this case, the near empty toner cartridge will be replaced with the received replacement toner cartridge by the user.

While the present invention has been described herein with reference to some particular modes of embodied implementation, it should be understood that the invention is not limited thereto.

Specifically, in these modes of embodied implementation, an order receiving server 52 is employed in the management system, and the management server 50 outputs a delivery instruction to the order receiving server 52. Alternatively, the management server 50 may display a message encouraging the user to place an order, on its own display 50*e* or a display of another machine such as a personal computer. In such a case, an order placement operation is manually performed.

Furthermore, the consumable units are toner cartridges for example in these modes or embodied implementation, but those may be imaging units including photoreceptor drums. In such a case, instead of the remaining toner information of toner cartridges, the management server 50 manages the life information of photoreceptor drums which are consumable. Alternatively, the consumable units may be those dedicated for inkjet image forming apparatuses.

The present invention of the subject application having been described above may be applied to the following modes.

[1] A replacement consumable unit management apparatus provided with: a receiver which receives consumable unit replacement information indicating that one consumable unit of one color or more than one consumable unit of different colors has been replaced with a new one, from one or more than one image forming apparatus which the replacement consumable unit management apparatus can access via a communication circuit;

a consumable unit manager which manages the remaining amount information or the life information of the one or more than one consumable unit, and stock information indicating the states of the stocks of replacement consumable units for the one or more than one consumable unit;

a determiner which, if the receiver receives the consumable unit replacement information while a consumable unit which cannot be replaced with a new one because of no stock and a consumable unit whose remaining amount information or life information is smaller than a first predetermined value are both used at the same place as the new consumable unit most recently loaded, makes a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together; and a transmitter which outputs a delivery instruction as determined by the determiner.

[2] The replacement consumable unit management apparatus as recited in the aforementioned item [1], wherein:

the stock information managed by the consumable unit manager indicates that: there is no replacement consumable unit in stock; there is a replacement consumable unit in stock while another replacement consumable unit has not been shipped out; or there is a replacement consumable unit in stock while another replacement consumable unit has been shipped out; and the consumable unit manager updates the stock information when the receiver receives the consumable unit replacement information or when the transmitter outputs the delivery instruction.

[3] The replacement consumable unit management apparatus as recited in the aforementioned item [1], wherein:

if the receiver receives the consumable unit replacement information while there are a consumable unit which cannot be replaced with a new one because of no stock and a consumable unit whose remaining amount information or life information is larger than the first predetermined value but smaller than a second predetermined value, the determiner makes a second determination that the first replacement consumable unit and a third replacement consumable unit of the same color as the consumable unit whose remaining amount information or life information is larger than the first predetermined value but smaller than the second predetermined value should be kept on hold before the remaining amount information or the life information reaches the first predetermined value then be delivered together eventually when the remaining amount information or the life information reaches the first predetermined value; and if the receiver receives the consumable unit replacement information while there is any consumable unit that cannot be replaced with a new one because of no stock but there is no consumable unit whose remaining amount information or life information is smaller than the first predetermined value neither no consumable unit whose remaining amount information or life information is larger than the first predetermined value but smaller than a second predetermined value, the determiner makes a third determination that only the first replacement consumable unit should be delivered.

[4] The replacement consumable unit management apparatus as recited in the aforementioned item [3], wherein after making the second determination, eventually when the remaining amount information or the life information of the consumable unit which cannot be replaced with a new one because of no stock reaches the second predetermined value before that of the consumable unit whose remaining amount information or life information is larger than the first predetermined value but smaller than the second predetermined value reaches the first predetermined value, the determiner makes a fourth determination that only the first replacement consumable unit should be delivered.

[5] The replacement consumable unit management apparatus as recited in the aforementioned item [1], wherein the consumable units are toner cartridges.

[6] The replacement consumable unit management apparatus as recited in the aforementioned item [1], wherein the transmitter outputs the delivery instruction to an order receiving server which the replacement consumable unit management apparatus can access via a communication circuit to place an order for a replacement consumable unit.

[7] An image forming apparatus provided with:

a detector which detects that a consumable unit loaded on the image forming apparatus or loaded on a different image forming apparatus which the image forming apparatus can access via a communication circuit has been replaced with a new one;

a consumable unit manager which manages the remaining amount information or the life information of one consumable unit of one color or more than one consumable unit of different colors loaded on the image forming apparatus, and stock information indicating the states of the stocks of replacement consumable units for the one or more than one consumable unit;

a determiner which, when the detector detects that a consumable unit has been replaced with a new one, determines a right replacement consumable unit to be delivered to the same place as the new consumable unit most recently loaded, based on the remaining amount information or the life information and the stock information which are all managed by the consumable unit manager; and a transmitter which outputs a delivery instruction as determined by the determiner.

[8] The image forming apparatus as recited in the aforementioned item 7, wherein:

the stock information managed by the consumable unit manager indicates that: there is no replacement consumable unit in stock; there is a replacement consumable unit in stock while another replacement consumable unit has not been shipped out; or there is a replacement consumable unit in stock while another replacement consumable unit has been shipped out; and the consumable unit manager updates the stock information when the receiver receives the consumable unit replacement information or when the transmitter outputs the delivery instruction.

[9] The image forming apparatus as recited in the aforementioned item [7], wherein:

if the receiver receives the consumable unit replacement information while there are both any consumable unit that cannot be replaced with a new one because of no stock and any consumable unit whose remaining amount information or life information is larger than the first predetermined value but smaller than a second predetermined value, the determiner makes a second determination that the first replacement consumable unit and a third replacement consumable unit of the same color as the consumable unit whose remaining amount information or life information is larger than the first predetermined value but smaller than the second predetermined value should be kept on hold before the remaining amount information or the life information reaches the first predetermined value then be delivered together eventually when the remaining amount information or the life information reaches the first predetermined value; and if the receiver receives the consumable unit replacement information while there is any consumable unit that cannot be replaced with a new one because of no stock but there is no consumable unit whose remaining amount information or life information is smaller than the first predetermined value neither no consumable unit whose remaining amount information or life information is larger than the first predetermined value but smaller than a second predetermined value, the determiner makes a third determination that only the first replacement consumable unit should be delivered.

[10] The image forming apparatus as recited in the aforementioned item [9], wherein after making the second determination, eventually when the remaining amount information or the life information of the consumable unit which cannot be replaced with a new one because of no stock reaches the second predetermined value before that of the consumable unit whose remaining amount information or life information is larger than the first predetermined value but smaller than the second predetermined value reaches the first predetermined value, the determiner makes a fourth determination that only the first replacement consumable unit should be delivered.

[11] The image forming apparatus as recited in the aforementioned item [7], wherein the consumable units are toner cartridges.

[12] The image forming apparatus as recited in the aforementioned item [7], wherein the transmitter outputs the delivery instruction to an order receiving server which the image forming apparatus can access via a communication circuit to place an order for a replacement consumable unit.

[13] A replacement consumable unit management system provided with one or more than one image forming apparatus and a replacement consumable unit management apparatus which can access each other via a communication circuit, wherein:

the image forming apparatus is provided with:

one consumable unit of one color or more than one consumable unit of different colors loaded thereon; and a transmitter which transmits consumable unit replacement information indicating that a consumable unit has been replaced with a new one; and the replacement toner cartridge management apparatus is provided with:

a receiver which receives the consumable unit replacement information;

a consumable unit manager which manages the remaining amount information or the life information of the one or more than one consumable unit, and stock information indicating the states of the stocks of replacement consumable units for the one or more than one consumable unit;

a determiner which, if the receiver receives the consumable unit replacement information while a consumable unit cannot be replaced with a new one because of no stock and a consumable unit whose remaining amount information or life information is smaller than a first predetermined value are both used at the same place as the new consumable unit most recently loaded, makes a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together; and a transmitter which outputs a delivery instruction as determined by the determiner.

[14] The replacement consumable unit management system as recited in the aforementioned item [13], wherein:

the stock information managed by the consumable unit manager of the replacement consumable unit management apparatus indicates that: there is no replacement consumable unit in stock; there is a replacement consumable unit in stock while another replacement consumable unit has not been shipped out; or there is a replacement consumable unit in stock while another replacement consumable unit has been shipped out; and the consumable unit manager updates the stock information when the receiver of the replacement consumable unit management apparatus receives the consumable unit replacement information or when the transmitter outputs the delivery instruction.

[15] The replacement consumable unit management system as recited in the aforementioned item [13], wherein:

if the receiver of the replacement consumable unit management apparatus receives the consumable unit replacement information while there are a consumable unit which cannot be replaced with a new one because of no stock and a consumable unit whose remaining amount information or life information is larger than the first predetermined value but smaller than a second predetermined value, the determiner of the replacement consumable unit management apparatus makes a second determination that the first replacement consumable unit and a third replacement consumable unit of the same color as the consumable unit whose remaining amount information or life information is larger than the first predetermined value but smaller than the second predetermined value should be kept on hold before the remaining amount information or the life information reaches the first predetermined value then be delivered together eventually when the remaining amount information or the life information reaches the first predetermined value; and if the receiver receives the consumable unit replacement information while there is any consumable unit that cannot be replaced with a new one because of no stock but there is no consumable unit whose remaining amount information or life information is smaller than the first predetermined value neither no consumable unit whose remaining amount information or life information is larger than the first predetermined value but smaller than a second predetermined value, the determiner makes a third determination that only the first replacement consumable unit should be delivered.

[16] The replacement consumable unit management system as recited in the aforementioned item [15], wherein after making the second determination, eventually when the remaining amount information or the life information of the consumable unit which cannot be replaced with a new one because of no stock reaches the second predetermined value before that of the consumable unit whose remaining amount information or life information is larger than the first predetermined value but smaller than the second predetermined value reaches the first predetermined value, the determiner of the replacement consumable unit management apparatus makes a fourth determination that only the first replacement consumable unit should be delivered.

[17] The replacement consumable unit management system as recited in the aforementioned item [13], wherein the consumable units are toner cartridges.

[18] The replacement consumable unit management system as recited in the aforementioned item [13], wherein the transmitter of the replacement consumable unit management apparatus outputs the delivery instruction to an order receiving server which the replacement consumable unit management apparatus can access via a communication circuit to place an order for a replacement consumable unit.

[19] A replacement consumable unit management method implemented by a replacement consumable unit management system provided with one or more than one image forming apparatus and a replacement consumable unit management apparatus which can access each other via a communication circuit, including:

the image forming apparatus's:

having one consumable unit of one color or more than one consumable unit of different colors loaded thereon; and transmitting consumable unit replacement information indicating that a consumable unit has been replaced with a new one; and the replacement toner cartridge management apparatus's:

receiving the consumable unit replacement information;

managing the remaining amount information or the life information of the one or more than one consumable unit, and stock information indicating the states of the stocks of replacement consumable units for the one or more than one consumable unit;

making a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together, if the consumable unit replacement information is received while a consumable unit which cannot be replaced with a new one because of no stock and a consumable unit whose remaining amount information or life information is smaller than a first predetermined value are both used at the same place as the new consumable unit most recently loaded; and outputting a delivery instruction.

[20] A non-transitory computer-readable recording medium having a replacement consumable unit management program stored thereon to make a computer of a replacement consumable unit management apparatus execute:

receiving consumable unit replacement information indicating that a consumable unit has been replaced with a new one, from one or more than one image forming apparatus which the replacement consumable unit management apparatus can access via a communication circuit;

managing the remaining amount information or the life information of one consumable unit of one color or more than one consumable unit of different colors loaded on the image forming apparatus, and stock information indicating the states of the stocks of replacement consumable units for the one or more than one consumable unit;

making a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together, if the consumable unit replacement information is received while a consumable unit which cannot be replaced with a new one because of no stock and a consumable unit whose remaining amount information or life information is smaller than a first predetermined value are both used at the same place as the new consumable unit most recently loaded; and outputting a delivery instruction.

[21] A non-transitory computer readable recording medium having a replacement consumable unit management program stored thereon to make a computer of an image processing apparatus execute:

detecting that a consumable unit loaded on the image forming apparatus or loaded on a different image forming apparatus which the image forming apparatus can access via a communication circuit has been replaced with a new one;

managing the remaining amount information or the life information of one consumable unit of one color or more than one consumable unit of different colors loaded on the image forming apparatus, and stock information indicating the states of the stocks of replacement consumable units for the one or more than one consumable unit;

determining a right replacement consumable unit to be delivered to the same place as the new consumable unit most recently loaded, based on the remaining amount information or the life information and the stock information which are all managed by the consumable unit manager, when it is detected that a consumable unit has been replaced with a new one; and outputting a delivery instruction.

[22] A replacement consumable unit management apparatus provided with:

a receiver which receives the life information of a first consumable unit from one or more than one image forming apparatus which the replacement consumable unit management apparatus can access via a communication circuit, and the life information of a second consumable unit loaded on the image forming apparatus causing the life information of the first consumable unit and/or a different image forming apparatus provided at the same place as the image forming apparatus causing the life information of the first consumable unit;

a transmitter which outputs an instruction to deliver a replacement consumable unit for the first consumable unit, depending on the life information of the first consumable unit; and a determiner which determines a first delivery address or a second delivery address for a replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

[23] The replacement consumable unit management apparatus as recited in the aforementioned item [22], wherein the first consumable unit serves for image forming and is supposed to be replaced with a new one by a user; the second consumable unit also serves for image forming is supposed to be replaced with a new one by a service engineer; the first delivery address corresponds to the place in which the image forming apparatuses are provided; and the second delivery address corresponds to a service center.

[24] The replacement consumable unit management apparatus as recited in the aforementioned item [22], wherein the determiner determines the second delivery address if the life information of the second consumable unit is smaller than or equal to a predetermined value, or the first delivery address if the life information of the second consumable unit is larger than the predetermined value.

[25] The replacement consumable unit management apparatus as recited in the aforementioned item [24], wherein if the determiner determines the second delivery address while any other first consumable unit whose life information is smaller than the predetermined value is loaded on the image forming apparatus causing the life information of the first consumable unit or the different image forming apparatus provided at the same place as the image forming apparatus causing the life information of the first consumable unit, the transmitter further outputs an instruction to deliver a replacement consumable unit for the other first consumable unit to the second delivery address.

[26] A replacement consumable unit management apparatus provided with:

a receiver which receives the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus causing the life information of the first consumable unit and/or a different image forming apparatus provided at the same place as the image forming apparatus causing the life information of the first consumable unit;

a transmitter which transmits an instruction to deliver a replacement consumable unit for the first consumable unit, depending on the life information of the first consumable unit which is received by the receiver; and a determiner which determines a first delivery address or a second delivery address for a replacement consumable unit for the first consumable unit, based on the service log information if the receiver receives the service log information before the transmitter outputs the delivery instruction, and wherein the transmitter that outputs an instruction to deliver a replacement consumable unit for the first consumable unit to the determined delivery address.

[27] The replacement consumable unit management apparatus as recited in the aforementioned item [26], wherein the first consumable unit serves for image forming and is supposed to be replaced with a new one by a user; the first delivery address corresponds to the place in which the image forming apparatuses are provided; and the second delivery address corresponds to a service center.

[28] The replacement consumable unit management apparatus as recited in the aforementioned item [26], wherein the determiner determines the second delivery address if the service log information is smaller than or equal to a predetermined value, or the first delivery address if the service log information is larger than the predetermined value.

[29] The replacement consumable unit management apparatus as recited in the aforementioned item [22], wherein the transmitter outputs the delivery instruction to an order receiving server which the image forming apparatus can access via a communication circuit to place an order for a replacement consumable unit.

[30] An image forming apparatus provided with:

a receiver which receives the life information of a first consumable unit loaded on the image forming apparatus, and the life information of a second consumable unit loaded on the image forming apparatus and/or a different image forming apparatus provided at the same place as the image forming apparatus;

a transmitter which outputs an instruction to deliver a replacement consumable unit for the first consumable unit, depending on the life information of the first consumable unit; and a determiner which determines a first delivery address or a second delivery address for a replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

[31] The image forming apparatus as recited in the aforementioned item [30], wherein the first consumable unit serves for image forming and is supposed to be replaced with a new one by a user; the second consumable unit also serves for image forming is supposed to be replaced with a new one by a service engineer; the first delivery address corresponds to the place in which the image forming apparatuses are provided; and the second delivery address corresponds to a service center.

[32] The image forming apparatus as recited in the aforementioned item [30], wherein the determiner determines the second delivery address if the life information of the second consumable unit is smaller than or equal to a predetermined value, or the first delivery address if the life information of the second consumable unit is larger than the predetermined value.

[33] The image forming apparatus as recited in the aforementioned item [32], wherein if the determiner determines the second delivery address while any other first consumable unit whose life information is smaller than the predetermined value is loaded on the image forming apparatus causing the life information of the first consumable unit or the different image forming apparatus provided at the same place as the image forming apparatus causing the life information of the first consumable unit, the transmitter further outputs an instruction to deliver a replacement consumable unit for the other first consumable unit to the second delivery address.

[34] An image forming apparatus provided with:

a receiver which receives the life information of a first consumable unit loaded on the image forming apparatus and service log information of the image forming apparatus and/or a different image forming apparatus provided at the same place as the image forming apparatus;

a transmitter which transmits an instruction to deliver a replacement consumable unit for the first consumable unit, depending on the life information of the first consumable unit which is received by the receiver; and a determiner which determines a first delivery address or a second delivery address for a replacement consumable unit for the first consumable unit, based on the service log information if the receiver receives the service log information before the transmitter outputs the delivery instruction, and wherein the transmitter that outputs an instruction to deliver a replacement consumable unit for the first consumable unit to the determined delivery address.

[35] The image forming apparatus as recited in the aforementioned item [34], wherein the first consumable unit serves for image forming and is supposed to be replaced with a new one by a user; the first delivery address corresponds to the place in which the image forming apparatuses are provided; and the second delivery address corresponds to a service center.

[36] The image forming apparatus as recited in the aforementioned item [34], wherein the determiner determines the second delivery address if the service log information is smaller than or equal to a predetermined value, or the first delivery address if the service log information is larger than the predetermined value.

[37] The image forming apparatus as recited in the aforementioned item [30], wherein the transmitter outputs the delivery instruction to an order receiving server which the image forming apparatus can access via a communication circuit to place an order for a replacement consumable unit.

[38] A replacement consumable unit management system provided with one or more than one image forming apparatus and a replacement consumable unit management apparatus which can access each other via a communication circuit, wherein:

the image forming apparatus is provided with:

one or more than one first consumable unit and one or more than one second consumable unit loaded thereon; and a transmitter which transmits the life information of a first consumable unit and a second consumable unit; and the replacement toner cartridge management apparatus is provided with:

a receiver which receives the life information of a first consumable unit loaded on the image forming apparatus and the life information of a second consumable unit loaded on the image forming apparatus and/or a different image forming apparatus provided at the same place as the image forming apparatus causing the life information of the first consumable unit;

a transmitter which outputs an instruction to deliver a replacement consumable unit for the first consumable unit, depending on the life information of the first consumable unit which is received by the receiver; and a determiner which determines a first delivery address or a second delivery address for a replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

[39] The replacement consumable unit management system as recited in the aforementioned item [38], wherein the first consumable unit serves for image forming and is supposed to be replaced with a new one by a user; the second consumable unit also serves for image forming and is supposed to be replaced with a new one by a service engineer; the first delivery address corresponds to the place in which the image forming apparatuses are provided; and the second delivery address corresponds to a service center.

[40] The replacement consumable unit management system as recited in the aforementioned item [38], wherein the determiner of the replacement consumable unit management apparatus determines the second delivery address if the life information of the second consumable unit is smaller than or equal to a predetermined value, or the first delivery address if the life information of the second consumable unit is larger than the predetermined value.

[41] The replacement consumable unit management system as recited in the aforementioned item [40], wherein if the determiner of the replacement consumable unit management apparatus determines the second delivery address while any other first consumable unit whose life information is smaller than the predetermined value is loaded on the image forming apparatus causing the life information of the first consumable unit or the different image forming apparatus provided at the same place as the image forming apparatus causing the life information of the first consumable unit, the transmitter further outputs an instruction to deliver a replacement consumable unit for the other first consumable unit to the second delivery address.

[42] A replacement consumable unit management system provided with one or more than one image forming apparatus and a replacement consumable unit management apparatus which can access each other via a communication circuit, wherein:

the image forming apparatus is provided with:

one or more than one first consumable unit and one or more than one second consumable unit loaded thereon; and a transmitter which transmits the life information of a first consumable unit and service log information indicating the time difference between a predetermined time interval between regularly scheduled services and a period of time actually having elapsed after the regularly scheduled service which is most recently implemented, from the image forming apparatus causing the life information of the first consumable unit and/or a different image forming apparatus provided at the same place as the image forming apparatus causing the life information of the first consumable unit; and the replacement consumable unit management apparatus is provided with:

a receiver which receives the life information of the first consumable unit and the service log information;

a transmitter which transmits an instruction to deliver a replacement consumable unit for the first consumable unit, depending on the life information of the first consumable unit which is received by the receiver; and a determiner which determines a first delivery address or a second delivery address for a replacement consumable unit for the first consumable unit, based on the service log information if the receiver receives the service log information before the transmitter outputs the delivery instruction, and wherein the transmitter outputs an instruction to deliver a replacement consumable unit for the first consumable unit to the determined delivery address.

[43] The replacement consumable unit management system as recited in the aforementioned item [42], wherein the first consumable unit serves for image forming and is supposed to be replaced with a new one by a user; the first delivery address corresponds to the place in which the image forming apparatuses are provided; and the second delivery address corresponds to a service center.

[44] The replacement consumable unit management system as recited in the aforementioned item [43], wherein the determiner of the replacement consumable unit management apparatus determines the second delivery address if the service log information is smaller than or equal to a predetermined value, or the first delivery address if the service log information is larger than the predetermined value.

[45] The replacement consumable unit management system as recited in the aforementioned item [39], wherein the transmitter of the replacement consumable unit management apparatus outputs the delivery instruction to an order receiving server which the image forming apparatus can access via a communication circuit to place an order for a replacement consumable unit.

[46] A non-transitory computer-readable recording medium having a replacement consumable unit management program stored thereon to make a computer of a replacement consumable unit management apparatus execute:

receiving the life information of a first consumable unit from one or more than one image forming apparatus which the replacement consumable unit management apparatus can access via a communication circuit, and the life information of a second consumable unit loaded on the image forming apparatus causing the life information of the first consumable unit and/or a different image forming apparatus provided at the same place as the image forming apparatus causing the life information of the first consumable unit;

outputting an instruction to deliver a replacement consumable unit for the first consumable unit, depending on the life information of the first consumable unit; and determining a first delivery address or a second delivery address for a replacement consumable unit for the first consumable unit based on the life information of the second consumable unit if the life information of the second consumable unit is received before the delivery instruction is outputted, and wherein an instruction to deliver a replacement consumable unit for the first consumable unit to the determined delivery address is outputted.

[47] A non-transitory computer-readable recording medium having a replacement consumable unit management program stored thereon to make a computer of a replacement consumable unit management apparatus execute:

receiving the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus causing the life information of the first consumable unit and/or a different image forming apparatus provided at the same place as the image forming apparatus causing the life information of the first consumable unit;

transmitting an instruction to deliver a replacement consumable unit for the first consumable unit, depending on the life information of the first consumable unit which is received; and determining a first delivery address or a second delivery address for a replacement consumable unit for the first consumable unit, based on the service log information if the service log information is received before the delivery instruction is outputted, and wherein an instruction to deliver a replacement consumable unit for the first consumable unit to the determined delivery address is outputted.

[48] A non-transitory computer-readable recording medium having a replacement consumable unit management program stored thereon to make a computer of an image forming apparatus execute:

receiving the life information of a first consumable unit loaded on the image forming apparatus and the life information of a second consumable unit loaded on the image forming apparatus causing the life information of the first consumable unit and/or a different image forming apparatus provided at the same place as the image forming apparatus causing the life information of the first consumable unit;

outputting an instruction to deliver a replacement consumable unit for the first consumable unit, depending on the life information of the first consumable unit; and determining a first delivery address or a second delivery address for a replacement consumable unit for the first consumable unit based on the life information of the second consumable unit if the life information of the second consumable unit is received before the delivery instruction is outputted, and wherein an instruction to deliver a replacement consumable unit for the first consumable unit to the determined delivery address is outputted.

[49] A non-transitory computer-readable recording medium having a replacement consumable unit management program stored thereon to make a computer of an image forming apparatus execute:

receiving the life information of a first consumable unit and service log information indicating the time difference between a predetermined time interval between regularly scheduled services and a period of time actually having elapsed after the regularly scheduled service which is most recently implemented, from the image forming apparatus causing the life information of the first consumable unit and/or a different image forming apparatus provided at the same place as the image forming apparatus causing the life information of the first consumable unit;

outputting an instruction to deliver a replacement consumable unit for the first consumable unit, depending on the life information of the first consumable unit which is received; and determining a first delivery address or a second delivery address for a replacement consumable unit for the first consumable unit, based on the service log information if the service log information is received before the delivery instruction is outputted, and wherein an instruction to deliver a replacement consumable unit for the first consumable unit to the determined delivery address is outputted.

According to the invention as recited in the aforementioned item [1], a replacement consumable unit management apparatus manages the remaining amount information or the life information of one consumable unit of one color or more than one consumable unit of different colors loaded on one or more than one image forming apparatus which the replacement consumable unit management apparatus can access via a communication circuit, and also manages stock information indicating the states of the stocks of replacement consumable units for the one or more than one consumable unit. Receiving from such an image forming apparatus, consumable unit replacement information indicating a consumable unit has been replaced with a new one, the replacement consumable unit management apparatus determines a replacement consumable unit to be delivered to the same delivery address as the new consumable unit most recently loaded, based on the remaining amount information or the life information and the stock information, and then outputs an instruction to deliver that replacement consumable unit.

In this mode described above, when a consumable unit loaded on an image forming apparatus is replaced with a new one, a replacement consumable unit to be delivered to the same delivery address as the new consumable unit most recently loaded is determined based on the remaining amount information or the life information of the new consumable unit and the stock information of a replacement consumable unit for the new consumable unit. For example, if the new consumable unit cannot be replaced because of no stock and there is, at the same delivery address as the new consumable unit, another consumable unit whose remaining amount information or life information is smaller than a first predetermined value, replacement consumable units for these both consumable units can be delivered together. Therefore, this is more cost-effective than delivering them separately. Furthermore, if there is a replacement consumable unit for the new consumable unit, a delivery instruction is kept on hold and later will be outputted at the right time. Therefore, the problem about the space for keeping the stocks of replacement consumable units can be eliminated.

According to the invention as recited in the aforementioned item [2], the states of the stocks of replacement consumable units are properly monitored, which contributes to controlling deliveries of replacement consumable units successfully.

According to the invention as recited in the aforementioned item [3], the advantage on saving the costs of delivery without causing the costs of stock keeping is more assured.

According to the invention as recited in the aforementioned item [4], the inconvenience that, after an instruction to deliver a replacement consumable unit for a new consumable unit most recently loaded is kept on hold, the new consumable unit cannot be replaced with a new one due to no stock when it becomes nearly empty or nearly reaches the end of life, is eliminated.

According to the invention as recited in the aforementioned item [5], the costs of delivering replacement toner cartridges can be reduced without causing the costs of keeping the stocks of replacement toner cartridges.

According to the invention as recited in the aforementioned item [6], an order for a necessary replacement consumable unit is automatically placed with use of the order receiving server.

According to the invention as recited in the aforementioned item [7], the image forming apparatus contributes to saving the costs of delivery without causing the costs of stock keeping, by controlling deliveries of replacement consumable units successfully.

According to the invention as recited in the aforementioned item [8], the states of the stocks of replacement consumable units are properly monitored, which contributes to controlling deliveries of replacement consumable units successfully.

According to the invention as recited in the aforementioned item [9], the advantage on saving the costs of delivery without causing the costs of stock keeping is more assured.

According to the invention as recited in the aforementioned item [10], the inconvenience that, after an instruction to deliver a replacement consumable unit for a new consumable unit most recently loaded is kept on hold, the new consumable unit cannot be replaced with a new one due to no stock when it becomes nearly empty or nearly reaches the end of life, is eliminated.

According to the invention as recited in the aforementioned item [11], the costs of delivering replacement toner cartridges can be reduced without causing the costs of keeping the stocks of replacement toner cartridges.

According to the invention as recited in the aforementioned item [12], an order for a necessary replacement consumable unit is automatically placed with use of the order receiving server.

According to the invention as recited in the aforementioned item [13], the replacement consumable unit management system contributes to saving the costs of delivery without causing the costs of stock keeping, by controlling deliveries of replacement consumable units successfully.

According to the invention as recited in the aforementioned item [14], the states of the stocks of replacement consumable units are properly monitored, which contributes to controlling deliveries of replacement consumable units successfully.

According to the invention as recited in the aforementioned item [15], the advantage on saving the costs of delivery without causing the costs of stock keeping is more assured.

According to the invention as recited in the aforementioned item [16], the inconvenience that, after an instruction to deliver a replacement consumable unit for a new consumable unit most recently loaded is kept on hold, the new consumable unit cannot be replaced with a new one due to no stock when it becomes nearly empty or nearly reaches the end of life, is eliminated.

According to the invention as recited in the aforementioned item [17], the costs of delivering replacement toner cartridges can be reduced without causing the costs of keeping the stocks of replacement toner cartridges.

According to the invention as recited in the aforementioned item [18], an order for a necessary replacement consumable unit is automatically placed with use of the order receiving server.

According to the invention as recited in the aforementioned item [19], the advantage on saving the costs of delivery without causing the costs of stock keeping is assured by controlling deliveries of replacement consumable units successfully.

According to the invention as recited in the aforementioned item [20], a computer of the replacement consumable unit management apparatus contributes to saving the costs of delivery without causing the costs of stock keeping, by controlling deliveries of replacement consumable units successfully.

According to the invention as recited in the aforementioned item [21], a computer of the image forming apparatus contributes to saving the costs of delivery without causing the costs of stock keeping, by controlling deliveries of replacement consumable units successfully.

According to the invention as recited in the aforementioned item [22], an instruction to deliver a replacement consumable unit for the first consumable unit is outputted depending on the life information of the first consumable unit. Meanwhile, a first delivery address or a second delivery address for a replacement consumable unit for the first consumable unit is determined based on the life information of the second consumable unit loaded on an image forming apparatus causing the life information of the first consumable unit or a different image forming apparatus provided at the same place as the image forming apparatus causing the life information of the first consumable unit, if the life information of the second consumable unit is received before the delivery instruction is outputted. And then, an instruction to deliver a replacement consumable unit for the first consumable unit to the determined delivery address. Therefore, if there is a need to deliver a replacement consumable unit such as a replacement toner cartridge while a consumable unit such as a transfer belt unit nearly reaches the end of life, a replacement toner cartridge is delivered to a service center, not to the user's place, so that a service engineer can visit the user's place with both a replacement transfer belt unit and the received replacement toner cartridge. In this way, the inconvenience that the user feels that the service is somewhat unfriendly because of receiving a replacement toner cartridge after a regularly scheduled service by a service engineer is eliminated.

According to the invention as recited in the aforementioned item [23], before an instruction to deliver a replacement consumable unit for the first consumable unit for image forming which is supposed to be replaced with a new one by a user is outputted, a right delivery address, the user's place or a service center, is determined based on the life information of the second consumable unit for image forming which is supposed to be replaced by a new one by a service engineer. For example, if there is a need to deliver a replacement consumable unit for the first consumable unit while the second consumable unit nearly reaches the end of life, a replacement consumable unit for the first consumable unit is delivered to a service center, not the user's place. In this way, the inconvenience that the user feels that the service is somewhat unfriendly because of receiving a replacement consumable unit for the first consumable unit after a service engineer visits the user's place and replaces the second consumable unit with a new one is eliminated.

According to the invention as recited in the aforementioned item [24], when the second consumable unit nearly reaches the end of life, a replacement consumable unit for the first consumable unit is properly delivered to the second delivery address.

According to the invention as recited in the aforementioned item [25], a service engineer is allowed to visit the user's place with a replacement consumable unit for the second consumable unit, a replacement consumable unit for the first consumable unit, and a replacement consumable unit for another first consumable unit which also will need to be replaced soon.

According to the invention as recited in the aforementioned item [26], when there is a need to deliver a replacement consumable unit such as a replacement toner cartridge, a right delivery address is determined based on the service log information received from the image forming apparatus. For example, if there is a need to deliver a replacement toner cartridge while the time of a next regularly scheduled service is closer, a replacement toner cartridge is delivered to a service center, not the user's place, so that a service engineer can visit the user's place with it. In this way, the inconvenience that the user feels that the service is somewhat unfriendly because of receiving a replacement toner cartridge after a regularly scheduled service by a service engineer is eliminated.

According to the invention as recited in the aforementioned item [27], when the time of a next regularly scheduled service is closer, a replacement consumable unit for the first consumable unit for image forming which is supposed to be replaced with a new one by a user is delivered to a service center, not the user's place, so that a service engineer can visit the user's place with it. In this way, the inconvenience that the user feels that the service is somewhat unfriendly because of receiving a replacement consumable unit for the first consumable unit after a regularly scheduled service by a service engineer is eliminated.

According to the invention as recited in the aforementioned item [28], when the time of a next regularly scheduled service is closer, a replacement consumable unit for the first consumable unit for image forming which is supposed to be replaced with a new one by a user is properly delivered to a service center, not the user's place.

According to the invention as recited in the aforementioned item [29], an order for a necessary replacement toner cartridge is automatically placed with use of the order receiving server.

According to the invention as recited in the aforementioned item [30], if there is a need to deliver a replacement consumable unit such as a replacement toner cartridge while a consumable unit such as a transfer belt unit nearly reaches the end of life, a replacement toner cartridge is delivered to a service center, not the user's place, so that a service engineer can visit the user's place with both a replacement transfer belt unit and the received replacement toner cartridge. In this way, the image forming apparatus contributes to eliminating the inconvenience that the user feels that the service is somewhat unfriendly because of receiving a replacement toner cartridge after a regularly scheduled service by a service engineer.

According to the invention as recited in the aforementioned item [31], when the second consumable unit nearly reaches the end of life, a replacement consumable unit for the first consumable unit is delivered to a service center, not the user's place, so that a service engineer can visit the user's place with both a replacement consumable unit for the second consumable unit and the received replacement consumable unit for the first consumable unit.

According to the invention as recited in the aforementioned item [32], when the second consumable unit nearly reaches the end of life, a replacement consumable unit for the first consumable unit is properly delivered to the second delivery address.

According to the invention as recited in the aforementioned item [33], a service engineer is allowed to visit the user's place with a replacement consumable unit for the second consumable unit, a replacement consumable unit for the first consumable unit, and a replacement consumable unit for another first consumable unit which also will need to be replaced soon.

According to the invention as recited in the aforementioned item [34], when there is a need to deliver a replacement consumable unit such as a replacement toner cartridge, a right delivery address is determined based on the service log information received from the image forming apparatus. Therefore, if there is a need to deliver a replacement toner cartridge while the time of a next regularly scheduled service is closer, a replacement toner cartridge is delivered to a service center, not the user's place, so that a service engineer can visit the user's place with it. In this way, the image forming apparatus contributes to eliminating the inconvenience that the user feels that the service is somewhat unfriendly because of receiving a replacement toner cartridge after a regularly scheduled service by a service engineer.

According to the invention as recited in the aforementioned item [35], when the time of a next regularly scheduled service is closer, a replacement consumable unit for the first consumable unit for image forming which is supposed to be replaced with a new one by a user is delivered to a service center, not the user's place, so that a service engineer can visit the user's place with it. In this way, the inconvenience that the user feels that the service is somewhat unfriendly because of receiving a replacement consumable unit for the first consumable unit after a regularly scheduled service by a service engineer is eliminated.

According to the invention as recited in the aforementioned item [36], when the time of a next regularly scheduled service is closer, a replacement consumable unit for the first consumable unit for image forming which is supposed to be replaced with a new one by a user is properly delivered to a service center, not the user's place.

According to the invention as recited in the aforementioned item [37], an order for a necessary replacement toner cartridge is automatically placed with use of the order receiving server.

According to the invention as recited in the aforementioned item [38], if there is a need to deliver a replacement consumable unit such as a replacement toner cartridge while a consumable unit such as a transfer belt unit nearly reaches the end of life, a replacement toner cartridge is delivered to a service center, not the user's place, so that a service engineer can visit the user's place with both a replacement transfer belt unit and the received replacement toner cartridge. In this way, the replacement consumable unit management system contributes to eliminating the inconvenience that the user feels that the service is somewhat unfriendly because of receiving a replacement toner cartridge after a regularly scheduled service by a service engineer.

According to the invention as recited in the aforementioned item [39], when the second consumable unit nearly reaches the end of life, a replacement consumable unit for the first consumable unit is delivered to a service center, not the user's place, so that a service engineer can visit the user's place with both a replacement consumable unit for the second consumable unit and the received replacement consumable unit for the first consumable unit.

According to the invention as recited in the aforementioned item [40], when the second consumable unit nearly reaches the end of life, a replacement consumable unit for the first consumable unit is properly delivered to the second delivery address.

According to the invention as recited in the aforementioned item [40], a service engineer is allowed to visit the user's place with a replacement consumable unit for the second consumable unit, a replacement consumable unit for the first consumable unit, and a replacement consumable unit for another first consumable unit which also will need to be replaced soon.

According to the invention as recited in the aforementioned item [42], when there is a need to deliver a replacement consumable unit such as a replacement toner cartridge, a right delivery address is determined based on the service log information received from the image forming apparatus. Therefore, if there is a need to deliver a replacement toner cartridge while the time of a next regularly scheduled service is closer, a replacement toner cartridge is delivered to a service center, not the user's place, so that a service engineer can visit the user's place with it. In this way, the replacement consumable unit management system contributes to eliminating the inconvenience that the user feels that the service is somewhat unfriendly because of receiving a replacement toner cartridge after a regularly scheduled service by a service engineer.

According to the invention as recited in the aforementioned item [43], when the time of a next regularly scheduled service is closer, a replacement consumable unit for the first consumable unit for image forming which is supposed to be replaced with a new one by a user is delivered to a service center, not the user's place, so that a service engineer can visit the user's place with it. In this way, the inconvenience that the user feels that the service is somewhat unfriendly because of receiving a replacement consumable unit for the first consumable unit after a regularly scheduled service by a service engineer is eliminated.

According to the invention as recited in the aforementioned item [44], when the time of a next regularly scheduled service is closer, a replacement consumable unit for the first consumable unit for image forming which is supposed to be replaced with a new one by a user is properly delivered to a service center, not the user's place.

According to the invention as recited in the aforementioned item [45], an order for a necessary replacement toner cartridge is automatically placed with use of the order receiving server.

According to the invention as recited in the aforementioned item [46], if there is a need to deliver a replacement consumable unit such as a replacement toner cartridge while a consumable unit such as a transfer belt unit nearly reaches the end of life, a computer of the replacement consumable unit management apparatus outputs an instruction to deliver a replacement toner cartridge to a service center, not the user's place, so that a service engineer can visit the user's place with both a replacement transfer belt unit and the received replacement toner cartridge.

According to the invention as recited in the aforementioned item [47], when there is a need to deliver a replacement consumable unit such as a replacement toner cartridge, a computer of the replacement consumable unit management apparatus determines a right delivery address based on the service log information received from the image forming apparatus. Therefore, if there is a need to deliver a replacement toner cartridge while the time of a next regularly scheduled service is closer, the computer outputs an instruction to deliver a replacement toner cartridge to a service center, not the user's place.

According to the invention as recited in the aforementioned item [48], if there is a need to deliver a replacement consumable unit such as a replacement toner cartridge while a consumable unit such as a transfer belt unit nearly reaches the end of life, a computer of the image forming apparatus outputs an instruction to deliver a replacement toner cartridge to a service center, not the user's place, so that a service engineer can visit the user's place with both a replacement transfer belt unit and the received replacement toner cartridge.

According to the invention as recited in the aforementioned item [49], when there is a need to deliver a replacement consumable unit such as a replacement toner cartridge, a computer of the image forming apparatus determines a right delivery address based on the service log information received from the image forming apparatus. Therefore, if there is a need to deliver a replacement toner cartridge while the time of a next regularly scheduled service is closer, the computer outputs an instruction to deliver a replacement toner cartridge to a service center, not the user's place.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. A replacement consumable unit management apparatus comprising:

a receiver which receives consumable unit replacement information indicating that at least one consumable unit of at least one color has been replaced with a new one, from at least one image forming apparatus which the replacement consumable unit management apparatus can access via a communication circuit;

a consumable unit manager which manages remaining amount information or life information of the at least one consumable unit, and stock information indicating a state of stock of replacement consumable units for the at least one consumable unit for the at least one image forming apparatus;

a determiner which, if the receiver receives the consumable unit replacement information while a consumable unit which cannot be replaced with a new one because of no stock and a consumable unit whose remaining amount information or life information is smaller than a first predetermined value are both used at the same place as the new consumable unit was most recently loaded, makes a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together;

when the receiver receives the consumable unit replacement information while there are a consumable unit which cannot be replaced with a new one because of no stock and a consumable unit whose remaining amount information or life information is larger than the first predetermined value, but smaller than a second predetermined value, the determiner makes a second determination that the first replacement consumable unit and a third replacement consumable unit of the same color as the consumable unit whose remaining amount information or life information is larger than the first predetermined value, but smaller than the second predetermined value, should be kept on hold until the remaining amount information or the life information reaches the first predetermined value, and then be delivered together when the remaining amount information or the life information reaches the first predetermined value; and when the receiver receives the consumable unit replacement information while there is a consumable unit that cannot be replaced with a new one because of no stock and there is no consumable unit whose remaining amount information or life information is smaller than the second predetermined value, the determiner makes a third determination that only the first replacement consumable unit should be delivered; and a transmitter which outputs a delivery instruction as determined by the determiner.

2. The replacement consumable unit management apparatus as recited in claim 1, wherein:

the stock information managed by the consumable unit manager indicates that:

there is no replacement consumable unit in stock;

there is a replacement consumable unit in stock while another replacement consumable unit has not been shipped out; or there is a replacement consumable unit in stock while another replacement consumable unit has been shipped out; and the consumable unit manager updates the stock information when the receiver receives the consumable unit replacement information or when the transmitter outputs the delivery instruction.

3. The replacement consumable unit management apparatus as recited in claim 1, wherein after making the second determination, when the remaining amount information or the life information of the consumable unit which cannot be replaced with a new one because of no stock reaches the second predetermined value before that of the consumable unit whose remaining amount information or life information is larger than the first predetermined value, but smaller than the second predetermined value, reaches the first predetermined value, the determiner makes a fourth determination that only the first replacement consumable unit should be delivered.

4. The replacement consumable unit management apparatus as recited in claim 1, wherein the consumable units are toner cartridges.

5. The replacement consumable unit management apparatus as recited in claim 1, wherein the transmitter outputs the delivery instruction to an order receiving server which the replacement consumable unit management apparatus can access via a communication circuit to place an order for a replacement consumable unit.

6. An image forming apparatus comprising:

a detector which detects that a consumable unit loaded on the image forming apparatus or loaded on a different image forming apparatus which the image forming apparatus can access via a communication circuit has been replaced with a new one;

a consumable unit manager which manages the remaining amount information or the life information and stock information indicating a state of stock of replacement consumable units, by the consumable units of different colors than a color of the consumable unit loaded on the image forming apparatus or loaded on the different image forming apparatus;

a determiner which, when the detector detects that the consumable unit has been replaced with a new one, determines a right replacement consumable unit to be delivered to the same place as the new consumable unit most recently loaded, when the remaining amount information or the life information of another consumable unit reaches a predetermined value and when there is no stock remaining of the new consumable unit;

if there are both any consumable unit that cannot be replaced with a new one because of no stock and any consumable unit whose remaining amount information or life information is larger than the first predetermined value but smaller than a second predetermined value, the determiner makes a second determination that the first replacement consumable unit and a third replacement consumable unit of the same color as the consumable unit whose remaining amount information or life information is larger than the first predetermined value but smaller than the second predetermined value should be kept on hold before the remaining amount information or the life information reaches the first predetermined value then be delivered together when the remaining amount information or the life information reaches the first predetermined value; and if there is any consumable unit that cannot be replaced with a new one because of no stock but there is no consumable unit whose remaining amount information or life information is smaller than the first predetermined value neither no consumable unit whose remaining amount information or life information is larger than the first predetermined value but smaller than a second predetermined value, the determiner makes a third determination that only the first replacement consumable unit should be delivered; and a transmitter which outputs a delivery instruction as determined by the determiner.

7. The image forming apparatus as recited in claim 6, wherein:

the stock information managed by the consumable unit manager indicates that:

there is no replacement consumable unit in stock;

there is a replacement consumable unit in stock while another replacement consumable unit has not been shipped out; or there is a replacement consumable unit in stock while another replacement consumable unit has been shipped out; and the consumable unit manager updates the stock information when the receiver receives the consumable unit replacement information or when the transmitter outputs the delivery instruction.

8. The image forming apparatus as recited in claim 6, wherein after making the second determination, when the remaining amount information or the life information of the consumable unit which cannot be replaced with a new one because of no stock reaches the second predetermined value before that of the consumable unit whose remaining amount information or life information is larger than the first predetermined value but smaller than the second predetermined value reaches the first predetermined value, the determiner makes a fourth determination that only the first replacement consumable unit should be delivered.

9. The image forming apparatus as recited in claim 6, wherein the consumable units are toner cartridges.

10. The image forming apparatus as recited in claim 6, wherein the transmitter outputs the delivery instruction to an order receiving server which the image forming apparatus can access via a communication circuit to place an order for a replacement consumable unit.

11. A replacement consumable unit management apparatus comprising:

a receiver which receives life information of a first consumable unit from at least one image forming apparatus which the replacement consumable unit management apparatus can access via a communication circuit, and life information of a second consumable unit loaded on the at least one image forming apparatus sending the life information of the first consumable unit or a different image forming apparatus provided at the same place as the image forming apparatus sending the life information of the first consumable unit;

a transmitter which outputs an instruction to deliver a replacement consumable unit for the first consumable unit, depending on the life information of the first consumable unit; and a determiner which determines a first delivery address or a second delivery address for the replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

12. The replacement consumable unit management apparatus as recited in claim 11, wherein the first consumable unit serves for image forming and is supposed to be replaced with a new one by a user; the second consumable unit also serves for image forming and is supposed to be replaced with a new one by a service engineer; the first delivery address corresponds to the place in which the image forming apparatuses are provided; and the second delivery address corresponds to a service center.

13. The replacement consumable unit management apparatus as recited in claim 11, wherein the determiner determines the second delivery address if the life information of the second consumable unit is smaller than or equal to a predetermined value, or the first delivery address if the life information of the second consumable unit is larger than the predetermined value.

14. The replacement consumable unit management apparatus as recited in claim 13, wherein if the determiner determines the second delivery address while any other first consumable unit whose life information is smaller than the predetermined value is loaded on the image forming apparatus causing the life information of the first consumable unit or the different image forming apparatus provided at the same place as the image forming apparatus sending the life information of the first consumable unit, the transmitter further outputs an instruction to deliver a replacement consumable unit for the other first consumable unit to the second delivery address.

15. The replacement consumable unit management apparatus as recited in claim 11, wherein the transmitter outputs the delivery instruction to an order receiving server which the image forming apparatus can access via a communication circuit to place an order for a replacement consumable unit.

16. A replacement consumable unit management apparatus comprising:

a receiver which receives the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus sending the life information of the first consumable unit and/or a different image forming apparatus provided at the same place as the image forming apparatus causing the life information of the first consumable unit;

a transmitter which outputs an instruction to deliver a replacement consumable unit for the first consumable unit, depending on the life information of the first consumable unit which is received by the receiver;

a determiner which determines a first delivery address or a second delivery address for a replacement consumable unit for the first consumable unit, based on the service log information if the receiver receives the service log information before the transmitter outputs the delivery instruction, and wherein the transmitter outputs an instruction to deliver a replacement consumable unit for the first consumable unit to the determined delivery address.

17. The replacement consumable unit management apparatus as recited in claim 16, wherein the first consumable unit serves for image forming and is supposed to be replaced with a new one by a user; the first delivery address corresponds to the place in which the image forming apparatuses are provided; and the second delivery address corresponds to a service center.

18. The replacement consumable unit management apparatus as recited in claim 16, wherein the determiner determines the second delivery address if the service log information is smaller than or equal to a predetermined value, or the first delivery address if the service log information is larger than the predetermined value.

19. A nontransitory computer readable medium encoded with a program for making a computer of a replacement consumable unit management apparatus perform a method comprising:

using a receiver to receive consumable unit replacement information indicating that at least one consumable unit of at least one color has been replaced with a new one, from at least one image forming apparatus which the replacement consumable unit management apparatus can access via a communication circuit;

using a consumable unit manager to manage remaining amount information or life information of the at least one consumable unit, and stock information indicating a state of stock of replacement consumable units for the at least one consumable unit for the at least one image forming apparatus;

using a determiner to, if the receiver receives the consumable unit replacement information while a consumable unit which cannot be replaced with a new one because of no stock and a consumable unit whose remaining amount information or life information is smaller than a first predetermined value are both used at the same place as the new consumable unit was most recently loaded, make a first determination that a first replacement consumable unit of the same color as the consumable unit which cannot be replaced with a new one because of no stock and a second consumable unit of the same color as the consumable unit whose remaining amount information or life information is smaller than the first predetermined value should be delivered together;

when the receiver receives the consumable unit replacement information while there are a consumable unit which cannot be replaced with a new one because of no stock and a consumable unit whose remaining amount information or life information is larger than the first predetermined value, but smaller than a second predetermined value, the determiner makes a second determination that the first replacement consumable unit and a third replacement consumable unit of the same color as the consumable unit whose remaining amount information or life information is larger than the first predetermined value, but smaller than the second predetermined value, should be kept on hold until the remaining amount information or the life information reaches the first predetermined value, and then be delivered together when the remaining amount information or the life information reaches the first predetermined value; and when the receiver receives the consumable unit replacement information while there is a consumable unit that cannot be replaced with a new one because of no stock and there is no consumable unit whose remaining amount information or life information is smaller than the second predetermined value, the determiner makes a third determination that only the first replacement consumable unit should be delivered; and using a transmitter to output a delivery instruction as determined by the determiner.

20. A nontransitory computer readable medium encoded with a program for making a computer of an image forming apparatus perform a method comprising:

using a detector to detect that a consumable unit loaded on the image forming apparatus or loaded on a different image forming apparatus which the image forming apparatus can access via a communication circuit has been replaced with a new one;

using a consumable unit manager to manage the remaining amount information or the life information and stock information indicating a state of stock of replacement consumable units, by the consumable units of different colors than a color of the consumable unit loaded on the image forming apparatus or loaded on the different image forming apparatus;

using a determiner to, when the detector detects that the consumable unit has been replaced with a new one, determine a right replacement consumable unit to be delivered to the same place as the new consumable unit most recently loaded, when the remaining amount information or the life information of another consumable unit reaches a predetermined value and when there is no stock remaining of the new consumable unit;

if there are both any consumable unit that cannot be replaced with a new one because of no stock and any consumable unit whose remaining amount information or life information is larger than the first predetermined value but smaller than a second predetermined value, the determiner makes a second determination that the first replacement consumable unit and a third replacement consumable unit of the same color as the consumable unit whose remaining amount information or life information is larger than the first predetermined value but smaller than the second predetermined value should be kept on hold before the remaining amount information or the life information reaches the first predetermined value then be delivered together when the remaining amount information or the life information reaches the first predetermined value; and if there is any consumable unit that cannot be replaced with a new one because of no stock but there is no consumable unit whose remaining amount information or life information is smaller than the first predetermined value neither no consumable unit whose remaining amount information or life information is larger than the first predetermined value but smaller than a second predetermined value, the determiner makes a third determination that only the first replacement consumable unit should be delivered; and using a transmitter to output a delivery instruction as determined by the determiner.

21. An image forming apparatus comprising:

a receiver which receives life information of a first consumable unit from at least one image forming apparatus which the replacement consumable unit management apparatus can access via a communication circuit, and life information of a second consumable unit loaded on the at least one image forming apparatus sending the life information of the first consumable unit or a different image forming apparatus provided at the same place as the image forming apparatus sending the life information of the first consumable unit;

a transmitter which outputs an instruction to deliver a replacement consumable unit for the first consumable unit, depending on the life information of the first consumable unit; and a determiner which determines a first delivery address or a second delivery address for the replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

22. An image forming apparatus comprising:

a receiver which receives the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus sending the life information of the first consumable unit and/or a different image forming apparatus provided at the same place as the image forming apparatus causing the life information of the first consumable unit;

a transmitter which outputs an instruction to deliver a replacement consumable unit for the first consumable unit, depending on the life information of the first consumable unit which is received by the receiver;

a determiner which determines a first delivery address or a second delivery address for a replacement consumable unit for the first consumable unit, based on the service log information if the receiver receives the service log information before the transmitter outputs the delivery instruction, and wherein the transmitter outputs an instruction to deliver a replacement consumable unit for the first consumable unit to the determined delivery address.

23. A nontransitory computer readable medium encoded with a program for making a computer of a replacement consumable unit management apparatus perform a method comprising:

using a receiver to receive life information of a first consumable unit from at least one image forming apparatus which the replacement consumable unit management apparatus can access via a communication circuit, and life information of a second consumable unit loaded on the at least one image forming apparatus sending the life information of the first consumable unit or a different image forming apparatus provided at the same place as the image forming apparatus sending the life information of the first consumable unit;

using a transmitter to output an instruction to deliver a replacement consumable unit for the first consumable unit, depending on the life information of the first consumable unit; and using a determiner to determine a first delivery address or a second delivery address for the replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

24. A nontransitory computer readable medium encoded with a program for making a computer of a replacement consumable unit management apparatus perform a method comprising:

using a receiver to receive the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus sending the life information of the first consumable unit and/or a different image forming apparatus provided at the same place as the image forming apparatus causing the life information of the first consumable unit;

using a transmitter to output an instruction to deliver a replacement consumable unit for the first consumable unit, depending on the life information of the first consumable unit which is received by the receiver;

using a determiner to determine a first delivery address or a second delivery address for a replacement consumable unit for the first consumable unit, based on the service log information if the receiver receives the service log information before the transmitter outputs the delivery instruction, and wherein the transmitter outputs an instruction to deliver a replacement consumable unit for the first consumable unit to the determined delivery address.

25. A nontransitory computer readable medium encoded with a program for making a computer of an image forming apparatus perform a method comprising:

using a receiver to receive life information of a first consumable unit from at least one image forming apparatus which the replacement consumable unit management apparatus can access via a communication circuit, and life information of a second consumable unit loaded on the at least one image forming apparatus sending the life information of the first consumable unit or a different image forming apparatus provided at the same place as the image forming apparatus sending the life information of the first consumable unit;

using a transmitter to output an instruction to deliver a replacement consumable unit for the first consumable unit, depending on the life information of the first consumable unit; and using a determiner to determine a first delivery address or a second delivery address for the replacement consumable unit for the first consumable unit based on the life information of the second consumable unit if the receiver receives the life information of the second consumable unit before the transmitter outputs the delivery instruction, and wherein the transmitter outputs an instruction to deliver a replacement consumable unit for the first consumable unit to the determined delivery address.

26. A nontransitory computer readable medium encoded with a program for making a computer of an image forming apparatus perform a method comprising:

using a receiver to receive the life information of a first consumable unit from one or more than one image forming apparatus which the replacement consumable unit management apparatus can access via a communication circuit, and service log information indicating the time difference between a predetermined time interval between regularly scheduled services and a period of time actually having elapsed after the regularly scheduled service which is most recently implemented, from the image forming apparatus sending the life information of the first consumable unit and/or a different image forming apparatus provided at the same place as the image forming apparatus causing the life information of the first consumable unit;

using a transmitter to output an instruction to deliver a replacement consumable unit for the first consumable unit, depending on the life information of the first consumable unit which is received by the receiver;

using a determiner to determine a first delivery address or a second delivery address for a replacement consumable unit for the first consumable unit, based on the service log information if the receiver receives the service log information before the transmitter outputs the delivery instruction, and wherein the transmitter outputs an instruction to deliver a replacement consumable unit for the first consumable unit to the determined delivery address.

* * * * *